US006485898B2

(12) United States Patent
Yoshioka et al.

(10) Patent No.: US 6,485,898 B2
(45) Date of Patent: Nov. 26, 2002

(54) PHOTOTHERMOGRAPHIC MATERIAL

(75) Inventors: Yasuhiro Yoshioka, Minami-ashigara (JP); Kouta Fukui, Minami-ashigara (JP); Makoto Suzuki, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/754,371

(22) Filed: Jan. 5, 2001

(65) Prior Publication Data

US 2001/0029000 A1 Oct. 11, 2001

(30) Foreign Application Priority Data

Jan. 5, 2000 (JP) ..... 2000-000208
Jan. 11, 2000 (JP) ..... 2000-002311

(51) Int. Cl.[7] ..... G03C 1/498; G03C 1/34

(52) U.S. Cl. ..... 430/619; 430/531; 430/607; 430/613; 430/614; 430/617

(58) Field of Search ..... 430/619, 531, 430/600, 607, 613, 614, 617, 566

(56) References Cited

U.S. PATENT DOCUMENTS 5,300,415 A * 4/1994 Sato et al. ..... 430/513
5,952,167 A * 9/1999 Okada et al. ..... 430/619
5,958,668 A * 9/1999 Matsumoto et al. ..... 430/619
6,146,823 A * 11/2000 Katoh ..... 430/619
6,190,854 B1 * 2/2001 Sampei ..... 430/617

FOREIGN PATENT DOCUMENTS

GB 1498406 * 1/1978

* cited by examiner

*Primary Examiner*—Thorl Chea
(74) *Attorney, Agent, or Firm*—Birch, Stewart, Kolasch & Birch, LLP

(57) ABSTRACT

A photothermographic material comprising a defined amount of a compound represented by the following general formula as a reducing agent is disclosed. In the following general formula, $R^1$ and $R^{1'}$ each independently represent an alkyl group, at least one of which is a secondary or tertiary alkyl group; $R^2$ and $R^{2'}$ each independently represent hydrogen atom or a group that can be a substituent on benzene ring; L represents —S— group or a —CH($R^3$)— group where $R^3$ represents hydrogen atom or an alkyl group; and X and X' each independently represent hydrogen atom or a group that can be a substituent on benzene ring. The photothermographic material is characterized by providing sufficient image density by heat development, and showing good silver color tone and little change with time after the development.

22 Claims, 1 Drawing Sheet

PHOTOTHERMOGRAPHIC MATERIAL

FIELD OF THE INVENTION

The present invention relates to a photothermographic material. In particular, the present invention relates to a photothermographic material that provides sufficient image density with a small amount of reducing agent as well as improved color tone and improved color tone change during storage.

BACKGROUND OF THE INVENTION

In recent years, reduction of amount of waste processing solutions is strongly desired in the field of medical diagnosis and the field of photographic art from the standpoints of environmental protection and space savings. Therefore, techniques relating to photothermographic materials for medical diagnosis films and photographic art films are required which enables efficient exposure by a laser image setter or laser imager and formation of a clear black image having high resolution and sharpness. The photothermographic materials can provide users with a simple and non-polluting heat development processing system that eliminates the use of solution-type processing chemicals.

The same applies to the field of ordinary image-forming materials. However, photo-images for medical use require high quality excellent in sharpness and graininess as they need very fine images. In addition, for easy diagnosis, cold monochromatic images are preferred. At present, various types of hard copy systems using pigments and dyes, for example, ink jet printers and electrophotographic systems, are available as ordinary imaging systems. However, no satisfactory image-forming system is available for medical images.

Meanwhile, photothermographic systems utilizing a silver salt of an organic acid are described in, for example, U.S. Pat. Nos. 3,152,904 and 3,457,075 and Klostervoer, "Thermally Processed Silver Systems", Imaging Processes and Materials, Neblette, 8th ed., compiled by J. Sturge, V. Walworth and A. Shepp, Chapter 9, p. 279, (1989). In particular, the photothermographic material comprises a photosensitive layer containing a photocatalyst (e.g., silver halide) in a catalytically active amount, a heat developing agent, a reducible silver salt (e.g., silver salt of an organic acid), and optionally a toning agent for controlling color tone of silver, which are usually dispersed in a binder matrix. When the photothermographic material is heated at a high temperature (e.g., 80° C. or higher) after light exposure, a monochromatic black silver image is produced through an oxidation-reduction reaction between the silver halide or the reducible silver salt (which functions as an oxidizing agent) and the heat developing agent. The oxidation-reduction reaction is accelerated by catalytic action of a latent image of silver halide generated upon exposure. Therefore, the monochromatic silver images are formed in exposed areas of the materials. This technique is disclosed in many references including U.S. Pat. No. 2,910,377 and Japanese Patent Publication (Kokoku, hereinafter referred to as JP-B) 43-4924 and Fuji Medical Dry Imager FM-DP L was put into the market as an image-forming system for medical diagnosis utilizing photothermographic materials.

The photothermographic material are characterized in that they do not require use of any process solution that necessitates troublesome management, and thus they are clean materials and can be used with a low running cost. Therefore, they are favorably accepted in the market mainly constituted by hospitals.

However, since the photothermographic materials are not subjected to a fixation treatment after the heat development, they suffer from a problem that the thermally reactive silver salt of an organic acid and reducing agent are left as they are in the photosensitive materials, and thus white portions are colored or image portions show color change when the materials are stored for a long period of time after the development. They also suffer from a problem that images after the development show bad gray balance and become bluish. If the amount of the reducing agent is reduced in order to ameliorate these problems, the maximum image density is unfavorably reduced.

Under such a technical situation, it has been strongly desired that there can be obtained gray color tone with good balance from a low density region to a high density region for silver images generated by heat development performed at a practical reaction temperature and within a practical reaction time, and such good gray color tone should not be changed by heat or light during storage. Further, conventional photothermographic materials also suffer from a drawback that they show strong environmental temperature and humidity dependency, and its improvement is desired.

Therefore, an object of the present invention is to provide a photothermographic material that can provide sufficient image density at a practical reaction temperature and within a practical reaction time, and shows little change with time after development. In particular, the object of the present invention is to provide a photothermographic material that provides, besides the aforementioned characteristics, silver color tone near pure black after the development and superior environmental temperature and humidity dependency.

SUMMARY OF THE INVENTION

The present invention provides a photothermographic material comprising a non-photosensitive silver salt of an organic acid, a photosensitive silver halide, a reducing agent for silver ions and a binder on one surface of a support, wherein content of the reducing agent is 0.4–3.5 mmol/$m^2$, and the reducing agent contains at least one kind of compound represented by the following general formula (I):

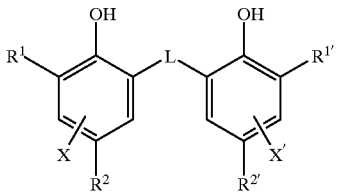

wherein $R^1$ and $R^{1'}$ each independently represent an alkyl group, at least one of which is a secondary or tertiary alkyl group; $R^2$ and $R^{2'}$ each independently represent hydrogen atom or a group that can be a substituent on benzene ring; L represents —S— group or a —CH($R^3$)— group where $R^3$ represents hydrogen atom or an alkyl group; and X and X' each independently represent hydrogen atom or a group that can be a substituent on benzene ring.

The present invention also provides a photothermographic material comprising a non-photosensitive silver salt of an organic acid, a photosensitive silver halide, a reducing agent for silver ions and a binder on one surface of a support, wherein the photothermographic material contains at least one kind of compound represented by the aforementioned formula (I) as the reducing agent, and at least one kind of compound represented by the following general formula (A):

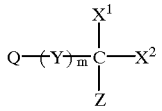

wherein Q represents an alkyl group, an aryl group or a heterocyclic group; $X^1$ and $X^2$ each independently represent a halogen atom; Z represents hydrogen atom or an electron withdrawing group; Y represents —C(=O)—, —SO— or —$SO_2$—; and m represents 0 or 1, which has a melting point not lower than a heat development temperature for the photothermographic material by more than 10° C. but not higher than the heat development temperature by more than 55° C.

PREFERRED EMBODIMENT OF THE INVENTION

Figure 1:
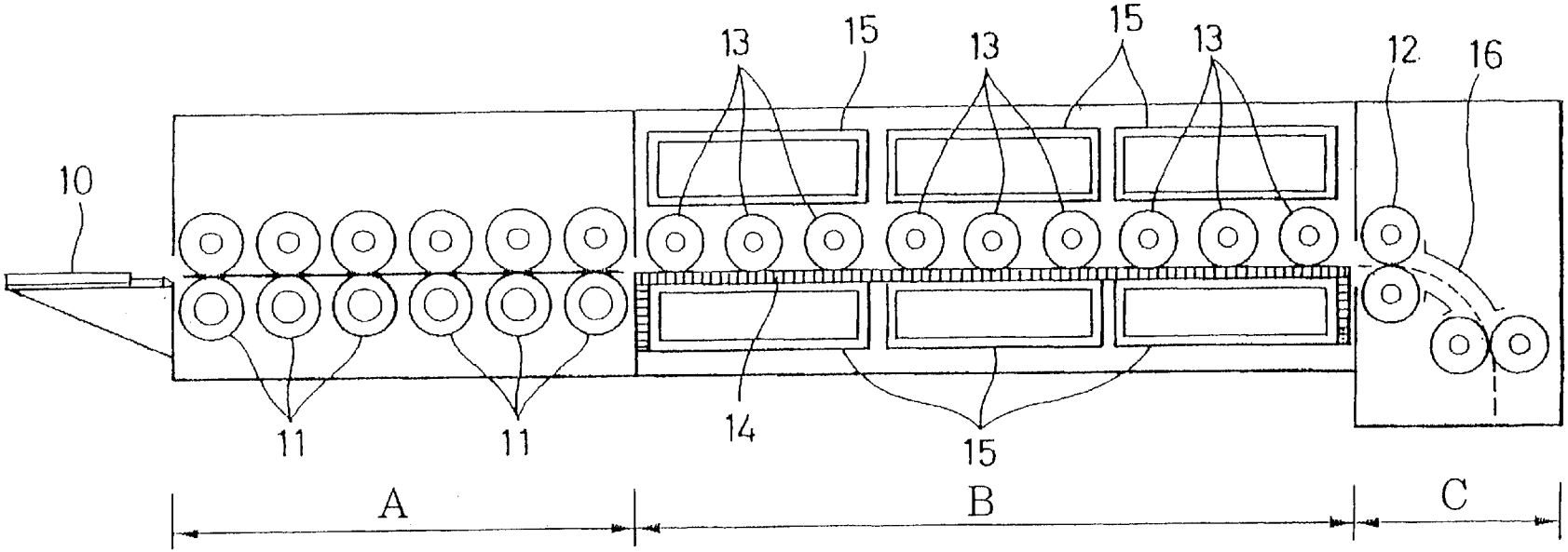
FIG. 1 is a side view of an exemplary heat developing apparatus used for the photothermographic material of the present invention. In the figure, there are shown a photothermographic material 10, carrying-in roller pairs 11, carrying-out roller pairs 12, rollers 13, a flat surface 14, heaters 15, and guide panels 16. The apparatus consists of a preheating section A, a heat development section B, and a gradual cooling section C.

The photothermographic material of the present invention will be explained in detail hereinafter. The photothermographic material of the present invention utilizes the compound represented by the general formula (I) as an essential component.

In the general formula (I) , $R^1$ and $R^{1'}$ each independently represent an alkyl group. Although $R^1$ and $R^{1'}$ are identical groups or different groups, at least one of them is a secondary or tertiary alkyl group. In the present specification, an alkyl group or an alkyl portion of the substituents containing an alkyl portion may be linear, branched or cyclic, or may consist of a combination thereof, and it may be substituted or unsubstituted. The alkyl group preferably has 1–20 carbon atoms. Specific examples of the unsubstituted alkyl group include, for example, methyl group, ethyl group, propyl group, butyl group, heptyl group, undecyl group, isopropyl group, 1-ethylpentyl group, 2,4,4-trimethylpentyl group, tert-butyl group, isobutyl group, tert-amyl group, tert-octyl group, cyclohexyl group, cyclopentyl group, 1-methylcyclohexyl group and 1-methylcyclopropyl group. The kind of the substituent on the alkyl group is not particularly limited. Examples of the substituent include, for example, an aryl group, hydroxy group, an alkoxy group, an aryloxy group, an alkylthio group, an arylthio group, an acylamino group, a sulfonamido group, a sulfonyl group, a phosphoryl group, an acyl group, a carbamoyl group, an ester group, a halogen atom (a halogen atom referred to in the present specification may be any of fluorine atom, chlorine atom, bromine atom and iodine atom) and so forth.

As $R^1$ and $R^{1'}$, a secondary or tertiary alkyl group can be preferably used. More specifically, they may be isopropyl group, isobutyl group, tert-butyl group, tert-amyl group, tert-octyl group, cyclohexyl group, cyclopentyl group, 1-methylcyclohexyl group, 1-methylcyclopropyl group or the like. $R^1$ and $R^{1'}$ more preferably represent a tertiary alkyl group. Interalia, tert-butyl group, tert-amyl group and 1-methylcyclohexyl group are more preferred, and tert-butyl group is the most preferred.

$R^{2\ and\ R2'}$ may be the same or different from each other, and they represent a hydrogen atom or a group that can be a substituent on benzene ring. Examples of the group that can be a substituent on benzene ring include a substituted or unsubstituted alkyl group having 1–20 carbon atoms, a substituted or unsubstituted aryl group having 6–26 carbon atoms, a halogen atom, a substituted or unsubstituted alkoxy group having 1–20 carbon atoms, a substituted or unsubstituted acylamino group having 2–21 carbon atoms and so forth. They may also form a saturated ring together with X and X'. Preferably, $R^2$ and $R^{2'}$ each independently represents an alkyl group, and specific examples thereof include methyl group, ethyl group, propyl group, butyl group, isopropyl group, tert-butyl group, tert-amyl group, cyclohexyl group, 1-methylcyclohexyl group, benzyl group, methoxymethyl group, methoxyethyl group and so forth. More preferably, they represent methyl group, ethyl group, propyl group, isopropyl group or tert-butyl group.

L represents —S— group or a —CH($R^3$)— group. The —CH($R^3$)— group is preferred. $R^3$ represents hydrogen atom or an alkyl group, and the alkyl group may have a substituent. Specific examples of the unsubstituted alkyl group that can be represented by $R^3$ include methyl group, ethyl group, propyl group, butyl group, heptyl group, undecyl group, isopropyl group, 1-ethylpentyl group, 2,4,4-trimethylpentyl group and so forth. Examples of the substituent of the alkyl group include a halogen atom, a substituted or unsubstituted alkoxy group having 1–20 carbon atoms, a substituted or unsubstituted alkylthio group having 1–20 carbon atoms, a substituted or unsubstituted aryloxy group having 6–26 carbon atoms, a substituted or unsubstituted arylthio group having 6–26 carbon atoms, a substituted or unsubstituted acylamino group having 2–21 carbon atoms, a substituted or unsubstituted sulfonamido group having 1–20 carbon atoms, a substituted or unsubstituted sulfonyl group having 1–20 carbon atoms, a substituted or unsubstituted phosphoryl group having 1–20 carbon atoms, a substituted or unsubstituted oxycarbonyl group having 2–21 carbon atoms, a substituted or unsubstituted carbamoyl group having 1–20 carbon atoms, a substituted or unsubstituted sulfamoyl group having 0–20 carbon atoms and so forth. $R^3$ preferably represents hydrogen atom, methyl group, ethyl group, propyl group, isopropyl group, n-octyl group or 2,4,4-trimethylpentyl group. $R^3$ particularly preferably represents hydrogen atom, methyl group or propyl group.

X and X' may be the same or different from each other, and represent hydrogen atom or a group that can be a substituent on benzene ring. Examples of the group that can be a substituent on benzene ring include a substituted or unsubstituted alkyl group having 1–20 carbon atoms, a substituted or unsubstituted aryl group having 6–26 carbon atoms, a halogen atom, a substituted or unsubstituted alkoxy group having 1–20 carbon atoms, a substituted or unsubstituted acylamino group having 2–21 carbon atoms and so forth. X and X' may also form a saturated ring together with $R^1$, $R^{1'}$, $R^2$ or $R^{2'}$. Preferably, X and X' represent hydrogen atom, a halogen atom or an alkyl group, and more preferably the both represent hydrogen atom.

When $R^3$ is hydrogen atom, it is preferred that $R^2$ and $R^{2'}$ each independently represent an alkyl group having 2 or more carbon atoms, more preferably ethyl group or propyl group, most preferably ethyl group.

When $R^2$ and $R^{2'}$ represent methyl group, $R^3$ preferably represents a primary or secondary alkyl group, more preferably methyl group, ethyl group, propyl group or isopropyl group, more preferably, methyl group, ethyl group or propyl group.

Preferred compounds represented by the general formula (I) that are used as the reducing agent in the present invention are those compounds wherein $R^1$ and $R^{1'}$ each independently represent a secondary or tertiary alkyl group, $R^2$ and $R^{2'}$ each independently represent an alkyl group, L represents a —CH($R^3$)— group where $R^3$ represents hydrogen atom or an alkyl group, and X and X' both represent hydrogen atom.

Among these, those compounds wherein $R^1$ and $R^{1'}$ each independently represent a tertiary alkyl group, $R^2$ and $R^{2'}$ each independently represent an alkyl group, L represents a —CH($R^3$)— group where $R^3$ represents an alkyl group, and X and X' both represent hydrogen atom are preferred.

Those compounds wherein $R^1$ and $R^{1'}$ each independently represent a tertiary alkyl group, $R^2$ and $R^{2'}$ each independently represent an alkyl group having 2 or more carbon atoms, L represents a —CH($R^3$)— group where $R^3$ represents hydrogen atom, and X and X' both represent hydrogen atom are also preferred.

Specific examples of the compound represented by the general formula (I) are mentioned below. However, the compound represented by the general formula (I) that can be used in the present invention is not limited to these.

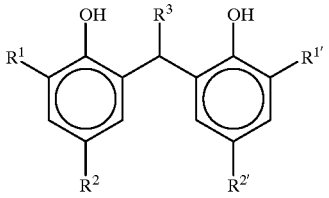

| | $R^1$ | $R^{1'}$ | $R^2$ | $R^{2'}$ | $R^3$ |
|---|---|---|---|---|---|
| I-1 | t-$C_4H_9$ | t-$C_4H_9$ | $CH_3$ | $CH_3$ | H |
| I-2 | t-$C_4H_9$ | t-$C_4H_9$ | $CH_3$ | $CH_3$ | $CH_3$ |
| I-3 | t-$C_4H_9$ | t-$C_4H_9$ | $CH_3$ | $CH_3$ | $C_2H_5$ |
| I-4 | t-$C_4H_9$ | t-$C_4H_9$ | $CH_3$ | $CH_3$ | n-$C_3H_7$ |
| I-5 | t-$C_4H_9$ | t-$C_4H_9$ | $CH_3$ | $CH_3$ | n-$C_4H_9$ |
| I-6 | t-$C_4H_9$ | t-$C_4H_9$ | $CH_3$ | $CH_3$ | n-$C_7H_{15}$ |
| I-7 | t-$C_4H_9$ | t-$C_4H_9$ | $CH_3$ | $CH_3$ | n-$C_{11}H_{23}$ |
| I-8 | t-$C_4H_9$ | t-$C_4H_9$ | $CH_3$ | $CH_3$ | i-$C_3H_7$ |
| I-9 | t-$C_4H_9$ | t-$C_4H_9$ | $CH_3$ | $CH_3$ | $CH(C_2H_5)C_4H_9$ |
| I-10 | t-$C_4H_9$ | t-$C_4H_9$ | $CH_3$ | $CH_3$ | $CH_2CH(CH_3)_2$ |
| I-11 | t-$C_4H_9$ | t-$C_4H_9$ | $CH_3$ | $CH_3$ | $CH_2CH(CH_3)CH_2C(CH_3)_3$ |
| I-12 | t-$C_4H_9$ | t-$C_4H_9$ | $CH_3$ | $CH_3$ | $CH_2OCH_3$ |
| I-13 | t-$C_4H_9$ | t-$C_4H_9$ | $CH_3$ | $CH_3$ | $CH_2CH_2OCH_3$ |
| I-14 | t-$C_4H_9$ | t-$C_4H_9$ | $CH_3$ | $CH_3$ | $CH_2CH_2OC_4H_9$ |
| I-15 | t-$C_4H_9$ | t-$C_4H_9$ | $CH_3$ | $CH_3$ | $CH_2CH_2SC_{12}H_{25}$ |
| I-16 | t-$C_4H_9$ | t-$C_4H_9$ | $C_2H_5$ | $C_2H_5$ | H |
| I-17 | t-$C_4H_9$ | t-$C_4H_9$ | $C_2H_5$ | $C_2H_5$ | $CH_3$ |
| I-18 | t-$C_4H_9$ | t-$C_4H_9$ | $C_2H_5$ | $C_2H_5$ | n-$C_3H_7$ |
| I-19 | t-$C_4H_9$ | t-$C_4H_9$ | $C_2H_5$ | $C_2H_5$ | i-$C_3H_7$ |
| I-20 | t-$C_4H_9$ | t-$C_4H_9$ | $C_2H_5$ | $C_2H_5$ | $CH_2CH_2OCH_3$ |
| I-21 | t-$C_4H_9$ | t-$C_4H_9$ | n-$C_3H_7$ | n-$C_3H_7$ | H |
| I-22 | t-$C_4H_9$ | t-$C_4H_9$ | n-$C_3H_7$ | n-$C_3H_7$ | $CH_3$ |
| I-23 | t-$C_4H_9$ | t-$C_4H_9$ | n-$C_3H_7$ | n-$C_3H_7$ | n-$C_3H_7$ |
| I-24 | t-$C_4H_9$ | t-$C_4H_9$ | n-$C_3H_9$ | n-$C_4H_9$ | H |
| I-25 | t-$C_4H_9$ | t-$C_4H_9$ | n-$C_3H_9$ | n-$C_4H_9$ | $CH_3$ |
| I-26 | t-$C_5H_{11}$ | t-$C_5H_{11}$ | $CH_3$ | $CH_3$ | H |
| I-27 | t-$C_5H_{11}$ | t-$C_5H_{11}$ | $CH_3$ | $CH_3$ | $CH_3$ |
| I-28 | t-$C_5H_{11}$ | t-$C_5H_{11}$ | $C_2H_5$ | $C_2H_5$ | H |
| I-29 | t-$C_5H_{11}$ | t-$C_5H_{11}$ | $C_2H_5$ | $C_2H_5$ | $CH_3$ |
| I-30 | i-$C_3H_7$ | i-$C_3H_7$ | $CH_3$ | $CH_3$ | H |
| I-31 | i-$C_3H_7$ | i-$C_3H_7$ | $CH_3$ | $CH_3$ | n-$C_3H_7$ |
| I-32 | i-$C_3H_7$ | i-$C_3H_7$ | $C_2H_5$ | $C_2H_5$ | H |
| I-33 | i-$C_3H_7$ | i-$C_3H_7$ | $C_2H_5$ | $C_2H_5$ | n-$C_3H_7$ |
| I-34 | i-$C_3H_7$ | i-$C_3H_7$ | i-$C_3H_7$ | i-$C_3H_7$ | H |
| I-35 | i-$C_3H_7$ | i-$C_3H_7$ | i-$C_3H_7$ | i-$C_3H_7$ | $CH_3$ |
| I-36 | t-$C_4H_9$ | $CH_3$ | $CH_3$ | $CH_3$ | H |

-continued

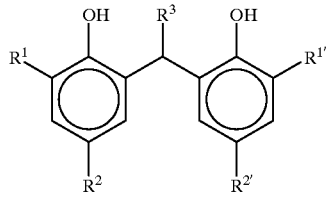

| | $R^1$ | $R^{1'}$ | $R^2$ | $R^{2'}$ | $R^3$ |
|---|---|---|---|---|---|
| I-37 | t-$C_4H_9$ | $CH_3$ | $CH_3$ | $CH_3$ | $CH_3$ |
| I-38 | t-$C_4H_9$ | $CH_3$ | $CH_3$ | $CH_3$ | n-$C_3H_7$ |
| I-39 | t-$C_4H_9$ | $CH_3$ | t-$C_4H_9$ | $CH_3$ | $CH_3$ |
| I-40 | i-$C_3H_7$ | $CH_3$ | $CH_3$ | $CH_3$ | $CH_3$ |

I-41

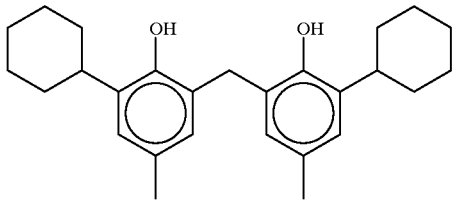

I-42

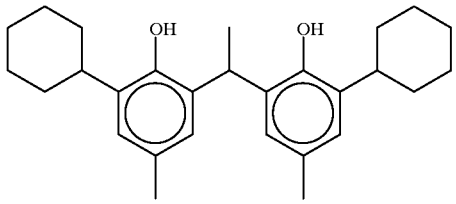

I-43

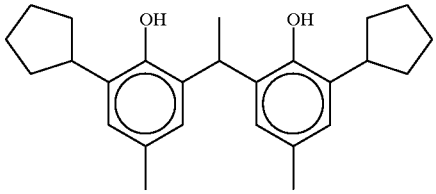

I-44

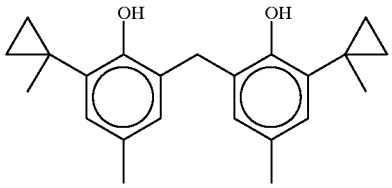

I-45

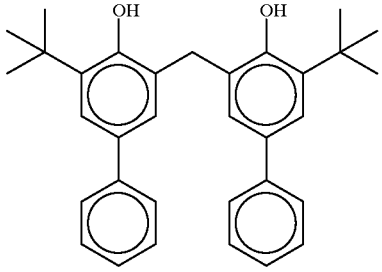

I-46
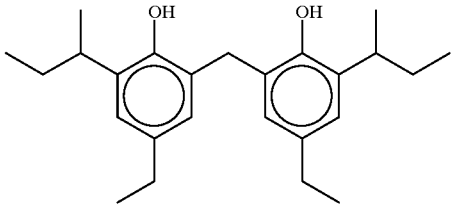
I-47
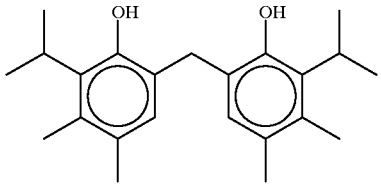
I-48
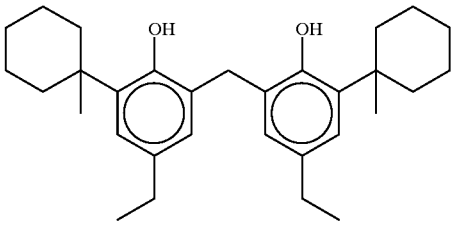
I-49
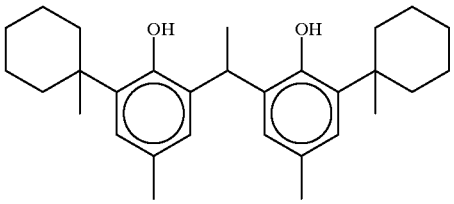
I-50
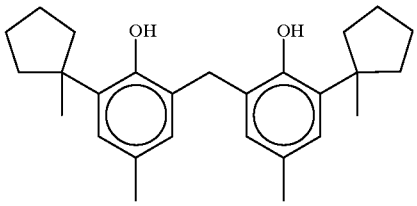
I-51
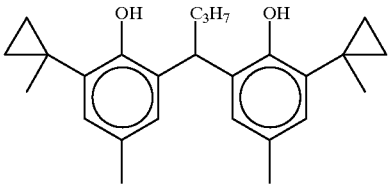
I-52
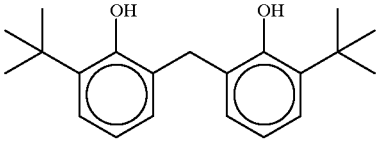
I-53
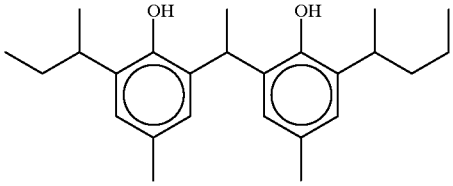
I-54
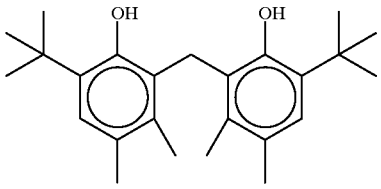
I-55
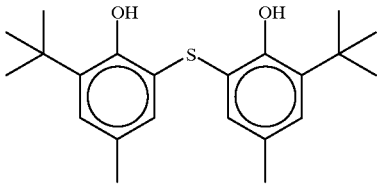
I-56
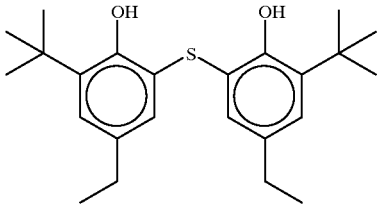
I-57
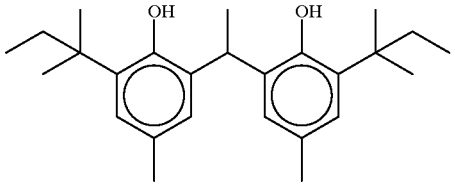
I-58
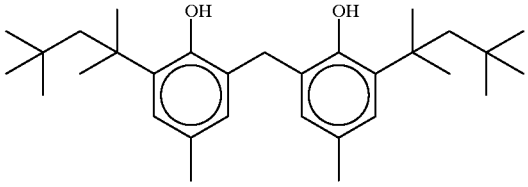
I-59
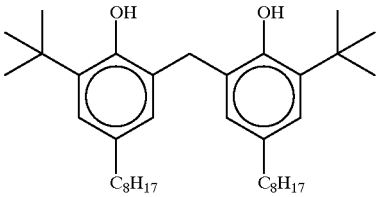

-continued

I-60

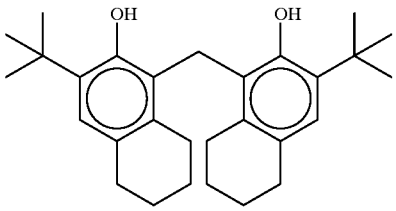

I-61

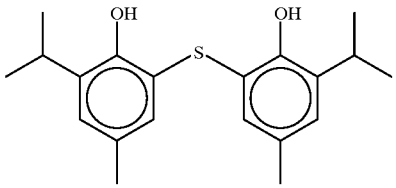

I-62

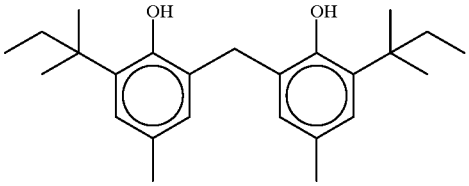

I-63

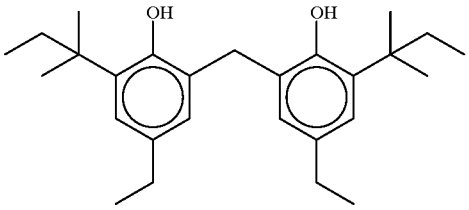

I-64

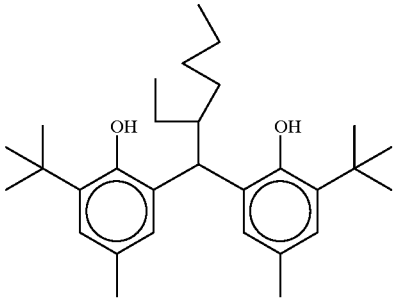

I-65

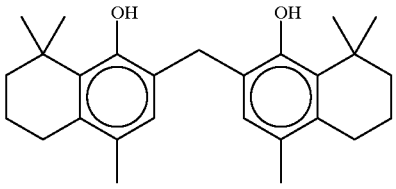

-continued

I-66

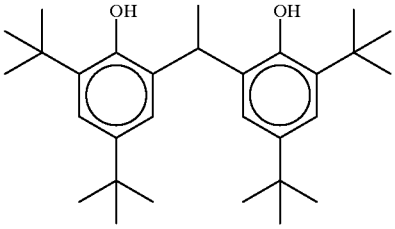

The reducing agents represented by the general formula (I) may be used each alone, or two or more kinds of them may be used in combination. It is also possible to use a reducing agent represented by the general formula (I) and a reducing agent other than those represented by the general formula (I) in combination.

The total content of the compound represented by the general formula (I) in the photothermographic material of the present invention is 0.4–3.5 mmol/$m^2$, preferably 0.4–3.0 mmol/$m^2$, more preferably 0.5–2.8 mmol/$m^2$, further preferably 0.6–2.5 mmol/$m^2$, when the compound represented by the general formula (A) to be explained later is not used. When the compound represented by the general formula (A) to be explained later is used in combination, the content is preferably 7 mmol/$m^2$ or less, more preferably 0.1–5.0 mmol/$m^2$, further preferably 0.2–4.0 mmol/$m^2$. The photothermographic material of the present invention preferably contains the compound represented by the general formula (I) in an amount of 2–40 mole, more preferably 3–30 mole, most preferably 5–30 mole, with respect to 1 mol of silver on the side having the image-forming layer.

The photothermographic material of the present invention may contain the compound represented by the general formula (I) and a reducing agent other than the compound represented by the general formula (I) in combination.

In this case, the total content of the reducing agent in the photothermographic material of the present invention is 0.4–3.5 mmol/$m^2$, preferably 0.4–3.0 mmol/$m^2$, more preferably 0.5–2.8 mmol/$m^2$, further preferably 0.6–2.5 mmol/$m^2$. The photothermographic material of the present invention preferably contains the reducing agent in an amount of 2–40 moles, more preferably 3–30 moles, per mole of silver on the side having the image-forming layer. When the reducing agents are used in combination, the reducing agent of the present invention represented by the general formula (I) accounts for preferably 10 mole % or more, more preferably 20 mole % or more, further preferably 40 mole % or more, of the reducing agents.

Reducing agents that can be used with the compounds represented by the general formula (I) are mentioned in, for example, Japanese Patent Laid-open Publication (Kokai, hereinafter referred to as JP-A) 11-65021, paragraphs 0043 to 0045 and EP 0803764A1, from page 7, line 34 to page 18, line 12. In the present invention, bisphenol-type reducing agents such as 1,1-bis(2-hydroxy-3,5-dimethylphenyl)-3,5,5-trimethylhexane are particularly preferably used in combination.

While the compound represented by the general formula (I) is preferably contained in the image-forming layer containing the silver salt of an organic acid, it may be contained in an adjacent non-image-forming layer.

In the present invention, the reducing agent may be added to a coating solution in any form such as solution, emulsion dispersion and solid microparticle dispersion so that it could be incorporated in the photothermographic material.

As a well known emulsion dispersion method, there can be mentioned a method of dissolving the compound in an oil such as dibutyl phthalate, tricresyl phosphate, glyceryl triacetate or diethyl phthalate by using an auxiliary solvent such as ethyl acetate or cyclohexanone and mechanically preparing an emulsion dispersion.

As the method for preparing solid microparticle dispersion, there can be mentioned a method of dispersing powder of the reducing agent in a suitable solvent such as water by using a ball mill, colloid mill, vibrating ball mill, sand mill, jet mill, roller mill or ultrasonic wave to form solid dispersion. In this operation, a protective colloid (e.g., polyvinyl alcohol), surfactant (e.g., an anionic surfactant such as sodium triisopropylnaphthalenesulfonate (mixture of those having three isopropyl groups on different positions)) and so forth may be used. An aqueous dispersion may contain a preservative (e.g., benzisothiazolinone sodium salt).

In the present invention, the reducing agent is preferably used as solid microparticle dispersion in a coating solution.

The photothermographic material of the present invention utilizes a non-photosensitive silver salt of an organic acid as an essential component.

A silver salt of an organic acid that can be used in the present invention is a silver salt relatively stable against light, but forms a silver image when it is heated at 80° C. or higher in the presence of an exposed photocatalyst (e.g., a latent image of photosensitive silver halide) and a reducing agent. The silver salt of an organic acid may be any organic substance containing a source capable of reducing silver ions. Such non-photosensitive silver salts of an organic acid are disclosed in JP-A-10-62899, paragraphs 0048 to 0049 and EP0803763A1, page 18, line 24 to page 19, line 37. Silver salts of an organic acid, in particular, silver salts of a long chained aliphatic carboxylic acid having from 10 to 30, preferably from 15 to 28 carbon atoms, are preferred. Preferred examples of the silver salt of an organic acid include silver behenate, silver arachidinate, silver stearate, silver oleate, silver laurate, silver caproate, silver myristate, silver palmitate and so forth.

The shape of the silver salt of an organic acid that can be used for the present invention is not particularly limited, and any of acicular, rod-like, scaly shapes and so forth may be used. However, scaly silver salts of an organic acid are preferred for the present invention. Scaly silver salts of an organic acid are herein defined as follows. A sample of a silver salt of an organic acid to be analyzed is observed with an electronic microscope, and grain shapes of the salt seen in the field are approximated to rectangular parallelepipeds. The three different edges of each rectangular parallelepiped are represented as a, b and c where a is the shortest, c is the longest, and c and b may be the same. From the shorter edges a and b, x is obtained according to the following equation:

$$x=b/a$$

The values of x are obtained for about 200 grains seen in the field, and an average of them (x (average)) is obtained. Samples that satisfy the requirement of x (average) $\geqq 1.5$ are defined to be scaly. Scaly grains preferably satisfy $30 \geqq x$ (average) $\geqq 1.5$, more preferably $20 \geqq x$ (average) $\geqq 2.0$. In this connection, acicular (needle-like) grains satisfy $1 \leqq x$ (average) $<1.5$.

In scaly grains, it is understood that a corresponds to the thickness of tabular grains of which main planes are defined by the sides of b and c. The average of a is preferably from 0.01 $\mu$m to 0.23 $\mu$m, more preferably from 0.1 $\mu$m to 0.20 $\mu$m. The average of c/b is preferably from 1 to 6, more preferably from 1.05 to 4, even more preferably from 1.1 to 3, particularly preferably from 1.1 to 2.

The grain size distribution of the silver salt of an organic acid is preferably monodispersed. The term "monodispersed" as used herein means that the percentage of the value obtained by dividing the standard deviation of the length of the short axis or long axis by the length of the short axis or long axis, respectively, is preferably 100% or less, more preferably 80% or less, further preferably 50% or less. The shape of the silver salt of an organic acid can be determined from a transmission electron microscope image of organic acid silver salt dispersion. Another method for determining the monodispesibility is a method of obtaining the standard deviation of a volume weight average diameter of the silver salt of an organic acid. The percentage of the value obtained by dividing the standard deviation by the volume weight average diameter (coefficient of variation) is preferably 100% or less, more preferably 80% or less, further preferably 50% or less. As a measurement method, for example, the grain size (volume weight average diameter) can be determined by irradiating organic acid silver salt dispersed in a solution with a laser ray and determining an autocorrelation function of the fluctuation of the scattered light on the basis of the change in time.

The organic acid silver salt used for the present invention is prepared by allowing a solution or suspension of alkali metal salt (e.g., sodium salt, potassium salt, lithium salt) of the above-described organic acid to react with silver nitrate. The organic acid alkali metal salt can be obtained by treating the organic acid with an alkali. The preparation of the organic acid silver salt may be performed batchwise or continuously in any appropriate reaction vessel. Stirring in the reaction vessel may be effected by any stirring method according to the required properties of the grains. The organic acid silver salt is preferably prepared by any of a method of gradually or rapidly adding an aqueous silver nitrate solution to a reaction vessel containing an organic acid alkali metal solution or suspension, a method of gradually or rapidly adding a previously prepared organic acid alkali metal salt solution or suspension to a reaction vessel containing an aqueous silver nitrate solution, or a method of previously preparing an aqueous silver nitrate solution and an organic acid alkali metal salt solution or suspension and simultaneously adding those solutions to a reaction vessel.

The aqueous silver nitrate solution and the organic acid alkali metal salt solution or suspension may have any concentration so as to control the grain size of the organic acid silver salt to be prepared and may be added at any addition rate. The aqueous silver nitrate solution and the organic acid alkali metal salt solution or suspension each may be added by a method of adding the solution or suspension at a constant rate or a method of adding the solution or suspension while increasing or decreasing the addition rate with arbitrary time function. The solution may also be added to the liquid surface or in the liquid of the reaction solution. When an aqueous silver nitrate solution and an organic acid alkali metal salt solution or suspension are previously prepared and then simultaneously added to a reaction vessel, either of the aqueous silver nitrate solution and the organic acid alkali metal salt solution or suspension maybe added in advance, but the aqueous silver nitrate solution is preferably added in advance. The amount added in advance is preferably from 0 to 50 volume %, more preferably from 0 to 25 volume %, of the entire addition amount. Furthermore, a method of adding the solution while controlling the pH or silver potential of the reaction solution during the reaction described in JP-A-9-127643 may be preferably used.

The pH of the aqueous silver nitrate solution and the organic acid alkali metal salt solution or suspension added may be adjusted according to the required properties of the grains. For adjusting the pH, any acid or alkali may be added. Furthermore, depending on the required property of the grains, for example, in order to control the grain size of the organic acid silver salt to be prepared, the temperature in the reaction vessel may be suitably selected. The temperature of the aqueous silver nitrate solution and the organic acid alkali metal salt solution or suspension added may also be suitably controlled. In order to ensure the liquid flowability of the organic acid alkali metal salt solution or suspension, the solution is preferably heated and maintained at a temperature of 50° C. or higher.

The silver salt of an organic acid for use in the present invention is preferably prepared in the presence of a tertiary alcohol. The tertiary alcohol preferably has a total carbon number of 15 or less, more preferably 10 or less. Examples of preferred tertiary alcohols include tert-butanol. The tertiary alcohol may be added in any timing during the preparation of the silver salt of an organic acid. However, the tertiary alcohol is preferably added at the time of preparation of the organic acid alkali metal salt to dissolve the organic alkali metal salt. The tertiary alcohol may be added in any amount of from 0.01 to 10 in terms of the weight ratio to water used as a solvent for the preparation of the silver salt of an organic acid, and preferably added in an amount of from 0.03 to 1 in terms of the weight ratio to water.

Preferably, the scaly silver salt of an organic acid for use in the present invention is prepared by reacting an aqueous solution of a water-soluble silver salt with an aqueous solution of an alkali metal salt of an organic acid in a aqueous tertiary alcohol solution in a reaction vessel (the method includes a step of adding the aqueous tertiary alcohol solution containing an alkali metal salt of an organic acid into a liquid already existing in a reaction vessel), wherein the temperature difference between the liquid already existing in the reaction vessel and the aqueous tertiary alcohol solution of an alkali metal salt of an organic acid to be added thereto falls between 20° C. and 85° C. The liquid existing in the reaction vessel in advance is preferably an aqueous solution of a water-soluble silver salt put into the reaction vessel in advance. In a case where the aqueous solution of a water-soluble silver salt is not put into the reaction vessel in advance but is put into the vessel from the start along with an aqueous solution of an alkali metal salt of an organic acid in a tertiary alcohol, the liquid existing in the reaction vessel is water or a mixed solvent of water and a tertiary alcohol, as will be mentioned hereinafter. Even in a case where the aqueous solution of a water-soluble silver salt is put into the reaction vessel in advance, the reaction vessel may contain water or a mixed solvent of water and a tertiary alcohol.

With the temperature difference between the liquid already existing in the reaction vessel and the aqueous tertiary alcohol solution of an alkali metal salt of an organic acid to be added being controlled to fall within the defined range during the addition, the crystal shape of the silver salt of an organic acid to be formed can favorably controlled.

The water-soluble silver salt is preferably silver nitrate. The concentration of the water-soluble silver salt in the aqueous solution is preferably 0.03 mole/liter to 6.5 moles/liter, more preferably 0.1 mole/liter to 5 moles/liter. The pH of the aqueous solution is preferably 2 to 6, more preferably 3.5 to 6.

The aqueous solution of a water-soluble silver salt may contain a tertiary alcohol having from 4 to 6 carbon atoms. In this case, the amount of the tertiary alcohol in the aqueous solution is 70% by volume or less, preferably 50% by volume or less, based on the total volume of the aqueous solution. The temperature of the aqueous solution is preferably 0° C. to 50° C., more preferably 5° C. to 30° C. In a case where the aqueous solution of a water-soluble silver salt and the aqueous tertiary alcohol solution of an alkali metal salt of an organic acid are simultaneously added into a reaction vessel as in the manner to be mentioned below, the temperature of the solutions is most preferably 5° C. to 15° C.

Specific examples of the alkali metal of the alkali metal salt of an organic acid include sodium and potassium. The alkali metal salt of an organic acid may be prepared by adding NaOH or KOH to an organic acid. In this step, it is desirable that the amount of the alkali to be added to an organic acid is not larger than the equivalent amount of the organic acid so that unreacted organic acid can remain in the reaction mixture. In this case, the amount of the remaining unreacted organic acid may be 3 mole % to 50 mole %, preferably 3 mole % to 30 mole %, per mole of the total organic acid. After the alkali is added in an amount larger than the intended amount, additional acid such as nitric acid or sulfuric acid may be added to neutralize the excess alkali to perform the preparation.

Depending on the required properties of the silver salt of an organic acid, the pH of the reaction system may be controlled. For controlling the pH, any acid or alkali may be used.

Further, the aqueous solution of a water-soluble silver salt, the aqueous tertiary alcohol solution of an alkali metal salt of an organic acid, or even the liquid existing in the reaction vessel in advance may be optionally added with, for example, compounds such as those of the formula (1) described in JP-A-62-65035, water-soluble group-containing N-heterocyclic compounds such as those described in JP-A-62-150240, inorganic peroxides such as those described in JP-A-50-101019, sulfur compounds such as those described in JP-A-51-78319, disulfide compounds such as those described in JP-A-57-643, hydrogen peroxide and so forth.

The aqueous tertiary alcohol solution of an alkali metal salt of an organic acid is preferably in a mixed solvent of water and a tertiary alcohol having 4 to 6 carbon atoms for ensuring uniformity of the solution. Alcohols in which the number of carbon atoms exceeds the defined range may not be preferred as their miscibility with water becomes poor. Among the tertiary alcohol having 4 to 6 carbon atoms, most preferred is tert-butanol as its miscibility with water is the highest of all. Alcohols other than such tertiary alcohols may also be unfavorable since they have a reducing property and adversely affect the process of forming the silver salt of an organic acid. The amount of the tertiary alcohol that may be used in the aqueous tertiary alcohol solution of an alkali metal salt of an organic acid may be 3% by volume to 70% by volume, preferably 5% by volume to 50% by volume, relative to the volume of water in the aqueous solution.

The concentration of the alkali metal salts of an organic acid in the aqueous tertiary alcohol solution of the alkali metal salt of an organic acid may be 7% by weight to 50% by weight, preferably 7% by weight to 45% by weight, more preferably 10% by weight to 40% by weight.

The temperature of the aqueous tertiary alcohol solution of an alkali metal salt of an organic acid to be added into a reaction vessel is preferably 50° C. to 90° C., more preferably 60° C. to 85° C., most preferably 65° C. to 85° C., in order that the alkali metal salt of an organic acid in the solution should be kept at a temperature sufficient for preventing the salt from being crystallized or solidified. For controlling the reaction temperature to be constant, it is desirable that the temperature of the aqueous solution should be controlled to be a predetermined temperature falling within the defined range.

The silver salt of an organic acid preferably used for the present invention may be prepared according to i) a method comprising first putting the total amount of an aqueous solution of a water-soluble silver salt into a reaction vessel, followed by adding thereto an aqueous tertiary alcohol solution of an alkali metal salt of an organic acid as a single portion, or ii) a method comprising simultaneously putting both of an aqueous solution of a water-soluble silver salt and an aqueous tertiary alcohol solution of an alkali metal salt of an organic acid into a reaction vessel at least any time (simultaneous addition method). In the present invention, the latter simultaneous addition method is preferred, since the mean grain size of the silver salt of an organic acid produced can be well controlled to narrow the grain size distribution thereof by the latter method. In this method, it is desirable that at least 30% by volume, more preferably from 50 to 75% by volume, of the total amount of the two is simultaneously put into the reaction vessel. In a case where any one of the two is put into the reaction vessel in advance, it is desirable that the solution of a water-soluble silver salt is put into the vessel in advance.

In any case, the temperature of the liquid previously existing in the reaction vessel (the liquid is the aqueous solution of a water-soluble silver salt put into the reaction vessel in advance as mentioned above; or when the aqueous solution of a water-soluble silver salt is not put into the reaction vessel in advance, the liquid is a solvent put into the vessel in advance as described below) is preferably 5° C. to 75° C., more preferably 5° C. to 60° C., most preferably 10° C. to 50° C. Throughout the entire process of the reaction, the reaction temperature is preferably controlled to be a constant temperature falling within the defined range. As the case may be, however, the reaction temperature may also be preferably controlled in some temperature profiles varying within the defined range.

The temperature difference between the liquid existing in the reaction vessel and the aqueous tertiary alcohol solution of an alkali metal salt of an organic acid to be added is preferably 20° C. to 85° C., more preferably 30° C. to 80° C. In this case, it is desirable that the temperature of the aqueous tertiary alcohol solution of an alkali metal salt of an organic acid should be higher than that of the liquid already existing in the reaction vessel. By such temperature control, the rate at which the aqueous tertiary alcohol solution of an alkali metal salt of an organic acid having a higher temperature is rapidly cooled by the reaction vessel and precipitated to give fine crystals, and the rate at which the deposited alkali metal salt is reacted with the water-soluble silver salt to give a silver salt of an organic acid are both favorably controlled, and therefore the crystal shape, crystal size and crystal size distribution of the silver salt of an organic acid can be favorably controlled. In addition, the properties of the thermally processed material, in particular, as a photothermographic material, can also be improved.

The reaction vessel may contain a solvent in advance, and water is preferably used as the solvent that is contained in advance. A mixed solvent of water and a tertiary alcohol may also be preferably used.

The aqueous tertiary alcohol solution of an alkali metal salt of an organic acid, the aqueous solution of a water-soluble silver salt, or the reaction mixture may optionally be added with a dispersing aid that is soluble in aqueous media. The dispersing aid may be any one capable of dispersing the silver salt of an organic acid formed. Specific examples thereof include those mentioned below as the dispersing aid for silver salt of an organic acid.

In the process of producing silver salt of an organic acid, the salts formed are preferably desalted and dehydrated. The methods for desalting and dehydrating the salts are not particularly limited, and well-known conventional methods may be used. For example, preferably used are known filtration methods including centrifugation filtration, suction filtration, ultrafiltration, flocculation by the coagulation method followed by washing with water and so forth. Also preferably used is supernatant removal by centrifugal precipitation. The desalting and dehydration may be performed once or may be repeated. Addition and removal of water may be effected continuously or separately. The desalting and the dehydration are preferably performed to such a degree that the finally removed water should have a conductivity of 300 $\mu$S/cm or less, more preferably 100 $\mu$S/cm or less, most preferably 60 $\mu$S/cm or less. As for the conductivity, there is no particular lower limit, it may generally be 5 $\mu$S/cm or so.

To improve conditions of the coated surface of the photothermographic material, the silver salt of an organic acid formed is preferably further processed in a process comprising dispersing it in water, forming a high-pressure and high-speed flow of the resulting aqueous dispersion, and re-dispersing the salt by lowering the pressure to form a fine aqueous dispersion of the salt. In this case, the dispersion medium preferably consists of water alone, but may contain an organic solvent so long as it is in an amount of 20% by weight or less of the dispersion medium.

As for the method for finely dispersing the silver salt of an organic acid, for example, it can be mechanically dispersed in the presence of a dispersing aid by a known pulverizing means (e.g., high-speed mixer, homogenizer, high-speed impact mill, Banbary mixer, homomixer, kneader, ball mill, vibrating ball mill, planetary ball mill, attriter, sand mill, bead mill, colloid mill, jet mill, roller mill, trone mill, high-speed stone mill).

It is desirable that the silver salt of an organic acid is dispersed substantially in the absence of a photosensitive silver salt, since the photosensitive silver salt will increase fog and markedly lower sensitivity, if it is present during the dispersion. For the production of the photothermographic material of the present invention, the amount of the photosensitive silver salt that may be in the aqueous dispersion of the silver salt of an organic acid should be 0.1 mole % or less per mole of the silver salt of an organic acid, and desirably, the photosensitive silver salt is not added intentionally.

For obtaining a uniform solid dispersion of a silver salt of an organic acid having a high S/N ratio and a small grain size and being free from coagulation, it is preferable to uniformly apply strong force within a range that should not cause breakage or unacceptable temperature increase of grains of the silver salt of an organic acid as the image-forming medium. To this end, a dispersion method comprising the steps of converting an aqueous dispersion that contains a silver salt of an organic acid and an aqueous solution of dispersant into a high-speed flow, and then releasing the pressure is preferred.

The dispersing apparatuses and techniques used for performing the above-described re-dispersion method are described in detail, for example, in Toshio Kajiuchi and Hiromoto Usui, "Bunsan-kei Rheology to Bunsanka Gijutsu (Rheology of Dispersion System and Dispersion Technology)", pp.357–403, Shinzan Sha Shuppan (1991) , and "Kagaku Kogaku no Shinpo (Progress of Chemical Engineering)", vol. 24, pp. 184–185, compiled by Corporation Kagaku Kogakukai Tokai Shibu, Maki Shoten (1990), JP-A-59-49832, U.S. Pat. No. 4,533,254, JP-A-8-137044, JP-A-8-238848, JP-A-2-261525, JP-A-1-94933 and so forth. The re-dispersion method used in the production of the photothermographic material of the present invention comprises steps of supplying a water dispersion containing at least a silver salt of an organic acid into a pipeline under a positive pressure by means of a high-pressure pump or the like, passing the dispersion through a narrow slit provided inside the pipeline, and then subjecting the dispersion to rapid pressure reduction to perform fine dispersion.

As for the high-pressure homogenizer, it is generally considered that fine and uniform dispersion can be achieved therein by enhancing (a) "shear force" to be generated at the passage of a dispersoid through a narrow slit (75 $\mu$m to 350 $\mu$m or so) under high pressure at high speed and (b) "cavitation force" to be generated by the pressure releasing, but without changing the preceding impact force resulting from the liquid-liquid collision or the liquid-wall collision in the high-pressure narrow space. One old example of the dispersion apparatus of this type is a Golline homogenizer. In this apparatus, a liquid to be dispersed introduced under high pressure is converted into a high-speed flow when it is passed through an arrow gap formed on the wall of a cylindrical surface. Then, the flow collides against a surrounding wall with its own force, and is emulsified and dispersed by the impact force. For the liquid-liquid collision mentioned above, for example, there can be mentioned a Y-type chamber of Microfluidizer, aspherical chamber utilizing a spherical check valve such as that described in JP-A-8-103642 mentioned below and so forth. For the liquid-wall collision, there can be mentioned a Z-type chamber of Microfluidizer and so forth. The pressure is generally 100 to 600 kg/cm$^2$, and the flow rate is generally a few meters/sec to 30 meters/sec. In order to increase the dispersion efficiency, some apparatuses are designed wherein the high flow rate area is so modified as to have a serrated configuration, thereby increasing the frequency of collision. Typical examples of such apparatuses are Golline homogenizer, Microfluidizer from Microfluidex International Corporation, Microfluidizer from Mizuho Kogyo Co., Ltd., Nanomizer from Tokushu Kika Kogyo Co., Ltd and so forth. Other examples of such apparatuses are described in JP-A-8-238848, JP-A-8-103642 and U.S. Pat. No. 4,533,254.

In dispersing process of the silver salt of an organic acid, dispersion having a desired grain size may be obtained by controlling the flow rate, the difference in the pressure before and after at the pressure releasing and the frequency of the processing. From viewpoints of photographic performance and the grain size, the flow rate is preferably from 200 to 600 m/sec and the difference in the pressure at the pressure releasing is preferably from 900 to 3,000 kg/cm$^2$, and more preferably, the flow rate is from 300 to 600 m/sec, and the difference in the pressure at the pressure releasing is from 1,500 to 3,000 kg/cm$^2$. The frequency of the dispersion processing may be appropriately chosen as required, and is usually from 1 to 10 times. From a viewpoint of productivity, the frequency is approximately from 1 to 3 times. The water dispersion under a high pressure is preferably not warmed at a high temperature from viewpoints of dispersibility and photographic performance. At a high temperature above 90° C., the grain size may readily become large and fog may be increased.

Accordingly, the water dispersion is preferably kept at a temperature of from 5° C. to 90° C., more preferably from 5° C. to 80° C., particularly preferably from 5° C. to 65° C., by using a cooling apparatus in a step before the conversion into a high-pressure and high-speed flow, or a step after the pressure release, or both of the steps. It is particularly effective to provide the cooling step at the time of dispersion under a high pressure of from 1,500 to 3,000 kg/cm$^2$. The cooling apparatus may be appropriately selected from a double pipe or triple pipe with a static mixer, a multi-tubular exchanger, a coiled heat exchanger and so forth depending on an amount of heat exchange to be required. The size, wall thickness or material of a pipe may be appropriately selected to increase heat exchange efficiency depending on an applied pressure. In addition, depending on an amount of heat exchange, a refrigerant used in the cooling apparatus may be a well water at 20° C. or a chilled water at from 5 to 10° C. cooled by a refrigerator, and if desired, a refrigerant such as ethylene glycol/water at −30° C. may also be used.

When the silver salt of an organic acid is dispersed into solid fine grains by using a dispersing agent, it can be selected for use from, for example, synthetic anion polymers such as polyacrylic acid, acrylic acid copolymer, maleic acid copolymer, maleic acid monoester copolymer and acryloylmethylpropane-sulfonic acid copolymer, semisynthetic anionic polymers such as carboxymethyl starch and carboxymethylcellulose, anionic polymers such as alginic acid and pectic acid, anionic surfactants described in JP-A-52-92716, WO88/04794 and so forth, the compounds described in JP-A-9-179243, known anionic, nonionic or cationic surface active agents, known polymers such as polyvinyl alcohol, polyvinylpyrrolidone, carboxymethylcellulose, hydroxypropylcellulose and hydroxypropylmethylcellulose, and naturally-occurring polymer compounds such as gelatin.

The dispersing aid is generally mixed with the silver salt of an organic acid in a form of powder or wet cake before the dispersing process, and fed as slurry into a dispersing apparatus. However, the dispersing aid may also be mixed with the silver salt of an organic acid beforehand, and then the mixture may be subjected to a treatment such as by heating or with a solvent to form an silver salt of an organic acid powder or wet cake. The pH may be controlled with a suitable pH modifier before, during or after the dispersing operation.

Other than the mechanical dispersion, the silver salt of an organic acid can be made into grains by roughly dispersing the salt in a solvent through pH control, and then changing the pH in the presence of a dispersing aid. For the operation, an organic solvent may be used as a solvent for the rough dispersion, and such organic solvent is generally removed after the formation of the grains.

The dispersion prepared can be stored with stirring to prevent precipitation of the grains during storage, or stored in a highly viscous state formed by means of hydrophilic colloids (e.g., a jelly state formed with gelatin).

Furthermore, the dispersion may contain a preservative in order to prevent proliferation of microorganisms during storage.

The silver salt of an organic acid prepared by a method for preparing silver salt of an organic acid is preferably dispersed in an aqueous solvent, and then mixed with an aqueous solution of a photosensitive silver salt to provide a coating solution for photosensitive image-forming medium.

In advance of the dispersion operation, the stock solution can be roughly dispersed (preparatory dispersion). The rough dispersion may be performed using a known dispersion means (for example, high-speed mixer, homogenizer, high-speed impact mill, Banbary mixer, homomixer, kneader, ball mill, vibrating ball mill, planetary ball mill, attriter, sand mill, bead mill, colloid mill, jet mill, roller mill, trone mill, high-speed stone mill) . Other than the mechanical dispersion, the stock solution may be roughly dispersed in a solvent by controlling pH and thereafter formed into fine grains in the presence of a dispersion aid by changing pH. At this time, the solvent used for the rough dispersion may be an organic solvent. The organic solvent is usually removed after the completion of fine grain formation.

The dispersion thus obtained can then be mixed with an aqueous photosensitive silver salt solution to produce a coating solution for photosensitive image-forming medium. The coating solution enables the manufacture of a photothermographic material exhibiting low haze and low fog, and having high sensitivity. When a photosensitive silver salt coexists at the time of dispersing process under a high-pressure by conversion into a high-speed flow, fog may increase and sensitivity may markedly decrease. Furthermore, when an organic solvent is used as a dispersion medium instead of water, haze and fog may increase and sensitivity may be likely to decrease. When a conversion method where a part of the silver salt of an organic acid in the dispersion is converted into a photosensitive silver salt is used instead of the method of mixing an aqueous photosensitive silver salt solution, sensitivity may be likely to be decreased.

The above-described water dispersion obtained by conversion into high-speed flow under a high-pressure is desirably substantially free of a photosensitive silver salt. The content thereof is 0.1 mole % or less based on the light insensitive silver salt of an organic acid, and desirably, the photosensitive silver salt is not added intentionally.

The grain size (volume weight average diameter) in the solid fine grain dispersion of silver salt of an organic acid can be determined by, for example, irradiating the solid fine grain dispersion dispersed in a solution with a laser ray and determining an autocorrelation function of the fluctuation of the scattered light on the basis of the change in time (volume weight average diameter). The solid fine grain dispersion preferably has an average grain size of 0.05 to 10.0 $\mu$m, more preferably from 0.1 to 5.0 $\mu$m, further preferably from 0.1 to 2.0 $\mu$m.

The silver salt of an organic acid solid fine grain dispersion preferably used in the present invention comprises at least a silver salt of an organic acid and water. The ratio of the silver salt of an organic acid to water is not particularly limited. The silver salt of an organic acid preferably accounts for from 5 to 50 weight %, more preferably from 10 to 30 weight % of the entire dispersion. A dispersing aid is preferably used as described above, but it is preferably used in a minimum amount within the range suitable for attaining a minimum grain size, specifically, in an amount of from 1 to 30 weight %, more preferably from 3 to 15 weight %, based on the silver salt of an organic acid.

A photosensitive material can be produced by mixing a silver salt of an organic acid aqueous dispersion and a photosensitive silver salt aqueous dispersion. The mixing ratio of the silver salt of an organic acid and the photosensitive silver salt may be selected according to the purpose. However, the ratio of the photosensitive silver salt to the silver salt of an organic acid is preferably from 1 to 30 mole %, more preferably from 3 to 20 mole %, still more preferably from 5 to 15 mole %. In the mixing, two or more kinds of aqueous dispersions of silver salt of an organic acid are preferably mixed with two or more photosensitive silver salt aqueous dispersions in order to control the photographic properties.

The silver salt of an organic acid may be used in any desired amount in the present invention. However, it is preferably used in an amount of from 0.1 to 5 g/m$^2$, more preferably from 1 to 3 g/m$^2$, in terms of silver.

In the photothermographic material of the present invention, the phenol derivatives represented by the formula (A) mentioned in Japanese Patent Application No. 11-73951 are preferably used as a development accelerator.

The photosensitive silver halide that can be used for the present invention is not particularly limited as for the halogen composition, and silver chloride, silver chlorobromide, silver bromide, silver iodobromide, silver chloroiodobromide and so forth may be used. The halide composition may have a uniform distribution in the grains, or the compositions may change stepwise or continuously in the grains. Silver halide grains having a core/shell structure may be preferably used. Core/shell grains having preferably a double to quintuple structure, more preferably a double to quadruple structure may be used. A technique for localizing silver bromide on the surface of silver chloride or silver chlorobromide grains may also be preferably used.

For the preparation of the photosensitive silver halide, methods well known in the art, e.g., the methods described in Research Disclosure, No. 17029 (June, 1978) and U.S. Pat. No. 3,700,458, can be used. More specifically, a method can be used which comprises the step of preparing photosensitive silver halide grains by addition of a silver-supplying compound and a halogen-supplying compound to a solution of gelatin or other polymer, and then adding a silver salt of an organic acid to the resulting grains.

As for a grain size of the photosensitive silver halide, smaller grains are desirable to prevent cloudiness of the photosensitive material after image formation. Specifically, the grain size may preferably be not greater than 0.20 $\mu$m, preferably from 0.01 to 0.15 $\mu$m, more preferably from 0.02 to 0.12 $\mu$m. The term "grain size" used herein means a diameter of a sphere having the same volume as the grain where the silver halide grains are regular crystals in cubic or octahedral form and where the silver halide grains are irregular crystals such as spherical or rod-like grains. Where silver halide grains are tabular grains, the term means the diameter of a circle having the same area as a projected area of the main surface of the tabular grain.

Examples of the form of silver halide grains include a cubic form, octahedral form, tabular form, spherical form, rod-like form and potato-like form. In particular, cubic grains are preferred for the present invention. Silver halide grains having round corners are also preferably used in the present invention. Surface index (Miller index) of outer surfaces of the photosensitive silver halide grains is not particularly limited. However, it is desirable that [100] face should be present in a high proportion that can achieve high spectral sensitizing efficiency when a spectral sensitizing dye adsorbed on the grains. The proportion of [100] face may be preferably not lower than 50%, more preferably at least 65%, still more preferably at least 80%. The proportion of Miller index [100] face can be determined using the method described in T. Tani, J. Imaging Sci., 29, 165 (1985), where the difference in adsorption of a sensitizing dye to [111] face and [100] face is utilized.

The photosensitive silver halide grain used in the present invention contains a metal or metal complex of Group VIII to Group X in the periodic table of elements (including Group I to Group XVIII). The metal or the center metal of the metal complex of Group VIII to X of the periodic table is preferably rhodium, rhenium, ruthenium, osmium or iridium. The metal complex may be used alone, or two or more complexes of the same or different metals may also be used in combination. The metal complex content is preferably from $1\times10^{-9}$ to $1\times10^{-3}$ mole per mole of silver. Such metal complexes are described in JP-A-11-65021, paragraphs 0018 to 0024.

In the present invention, an iridium compound is preferably contained in the silver halide grains. Examples of the iridium compound include hexachloroiridium, hexammineiridium, trioxalatoiridium, hexacyanoiridium and pentachloronitrosyliridium. The iridium compound is used after dissolving it in water or an appropriate solvent, and a method commonly used for stabilizing the iridium compound solution, more specifically, a method comprising adding an aqueous solution of hydrogen halogenide (e.g., hydrochloric acid, bromic acid, fluoric acid) or halogenated alkali (e.g., KCl, NaCl, KBr, NaBr) may be used. In place of using a water-soluble iridium, separate silver halide grains previously doped with iridium may be added and dissolved at the time of preparation of silver halide. The addition amount of the iridium compound is preferably $1\times10^{-8}$ to $1\times10^{-3}$ mole, more preferably $1\times10^{-7}$ to $5\times10^{-4}$ mole, per mole of silver halide.

Further, metal complexes that can be contained in the silver halide grains used for the present invention (e.g., $[Fe(CN)_6]^{4-}$), desalting methods and chemical sensitization methods are described in JP-A-11-84574, paragraphs 0046 to 0050 and JP-A-11-65021, paragraphs 0025 to 0031.

As a sensitizing dye that can be used for the present invention, there can be advantageously selected those sensitizing dyes which can spectrally sensitize silver halide grains within a desired wavelength range after they are adsorbed by the silver halide grains and have spectral sensitivity suitable for spectral characteristics of the light source to be used for exposure. Such sensitizing dyes and addition methods therefor are described in JP-A-11-65021, paragraphs 0103 to 0109 and EP 0803764A1, page 19, line 38 to page 20, line 35, and there can be mentioned the compounds of formula (II) described in JP-A-10-186572. In the present invention, the sensitizing dye is added to the silver halide emulsion preferably during the period after the desalting step and before the coating step, more preferably during the period after the desalting step and before the start of the chemical ripening.

While the amount of the sensitizing dye used in the present invention may be selected to be a desired amount depending on the performance including sensitivity and fog, it is preferably $10^{-6}$ to 1 mole, more preferably $10^{-4}$ to $10^{-1}$ mole, per mole of silver halide in the photosensitive layer.

In the present invention, a supersensitizer can be used in order to improve spectral sensitization efficiency. Examples of the supersensitizer that can be used for the present invention include compounds disclosed in EP-A-587338, U.S. Pat. Nos. 3,877,943, 4,873,184, JP-A-5-341432, JP-A-11-109547, JP-A-10-111543 and so forth.

Photosensitive silver halide grains used for the present invention are preferably subjected to chemical sensitization by sulfur sensitization, selenium sensitization or tellurium sensitization. Any known compounds are preferably usable for such sulfur, selenium or tellurium sensitization, and for example, the compounds described in JP-A-7-128768 are usable for that purpose. In the present invention, especially favorable is tellurium sensitization. Tellurium sensitizers usable herein include, for example, diacyltellurides, bis(oxycarbonyl)tellurides, bis(carbamoyl)tellurides, diacylditellurides, bis(oxycarbonyl)ditellurides, bis(carbamoyl)ditellurides, compounds with P═Te bond, tellurocarboxylates, tellurosulfonates, compounds with P-Te bond, tellurocarbonyl compounds, etc. For these, specifically mentioned are the compounds described in JP-A-11-65021, paragraph 0030. Particularly preferred are those disclosed in JP-A-5-313284 as the compounds of the general formulas (II), (III) and (IV).

In the present invention, the chemical sensitization may be performed at any time so long as it is performed after the formation of the grains and before the coating. It may be performed after desalting and (1) before the spectral sensitization, (2) simultaneously with the spectral sensitization, (3) after the spectral sensitization, (4) immediately before the coating, or the like. It is particularly preferably performed after spectral sensitization.

The amount of the sulfur, selenium or tellurium sensitizer for use in the present invention varies depending on the type of the silver halide grains to be used, the condition for chemical ripening etc., but may fall generally between $10^{-8}$ and $10^{-2}$ mole, preferably between $10^{-7}$ and $10^{-3}$ mole or so, per mol of the silver halide. Although the conditions for the chemical sensitization are not particularly limited in the present invention, pH falls between 5 and 8, pAg falls between 6 and 11, preferably between 7 and 10, and temperature falls between 40 and 95° C., preferably between 44 and 70° C.

In the photothermographic material of the present invention, one kind of photosensitive silver halide emulsion may be used or two or more different emulsions (for example, those having different average grain sizes, different halogen compositions, different crystal habits or different chemical sensitization conditions) may be used in combination. By using plural photosensitive silver halides having different sensitivities, contrast can be controlled. Examples of the techniques concerning this respect include those mentioned in JP-A-57-119341, JP-A-53-106125, JP-A-47-3929, JP-A-48-55730, JP-A-46-5187, JP-A-50-73627, JP-A-57-150841 and so forth. Each emulsion may preferably have sensitivity difference of 0.2 log E or higher.

The amount of the photosensitive silver halide is preferably 0.03 to 0.6 g/m$^2$, more preferably 0.05 to 0.4 g/m$^2$, most preferably 0.1 to 0.4 g/m$^2$, as the amount of coated silver per 1 m$^2$ of a photosensitive material. The amount of the photosensitive silver halide per mole of the silver salt of an organic acid is preferably from 0.01 to 0.5 mole, more preferably from 0.02 to 0.3 mole, still more preferably from 0.03 to 0.25 mole.

Methods and conditions for mixing photosensitive silver halide and a silver salt of an organic acid, which are prepared separately, are not particularly limited so long as the effect of the present invention can be attained satisfactorily. Examples thereof include, for example, a method of mixing silver halide grains and a silver salt of an organic acid after completion of respective preparations by using a high-speed stirring machine, ball mill, sand mill, colloid mill, vibrating mill, homogenizer or the like, or a method of preparing a silver salt of an organic acid by mixing a photosensitive silver halide obtained separately at any time during the preparation of the silver salt of an organic acid.

Preferred addition time point for the silver halide into the coating solution for image-forming layer resides in a period of from 180 minutes before the coating to immediately before the coating, preferably 60 minutes to 10 seconds before the coating. However, the method and conditions for mixing are not particularly limited so long as the effect of the present invention can be attained satisfactorily. Specific examples of the mixing method include a method in which the mixing is performed in a tank designed so that a desired average residence time therein can be obtained, which residence time is calculated from addition flow rate and feeding amount to a coater, a method utilizing a static mixer described in N. Harnby, M. F. Edwards, A. W. Nienow, "Ekitai Kongo Gijutsu (Techniques for Mixing Liquids)", translated by Koji Takahashi, Chapter 8, Nikkan Kogyo Shinbunsha, 1989 and so forth.

In the present invention, the image-forming layer (also referred to as a layer containing silver salt of an organic acid) can be formed by applying a coating solution comprising 30% by weight or more of water as to the total solvent in addition to organic solvent and drying it. In this case, the binder of the image-forming layer is more preferably soluble or dispersible in an aqueous solvent (water solvent). In particular, it is preferably a polymer latex showing an equilibrated moisture content of 2 weight % or less at 25° C. and relative humidity of 60%. In the most preferred embodiment, the polymer latex is prepared to have an ion conductivity of 2.5 mS/cm or less. As a method for preparing such polymer latex, there can be mentioned a method comprising synthesizing a polymer and purifying it by using a functional membrane for separation.

The aqueous solvent in which the polymer binder is soluble or dispersible is water or a mixed solvent of water and 70% by weight or less of a water-miscible organic solvent. Examples of the water-miscible organic solvent include, for example, alcohols such as methyl alcohol, ethyl alcohol and propyl alcohol; cellosolves such as methyl cellosolve, ethyl cellosolve and butyl cellosolve; ethyl acetate, dimethylformamide and so forth.

The terminology "aqueous solvent" referred to herein is also used for systems in which the polymer is not thermodynamically dissolved but is present in a so-called dispersed state.

The "equilibrated moisture content at 25° C. and relative humidity of 60%" referred to herein for polymer latex is represented by the following equation, in which W1 indicates the weight of a polymer in humidity-conditioned equilibrium at 25° C. and relative humidity of 60%, and W0 indicates the absolute dry weight of the polymer at 25° C. Equilibrated moisture content at 25° C. and relative humidity of 60%=[(W1−W0)/W0]×100 (weight %)

For the details of the definition of moisture content and the method for measuring it, for example, there can be referred Lecture of Polymer Engineering, 14, Test Methods for Polymer Materials (Polymer Society of Japan, Chijin Shokan).

The equilibrated moisture content at 25° C. and relative humidity of 60% of the binder polymer used for the present invention is preferably 2% by weight or less, more preferably from 0.01 to 1.5% by weight, even more preferably from 0.02 to 1% by weight.

In the present invention, a polymer dispersible in an aqueous solvent is particularly preferred. Examples of the dispersed state include latex in which solid microparticles of polymer are dispersed, dispersion in which polymer molecules are dispersed in molecular state or forming micelles and so forth, and all of these are preferred.

For example, hydrophobic polymers such as acrylic resins, polyester resins, rubber resins (e.g., SBR resins), polyurethane resins, polyvinyl chloride resins, polyvinyl acetate resins, polyvinylidene chloride resins and polyolefin resins can preferably be used. The polymers may be linear, branched or crosslinked. They may be so-called homopolymers in which a single kind of monomer is polymerized, or copolymers in which two or more different kinds of monomers are polymerized. The copolymers may be random copolymers or block copolymers. The polymers may have a number average molecular weight of 5000 to 1000000, preferably from 10000 to 200000. Polymers having a too small molecular weight may suffer from insufficient mechanical strength of the emulsion layer, and those having a too large molecular weight may suffer from bad film forming property, both of which are not preferred.

The binder polymer preferably has a glass transition temperature (Tg) of −20° C. to 80° C., more preferably 0° C. to 70° C., further preferably 10° C. to 60° C., in view of film-forming property and image storability. Two or more kinds of polymers may be blended and used as the binder. In such a case, weighted average of Tg based on the composition of the components is preferably in the aforementioned ranges. Further, when phase separation is observed in the polymer or the polymer has a core/shell structure, each phase or layer preferably has Tg within the aforementioned range.

The aforementioned "aqueous solvent" refers to a dispersion medium containing 30% by weight or more of water in its composition. The dispersed state may be any of emulsion dispersion, micellar dispersion, dispersion in which a polymer having a hydrophilic moiety in the molecule is dispersed in a molecular state and so forth. Among these, latex is particularly preferred.

Specific examples of the preferred polymer latex are mentioned below. They are expressed with the constituent monomers. The numerals parenthesized indicate the contents in terms of % by weight. The molecular weights are number average molecular weights.

P-1: Latex of -MMA(70)-EA(27)-MAA(3)-(molecular weight: 37000)

P-2: Latex of -MMA(70)-2EHA(20)-St(5)-AA(5)-(molecular weight: 40000)

P-3: Latex of -St(50)-Bu(47)-MMA(3)-(molecular weight: 45000)

P-4: Latex of -St(68)-Bu(29)-AA(3)-(molecular weight: 60000)

P-5: Latex of -St(70)-Bu(27)-IA(3)-(molecular weight: 120000)

P-6: Latex of -St(75)-Bu(24)-AA(1)-(molecular weight: 108000)

P-7: Latex of -St(60)-Bu(35)-DVB(3)-MAA(2)-(molecular weight: 150000)

P-8: Latex of -St(70)-Bu(25)-DVB(2)-AA(3)-(molecular weight: 280000)

P-9: Latex of -VC(50)-MMA(20)-EA(20)-AN(5)-AA(5)-(molecular weight: 80000)

P-10: Latex of -VDC(85)-MMA(5)-EA(5)-MAA(5)-(molecular weight: 67000)

P-11: Latex of -Et(90)-MAA(10)-(molecular weight: 12000)

P-12: Latex of -St(70)-2EHA(27)-AA(3)-(molecular weight: 130000)

P-13: Latex of -MMA(63)-EA(35)-AA(2)-(molecular weight: 33000)

Abbreviations used for the constituent monomers are as follows:

MMA: methyl methacrylate

EA: ethyl acrylate

MAA: methacrylic acid

2EHA: 2-ethylhexyl acrylate

St: styrene

Bu: butadiene

AA: acrylic acid

DVB: divinylbenzene

VC: vinyl chloride

AN: acrylonitrile

VDC: vinylidene chloride

Et: ethylene

IA: itaconic acid

The polymer latexes mentioned above are also commercially available, and those mentioned below can be used, for example. Examples of acrylic resins are CEBIAN A-4635, 46583, 4601 (all from Daicel Chemical Industries), Nipol Lx811, 814, 821, 820, 857 (all from Nippon Zeon) etc.; examples of polyester resins are FINETEX ES650, 611, 675, 850 (all from Dai-Nippon Ink & Chemicals), WD-size, WMS (both from Eastman Chemical) etc.; examples of polyurethane resins are HYDRAN AP10, 20, 30, 40 (all from Dai-Nippon Ink & Chemicals) etc.; examples of rubber resins are LACSTAR 7310K, 3307B, 4700H, 7132C (all from Dai-Nippon Ink & Chemicals), Nipol Lx416, 410, 438C, 2507 (all from Nippon Zeon) etc.; examples of polyvinyl chloride resins are G351, G576 (both from Nippon Zeon) etc.; examples of polyvinylidene chloride resins are L502, L513 (both from Asahi Chemical Industry) etc.; examples of polyolefin resins are CHEMIPEARL S120, SA100 (both from Mitsui Petrochemical) etc.

These polymer latexes may be used each alone, or two or more kinds of them may be blended as required.

As the polymer latex used in the present invention, styrene/butadiene copolymer latex is particularly preferred. In the styrene/butadiene copolymer, the weight ratio of styrene monomer units to butadiene monomer units is preferably 40:60 to 95:5. The ratio of the styrene monomer units and the butadiene monomer units preferably account for from 60 to 99% by weight of the copolymer. The preferred range of the molecular weight of the copolymer is similar to that mentioned above.

Examples of styrene/butadiene copolymer latex preferably used for the present invention include the aforementioned P-3 to P-8, commercially available products, LACSTAR-3307B, 7132C, Nipol Lx416 and so forth.

The image-forming layer of the photothermographic material of the present invention may optionally be added with a hydrophilic polymer such as gelatin, polyvinyl alcohol, methylcellulose and hydroxypropylcellulose. The amount of the hydrophilic polymer is preferably 30% by weight or less, more preferably 20% by weight or less, of the total binder in the layer containing silver salt of an organic acid.

The image-forming layer of the photothermographic material of the invention is preferably formed by using polymer latex. The amount of the binder in the layer containing silver salt of an organic acid is such an amount that the weight ratio of total binder/silver salt of an organic acid should be 1/10 to 10/1, more preferably 1/5 to 4/1.

The image-forming layer usually also serves as a photosensitive layer (emulsion layer) containing a photosensitive silver salt, that is, a photosensitive silver halide. In such a case, the weight ratio of total binder/silver halide is preferably 5 to 400, more preferably 10 to 200.

The total amount of the binder in the image-forming layer is preferably 0.2 to 30 g/m$^2$, more preferably 1 to 15 g/m$^2$. The image-forming layer may optionally contain a crosslinking agent for crosslinking, a surfactant for improving coating property of the coating solution and so forth.

The solvent for the coating solution for the image-forming layer containing silver salt of an organic acid of the photothermographic material of the invention (for simplicity, solvents and dispersion media are collectively referred to as "solvent") is preferably an aqueous solvent containing at least 30% by weight of water. As for components other than water, any water-miscible organic solvents may be used, including, for example, methyl alcohol, ethyl alcohol, isopropyl alcohol, methyl cellosolve, ethyl cellosolve, dimethylformamide, ethyl acetate and so forth. The water content of the solvent for the coating solution is preferably at least 50% by weight, more preferably at least 70% by weight. Preferred examples of the solvent composition are water, water/methyl alcohol=90/10, water/methyl alcohol=70/30, water/methyl alcohol/dimethyl-formamide=80/15/5, water/methyl alcohol/ethyl cellosolve=85/10/5, water/methyl alcohol/isopropyl alcohol=85/10/5 and so forth (numerals indicate weight %).

As antifoggants, stabilizers and stabilizer precursors that can be used for the present invention, there can be mentioned, for example, those mentioned in JP-A-10-62899, paragraph 0070 and EP 0803764A1, from page 20, line 57 to page 21, line 7.

The compound represented by the general formula (A) that is used for the present invention will be explained.

Q represents an alkyl group, an aryl group or a heterocyclic group.

The aryl group represented by Q may be monocyclic, or may have a condensed ring structure. Preferably, the aryl group is a monocyclic or bicyclic aryl group having from 6 to 30 carbon atoms (e.g., phenyl, naphthyl, etc.). More preferred is phenyl group or naphthyl group; and even more preferred is phenyl group.

The heterocyclic group represented by Q is a 3-membered to 10-membered saturated or unsaturated heterocyclic group having at least one of N, O and S atoms. The heterocyclic group may be monocyclic or may form a condensed ring structure with any other rings.

The heterocyclic group is preferably a 5- or 6-membered unsaturated heterocyclic group optionally having a condensed ring structure, more preferably a 5- or 6-membered aromatic heterocyclic group optionally having a condensed ring structure. More preferably, it is a nitrogen-containing 5- or 6-membered aromatic heterocyclic group optionally having a condensed ring structure, even more preferably a 5- or 6-membered aromatic heterocyclic group having from 1 to 4 nitrogen atoms and optionally having a condensed ring structure.

Specific examples of the hetero ring in the heterocyclic group are pyrrolidine, piperidine, piperazine, morpholine, thiophene, furan, pyrrole, imidazole, pyrazole, pyridine, pyrimidine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzthiazole, benzoselenazole, indolenine, tetrazaindene, etc. Preferably, the hetero ring is any of imidazole, pyrazole, pyridine, pyrimidine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzthiazole, indolenine and tetrazaindene; and is more preferably any of imidazole, pyridine, pyrimidine, pyrazine, pyridazine, triazole, triazine, thiadiazole, oxadiazole, quinoline, phthalazine, naphthyridine, quinoxaline, quinazoline, cinnoline, tetrazole, thiazole, oxazole, benzimidazole, benzoxazole, benzthiazole, tetrazaindene; and is even more preferably imidazole, pyridine, pyrimidine, pyrazine, pyridazine, triazole, triazine, thiadiazole, quinoline, phthalazine, naphthyridine, quinoxaline, quinazoline, cinnoline, tetrazole, thiazole, benzimidazole and benzthiazole; and is still more preferably any of pyridine, thiadiazole, quinoline, and benzthiazole.

The aryl or heterocyclic group represented by Q may have any other substituents in addition to the group represented by —(Y)m—CZ($X^1$) ($X^2$) . The additional substituents include, for example, an alkyl group preferably having from 1 to 20, more preferably from 1 to 12, even more preferably from 1 to 8 carbon atoms, such as methyl, ethyl, n-propyl, isopropyl, n-butyl, iso-butyl, tert-butyl, n-octyl, n-decyl, n-hexadecyl, cyclopropyl, cyclopentyl, cyclohexyl, etc.; an alkenyl group preferably having from 2 to 20, more preferably from 2 to 12, even more preferably from 2 to 8 carbon atoms, such as vinyl, allyl, 2-butenyl, 3-pentenyl, etc.; analkynyl group preferably having from 2 to 20, more preferably from 2 to 12, even more preferably from 2 to 8 carbon atoms, such as propargyl, 3-pentynyl, etc. ; an aryl group preferably having from 6 to 30, more preferably from 6 to 20, even more preferably from 6 to 12 carbon atoms, such as phenyl, p-methylphenyl, naphthyl, etc.; an amino group preferably having from 0 to 20, more preferably from 0 to 10, even more preferably from 0 to 6 carbon atoms, such as amino, methylamino, dimethylamino, diethylamino, dibenzylamino, etc.; an alkoxy group preferably having from 1 to 20, more preferably from 1 to 12, even more preferably from 1 to 8 carbon atoms, such as methoxy, ethoxy, butoxy, etc.; an aryloxy group preferably having from 6 to 20, more preferably from 6 to 16, even more preferably from 6 to 12 carbon atoms, such as phenyloxy, 2-naphthyloxy, etc.; an acyl group preferably having from 1 to 20, more preferably from 1 to 16, even more preferably from 1 to 12 carbon atoms, such as acetyl, benzoyl, formyl, pivaloyl, etc.; an alkoxycarbonyl group preferably having from 2 to 20, more preferably from 2 to 16, even more preferably from 2 to 12 carbon atoms, such as methoxycarbonyl, ethoxycarbonyl, etc.; an aryloxycarbonyl group preferably having from 7 to 20, more preferably from 7 to 16, even more preferably from 7 to 10 carbon atoms, such as phenyloxycarbonyl, etc.; an acyloxy group preferably having from 2 to 20, more preferably from 2 to 16, even more preferably from 2 to 10 carbon atoms, such as acetoxy, benzoyloxy, etc.; an acylamino group preferably having from 2 to 20, more preferably from 2 to 16, even more preferably from 2 to 10 carbon atoms, such as acetylamino, benzoylamino, etc.; an alkoxycarbonylamino group preferably having from 2 to 20, more preferably from 2 to 16, even more preferably from 2 to 12 carbon atoms, such as methoxycarbonylamino, etc.; an aryloxycarbonylamino group preferably having from 7 to 20, more preferably from 7 to 16, even more preferably from 7 to 12 carbon atoms, such as phenyloxycarbonylamino, etc.; a sulfonylamino group preferably having from 1 to 20, more preferably from 1 to 16, even more preferably from 1 to 12 carbon atoms, such as methanesulfonylamino, benzenesulfonylamino, etc.; a sulfamoyl group preferably having from 0 to 20, more preferably from 0 to 16, even more preferably from 0 to 12 carbon atoms, such as sulfamoyl, methylsulfamoyl, dimethylsulfamoyl, phenylsulfamoyl, etc.; a carbamoyl group preferably having from 1 to 20, more preferably from 1 to 16, even more preferably from 1 to 12 carbon atoms, such as carbamoyl, methylcarbamoyl, diethylcarbamoyl, phenylcarbamoyl, etc.; an alkylthio group preferably having from 1 to 20, more preferably from 1 to 16, even more preferably from 1 to 12 carbon atoms, such as methylthio, ethylthio, etc.; an arylthio group preferably having from 6 to 20, more preferably from 6 to 16, even more preferably from 6 to 12 carbon atoms, such as phenylthio, etc.; a sulfonyl group preferably having from 1 to 20, more preferably from 1 to 16, even more preferably from 1 to 12 carbon atoms, such as mesyl, tosyl, phenylsulfonyl, etc.; a sulfinyl group preferably having from 1 to 20, more preferably from 1 to 16, even more preferably from 1 to 12 carbon atoms, such as methanesulfinyl, benzenesulfinyl, etc.; an ureido group preferably having from 1 to 20, more preferably from 1 to 16, even more preferably from 1 to 12 carbon atoms, such as ureido, methylureido, phenylureido, etc.; a phosphoric acid amido group preferably having from 1 to 20, more preferably from 1 to 16, even more preferably from 1 to 12 carbon atoms, such as diethylphosphoric acid amido, phenylphosphoric acid amido, etc.; a hydroxyl group; a mercapto group; a halogen atom (e.g., fluorine atom, chlorine atom, bromine atom, iodine atom); a cyano group; a sulfo group; a carboxyl group; a nitro group; a hydroxamic acid group; a sulfino group; a hydrazino group; a heterocyclic group (e.g., imidazolyl, pyridyl, furyl, piperidyl, morpholino, etc.), etc. These substituents may be substituted with additional substituents. Two or more substituents, if present, may be the same or different.

Among these substituents, preferred are an alkyl group, an alkenyl group, an aryl group, an alkoxy group, an aryloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, an ureido group, a phosphoric acid amido group, a halogen atom, a cyano group, a sulfo group, a carboxyl group, a nitro group, and a heterocyclic group; more preferred are an alkyl group, an aryl group, an alkoxy group, an aryloxy group, an acyl group, an acylamino group, an alkoxycarbonylamino group, an aryloxycarbonylamino group, a sulfonylamino group, a sulfamoyl group, a carbamoyl group, an ureido group, a phosphoric acid amido group, a halogen atom, a cyano group, a nitro group, and a heterocyclic group; even more preferred are an alkyl group, an aryl group, an alkoxy group, an aryloxy group, an acyl group, an acylamino group, a sulfonylamino group, a sulfamoyl group, a carbamoyl group, a halogen atom, a cyano group, a nitro group and a heterocyclic group; and particularly preferred are an alkyl group, an aryl group, a halogen atom and a carbamoyl group. Q is most preferably a phenyl group substituted with a carbamoyl group.

The alkyl group represented by Q may be linear, branched, cyclic, or a combination thereof. Preferably, the alkyl group has from 1 to 30 carbon atoms, more preferably from 1 to 15 carbon atoms, including, for example, methyl group, ethyl group, n-propyl group, isopropyl group, tert-octyl group, etc.

The alkyl group represented by Q may have any other substituents in addition to —(Y)m—CZ($X^1$) ($X^2$). As examples of the substituents, there are mentioned the same groups as those mentioned hereinabove as substituents for the heterocyclic or aryl group represented Q. As the substituents, preferred are an alkenyl group, an aryl group, an alkoxy group, an aryloxy group, an acyloxy group, an acylamino group, an alkoxycarbonylamino group, an aryloxycarbonylamino group, a sulfonylamino group, an alkylthio group, an arylthio group, an ureido group, a phosphoric acid amido group, hydroxyl group, a halogen atom and a heterocyclic group; more preferred are an aryl group, an alkoxy group, an aryloxy group, an acylamino group, an alkoxycarbonylamino group, an aryloxycarbonylamino group, a sulfonylamino group, an ureido group, a phosphoric acid amido group, and a halogen atom; and even more preferred are an aryl group, an alkoxy group, an aryloxy group, an acylamino group, a sulfonylamino group, an ureido group and a phosphoric acid amido group.

These substituents may be further substituted. Two or more substituents, if any, may be the same or different.

Y represents —C(=O)—, —SO— or —$SO_2$—, preferably —C(=O)— or —$SO_2$—, more preferably —$SO_2$—.

m represents 0 or 1, but is preferably 1. $X^1$ and $X^2$ each independently represent a halogen atom, and the halogen atoms represented by $X^1$ and $X^2$ may be the same or different. The halogen atom includes fluorine, chlorine, bromine and iodine atoms; and is preferably any of chlorine, bromine and iodine atoms, more preferably any of chlorine and bromine atoms, even more preferably a bromine atom.

Z represents hydrogen atom or an electron withdrawing group. The electron withdrawing group represented by Z is preferably a substituent having $\sigma_p$ value of at least 0.01, more preferably at least 0.1. Regarding the Hammett's substituent constant $\sigma_p$, for example, Journal of Medicinal Chemistry, 1973, Vol. 16, No. 11, pp. 1207–1216 and so forth can be referred to. The electron withdrawing group includes, for example, a halogen atom (e.g., fluorine atom with $\sigma_p$ of 0.06, chlorine atom with $\sigma_p$ of 0.23, bromine atom with $\sigma_p$ of 0.23, iodine atom with $\sigma_p$ of 0.18), a trihalomethyl group (e.g., tribromomethyl with $\sigma_p$ of 0.29, trichloromethyl with $\sigma_p$ of 0.33, trifluoromethyl with $\sigma_p$ of 0.54), a cyano group with $\sigma_p$ of 0.66, a nitro group with $\sigma_p$ of 0.78, an aliphatic, aryl or heterocyclic sulfonyl group (e.g., methanesulfonyl with $\sigma_p$ of 0.72), an aliphatic, aryl or heterocyclic acyl group (e.g., acetyl with $\sigma_p$ of 0.50, benzoyl with $\sigma_p$ of 0.43), an alkynyl group (e.g., C≡CH with $\sigma_p$ of 0.23), an aliphatic, aryl or heterocyclic oxycarbonyl group (e.g., methoxycarbonyl with $\sigma_p$ of 0.45), phenoxycarbonyl with $\sigma_p$ of 0.44), a carbamoyl group with $\sigma_p$ of 0.36, a sulfamoyl group with $\sigma_p$ of 0.57, etc.

Preferably, Z is an electron withdrawing group; more preferably a halogen atom, an aliphatic, aryl or heterocyclic sulfonyl group, an aliphatic, aryl or heterocyclic acyl group, an aliphatic, aryl or heterocyclic oxycarbonyl group, a carbamoyl group, or a sulfamoyl group; even more preferably a halogen atom. Among the halogen atom, preferred is a chlorine, bromine or iodine atom; more preferred is a chlorine or bromine atom; even more preferred is a bromine atom.

Among the compounds represented by the general formula (A), preferred are those compounds wherein m is 0, more preferably those compounds wherein Y is —$SO_2$—.

The photothermographic material of the present invention contains a compound represented by the general formula (A) and having a melting point not lower than a heat development temperature for the photothermographic material by more than 10° C. but not higher than the heat development temperature by more than 55° C. The melting point is preferably not lower than the heat development temperature but not higher than the heat development temperature by more than 50° C., more preferably higher than the heat development temperature by 10° C. or more but not higher than the heat development temperature by more than 40° C. For example, when the heat development temperature is 120° C., the expression that a melting point of the compound represented by the general formula (A) is not lower than a heat development temperature for the photothermographic material by more than 10° C. but not higher than the heat development temperature by more than 55° C. means that the melting point is in the range of 110–175° C. While each kind of the compound represented by the general formula (A) may be used alone, two or more kinds of the compound may be used in combination.

Specific examples of the compound represented by the general formula (A) are mentioned below. However, the photothermographic material of the present invention is not limited to those containing the following compounds.

A-1

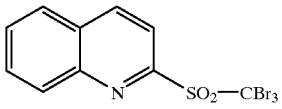

A-2

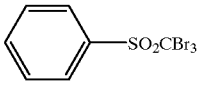

A-3

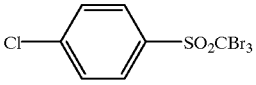

A-4

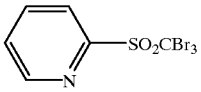

A-5

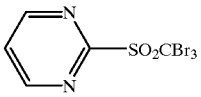

A-6

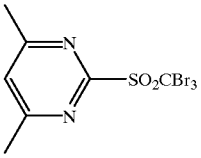

A-7

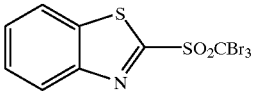

A-8

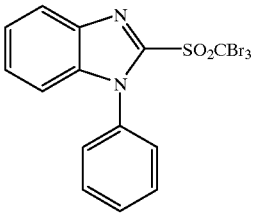

A-9

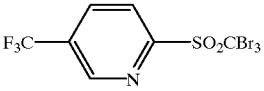

-continued

A-10

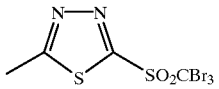

A-11

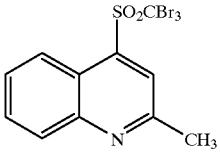

A-12

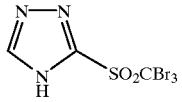

A-13

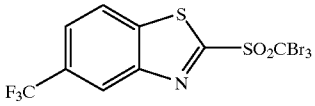

A-14

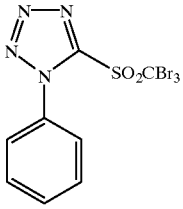

A-15

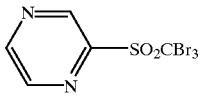

A-16

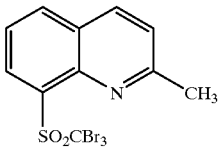

A-17

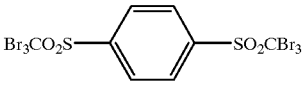

A-18

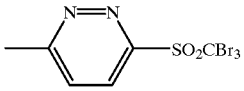

A-19

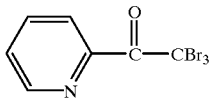

A-20

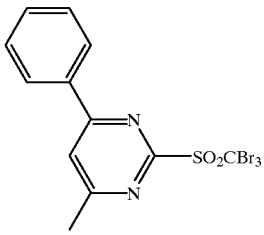

-continued

A-21

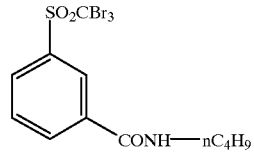

A-22

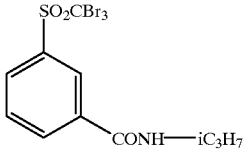

A-23

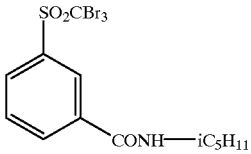

A-24

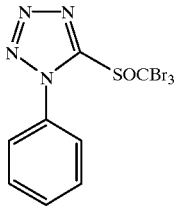

A-25

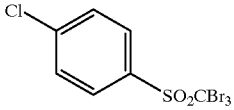

The compound of the general formula (A) for use in the invention, where Y is —SO— or —$SO_2$—, can be produced, for example, by (1) synthesizing an α-arylthio- or heterocyclylthioacetic acid derivative from an aryl or heterocyclylmercaptan and an α-halogenoacetic acid or α-halogenoacetate derivative, followed by (2) oxidizing and brominating the acetic acid derivative. For producing it, also employable is a method of oxidizing and brominating a corresponding sulfide derivative as described in JP-A-304059, or a method of halogenating a corresponding sulfone derivative as described in JP-A-264754.

As for the conversion into an α-arylthio- or heterocyclylthioacetic acid derivative, the corresponding mercaptan compound can be reacted with an α-halogenoacetic acid derivative or the like under a basic condition.

As for oxidization and halogenation of the α-arylthio- or heterocyclylthioacetic acid derivative, the derivative or its salt may be added to an aqueous basic solution of hypohalogenous acid or its salt and reacted with it to perform the oxidization and halogenation simultaneously, for example, as described in U.S. Pat. No. 3,874,946, European Patent Publication No. 60598, etc. Alternatively, the α-arylthio- or heterocyclylthioacetic acid derivative may be previously oxidized with an oxidizing agent such as hydrogen peroxide or the like into its sulfoxide or sulfonylacetic acid derivative, which may be thereafter halogenated into the intended compound.

For producing the starting alkyl, aryl or heterocyclic mercaptans, various methods are known. For example, for producing alkylmercaptans and arylmercaptans, employable are the methods described in Shin-Jikken Kagaku Koza (Lecture on New Experimental Chemistry), Maruzen, 14-III, Chapter 8, 8-1; Organic Functional Group Preparations (Sandler, Karo, Academic Press, New York and Rondon), I, Chapter 18; The Chemistry of Functional Groups, Patai, John Willy and Sons, "The Chemistry of the Thiol Group", Chapter 4. For producing heterocyclylmercaptans, employable are the methods described in Comprehensive Heterocyclic Chemistry, Pergamaon Press, 1984; Heterocyclic Compounds, John Willey and Sons, Vols. 1–9, 1950–1967 and so forth.

The compound of the general formula (A), where Y is —C(=O)—, can be produced by (1) synthesizing an acetophenone or carbonyl-substituted heterocyclic derivative, followed by α-halogenating the carbonyl compound. For α-halogenation of the carbonyl compound, for example, employable is the method described in Shin-Jikken Kagaku Koza (Lecture on New Experimental Chemistry), Maruzen, 14-I, Chapter 2.

The compound of the general formula (A), where m=0, can be produced by halogenating toluene, xylene or a heterocyclic compound having methyl group. The halogenation may be effected, for example, according to the method described in Shin-Jikken Kagaku Koza (Lecture on New Experimental Chemistry), Maruzen, 14-I, Chapter 2, as in the above.

The compound of the general formula (A) may be added in the form of solid microparticle dispersion prepared by using a dispersing agent in order to obtain microparticles with a small particle size and without aggregation. In order to obtain solid microparticle dispersion of the compound represented by the general formula (A) according to the present invention, the compound can be mechanically dispersed in the presence of a dispersing aid in known pulverizing means (e.g., ball mill, vibrating ball mill, planetary ball mill, sand mill, colloid mill, jet mill, roller mill).

When the compound of the general formula (A) is dispersed in the presence of a dispersing agent to give solid microparticle dispersion, suitably selected are synthetic anion polymers such as polyacrylic acid, acrylic acid copolymer, maleic acid copolymer, maleic acid monoester copolymer and acryloylmethylpropanesulfonic acid copolymer, semisynthetic anionic polymers such as carboxymethyl starch and carboxymethylcellulose, anionic polymers such as alginic acid and pectic acid, anionic surfactants described in JP-A-52-92716, WO88/04794 and so forth, the compounds described in JP-A-9-179243, known anionic, nonionic or cationic surface active agents, known polymers such as polyvinyl alcohol, polyvinylpyrrolidone, carboxymethylcellulose, hydroxypropylcellulose and hydroxypropylmethylcellulose, and naturally-occurring polymer compounds such as gelatin.

The dispersing aid is generally mixed with the compound represented by the general formula (A) in a form of powder or wet cake before the dispersing process, and fed as slurry into a dispersing apparatus. However, the dispersing aid may also be mixed with the compound represented by the general formula (A) beforehand, and then the mixture may be subjected to a treatment such as by heating or with a solvent to form powder or wet cake. The pH may be controlled with a suitable pH modifier before, during or after the dispersing operation.

Other than the mechanical dispersion, the compound represented by the general formula (A) can be made into microparticles by roughly dispersing the compound in a solvent through pH control, and then changing the pH in the presence of a dispersing aid. For the operation, an organic solvent may be used as a solvent for the rough dispersion, and such organic solvent is generally removed after the formation of the microparticles.

The dispersion prepared can be stored with stirring to prevent precipitation of the grains during storage, or stored in a highly viscous state formed by means of hydrophilic colloids (e.g., a jelly state formed with gelatin). Furthermore, the dispersion may contain a preservative in order to prevent proliferation of microorganisms during storage.

The compound represented by the general formula (A) may be added to any site of the photothermographic material of the invention without particular limitation. For example, it may be added to the image-forming layer (photosensitive layer, heat-sensitive layer), the protective layer and any other layers of the material. Preferably, it is added to the layer containing a silver salt of an organic silver salt, or to the layer containing silver halide.

The compound of the general formula (A) may be used as each kind alone or as combination of two or more kinds of the compound. Preferably, the photothermographic material contains the compound of the general formula (A) in an amount of from $1\times10^{-6}$ mole to 0.5 mole, more preferably from $1\times10^{-5}$ mole to $1\times10^{-1}$ mole, per mol of silver, on the surface having the image-forming layer.

Other examples of the antifoggant include the mercury (II) salts described in JP-A-11-65021, paragraph 0113, the benzoic acids described in the same, paragraph 0114, the salicylic acid derivatives represented by the formula (Z) mentioned in Japanese Patent Application No. 11-87297 and the formalin scavenger compounds represented by the formula (S) mentioned in Japanese Patent Application No. 11-23995.

The photothermographic material of the invention may contain an azolium salt as the antifoggant. Examples of the azolium salt include, for example, the compounds of the formula (XI) described in JP-A-59-193447, the compounds described in JP-B-55-12581 and the compounds of the formula (II) described in JP-A-60-153039. The azolium salt may be added to any site of the photothermographic material, but is preferably to a layer on the photosensitive layer side, more preferably to the image-forming layer. The azolium salt may be added at any time during the preparation of the coating solution. When the azolium salt is added to the image-forming layer, it may be added at any time during the period of from the preparation of the silver salt of an organic acid to the preparation of the coating solution. However, the azolium salt is preferably added during the period after the preparation of the silver salt of an organic acid and immediately before the coating. The azolium salt may be added in any form such as powder, solution and microparticle dispersion. It may also be added as a solution that also contains other additives such as sensitizing dye, reducing agent and toning agent. The amount of the azolium salt to be added is not particularly limited, but it is preferably $1\times10^{-6}$ mole to 2 moles, more preferably $1\times10^{-3}$ mole to 0.5 mole, per mole of silver.

The photothermographic material of the invention may optionally contain any of mercapto compounds, disulfide compounds and thione compounds in order to control development by retarding or accelerating it, or enhance spectral sensitization efficiency, or improve storage stability before and after development. Examples of those compounds include, for example, those described in JP-A-10-62899, paragraphs 0067 to 0069, those of the formula (I) mentioned in JP-A-10-186572 and those mentioned in the paragraphs 0033 to 0052 of the same as specific examples, and the mercapto compounds described in EP 0803764A1, page 20, lines 36 to 56. Among these, preferred are mercapto-substituted heteroaromatic compounds.

A compound having a phosphoryl group is preferably used for the present invention, and phosphine oxides are particularly preferred. Specific examples thereof include triphenylphosphine oxide, tri-(4-methylphenyl)phosphine oxide, tri-(4-methoxyphenyl)phosphine oxide, tri-(t-butylphenyl)phosphine oxide, tri-(3-methylphenyl)phosphine oxide, trioctylphosphine oxide and so forth. The compound having a phosphoryl group used for the present invention can be introduced into the photothermographic material in the same manner as that for the reducing agent or the polyhalogenated compounds. The compound having a phosphoryl group used for the present invention is used in an amount of preferably 0.1–1.0, more preferably 0.1–2.0, further preferably 0.2–1.0, with respect to the amount of the reducing agent (molar ratio).

The photothermographic material of the present invention is preferably added with a toning agent. Examples of the toning agent are mentioned in JP-A-10-62899, paragraphs 0054 to 0055 and EP 0803764A1, page 21, lines 23 to 48. Preferred are phthalazinone, phthalazinone derivatives (e.g., 4-(1-naphthyl)phthalazinone, 6-chlorophthalazinone, 5,7-dimethoxyphthalazinone, 2,3-dihydro-1,4-phthalazinone and other derivatives) and metal salts thereof; combinations of phthalazinones and phthalic acid or derivatives thereof (e.g., phthalic acid, 4-methylphthalic acid, 4-nitrophthalic acid, tetrachlorophthalic anhydride etc.); phthalazines including phthalazine and phthalazine derivatives (e.g., 4-(1-naphthyl)phthalazine, 6-isopropylphthalazine, 6-t-butylphthalazine, 6-chlorophthalazine, 5,7-dimethoxyphthalazine, 2,3-dihydrophthalazine and other derivatives) and metal salts thereof; combinations of phthalazines and phthalic acid or derivatives thereof (e.g., phthalic acid, 4-methylphthalic acid, 4-nitrophthalic acid, tetrachlorophthalic anhydride etc.). Particularly preferred are combinations of phthalazines and phthalic acid derivatives.

Plasticizers and lubricants that can be used for the photosensitive layer of the photothermographic material are described in JP-A-11-65021, paragraph 0117. Ultrahigh contrast agents for forming ultrahigh contrast images are described in the same publication, paragraph 0118, JP-A-11-223898, paragraphs 0136 to 0193, Japanese Patent Application No. 11-91652, general formula (H), formulas (1) to (3), formulas (A) and (B) and those mentioned in Japanese Patent Application No. 11-91652 as compounds of the general formulas (III) to (V) (specific compounds: Chem. 21 to Chem 24); and hardness enhancement promoters are described in JP-A-11-65021, paragraph 0102, and JP-A-11-223898, paragraphs 0194 to 0195. Addition methods and amounts of a nucleating agent are described in JP-A-11-223898, paragraphs 0182 to 0183.

When formic acid or a formic acid salt is used as a strongly fogging substance, it is preferably used on the side having the image-forming layer containing a photosensitive silver halide in an amount of 5 mmol or less, more preferably 1 mmol or less, per 1 mole of silver.

When a nucleating agent is used in the photothermographic material the present invention, an acid formed by hydration of diphosphorus pentoxide or a salt thereof is preferably used together with the nucleating agent. Examples of the acid formed by hydration of diphosphorus pentoxide or a salt thereof include metaphosphoric acid (salt), pyrophosphoric acid (salt), orthophosphoric acid (salt), triphosphoric acid (salt), tetraphosphoric acid (salt), hexametaphosphoric acid (salt) and so forth. Particularly preferably used acids formed by hydration of diphosphorus pentoxide or salts thereof are orthophosphoric acid (salt) and hexametaphosphoric acid (salt). Specific examples of the salt are sodium orthophosphate, sodium dihydrogenorthophosphate, sodium hexametaphosphate, ammonium hexametaphosphate and so forth.

The acid formed by hydration of diphosphorus pentoxide or a salt thereof may be used in a desired amount (coating amount per 1 $m^2$ of the photothermographic material) depending on the desired performance including sensitivity and fog. However, it can preferably be used in an amount of 0.1–500 $mg/m^2$, more preferably 0.5–100 $mg/m^2$.

The photothermographic material of the present invention may be provided with a surface protective layer, for example, to prevent adhesion of the image-forming layer. The surface protective layer is described in, for example, JP-A-11-65021, paragraphs 0119 to 0120.

Gelatin is preferred as the binder in the surface protective layer, and polyvinyl alcohol (PVA) is also preferably used. Examples of PVA include, for example, completely saponified PVA-105 [having a polyvinyl alcohol (PVA) content of at least 94.0% by weight, a degree of saponification of 98.5 ±0.5 mole %, a sodium acetate content of 1.5% by weight or less, a volatile content of 5.0% by weight or less, a viscosity (4% by weight at 20° C.) of 5.6±0.4 mPa.s]; partially saponified PVA-205 [having a PVA content of 94.0% by weight, a degree of saponification of 88.0±1.5 mole %, a sodium acetate content of 1.0% by weight, a volatile content of 5.0% by weight, a viscosity (4% by weight at 20° C.) of 5.0±0.4 mPa·s]; denatured polyvinyl alcohols, MP-102, MP-202, MP-203, R-1130, R2105 (all from Kraray Co., Ltd.) and so forth. The application amount of the polyvinyl alcohol (per $m^2$ of the support) for protective layers is preferably 0.3 to 4.0 $g/m^2$, more preferably 0.3 to 2.0 $g/m^2$ (per one layer).

When the photothermographic material of the present invention is used for printing use is which dimensional change is critical, in particular, polymer latex is preferably used also in a protective layer or a back layer. Such latex is described in "Gosei Jushi Emulsion (Synthetic Resin Emulsion)", compiled by Taira Okuda and Hiroshi Inagaki, issued by Kobunshi Kanko Kai (1978) ; "Gosei Latex no Oyo (Application of Synthetic Latex)", compiled by Takaaki Sugimura, Yasuo Kataoka, Souichi Suzuki and Keishi Kasahara, issued by Kobunshi Kanko Kai (1993); Soichi Muroi, "Gosei Latex no Kagaku (Chemistry of Synthetic Latex)", Kobunshi Kanko Kai (1970) and so forth. Specific example thereof include latex of methyl methacrylate (33.5 weight %)/ethyl acrylate (50 weight %)/methacrylic acid (16.5 weight %) copolymer, latex of methyl methacrylate (47.5 weight %)/butadiene (47.5 weight %)/itaconic acid (5 weight %) copolymer, latex of ethyl acrylate/methacrylic acid copolymer, latex of methyl methacrylate (58.9 weight %)/2-ethylhexyl acrylate (25.4 weight %)/styrene (8.6 weight %)/2-hydroxyethyl methacrylate (5.1 weight %)/acrylic acid (2.0 weight %) copolymer and so forth. As for the binder of the protective layer, there may be used the combination of polymer latex disclosed in Japanese Patent Application No. 11-6872, and techniques disclosed in Japanese Patent Application No. 11-143058, paragraphs 0021–0025, Japanese Patent Application No. 11-6872, paragraphs 0027–0028, and Japanese Patent Application No. 11-199626, paragraphs 0023–0041.

The temperature for preparation of the coating solution for the image-forming layer may preferably be 30° C. to 65° C., more preferably 35° C. to 60° C., most preferably 35° C.

to 55° C. The temperature of the coating solution for the image-forming layer immediately after the addition of the polymer latex may preferably be kept at 30° C. to 65° C. A reducing agent and a silver salt of an organic acid may preferably be mixed before the addition of polymer latex.

The fluid containing silver salt of organic acid or coating solution for the image-forming layer is preferably a so-called thixotropic flow. Thixotropy means that viscosity of a fluid lowers with increase of shear rate. Any apparatus may be used for measurement of viscosity. For example, RFS Fluid Spectrometer from Rheometrics Far East Co., Ltd. is preferably used, and the measurement is performed at 25° C. Viscosity of the fluid containing silver salt of organic acid or coating solution for the image-forming layer is preferably 400 mPa·s to 100,000 mPa·s, more preferably 500 mPa·s to 20,000 mPa·s, at a shear rate of 0.1 $sec^{-1}$. The viscosity is preferably 1 mPa.s to 200 mPa.s, more preferably 5 mPa.s to 80 mPa.s, at a shear rate of 1000 $sec^{-1}$.

Various systems exhibiting thixotropic property are known and, for example, described in "Lecture on Rheology", Kobunshi Kanko Kai; Muroi & Morino, "Polymer Latex", Kobunshi Knako Kai and so forth. A fluid is required to contain a large amount of fine solid microparticles to exhibit thixotropic property. For enhancing thixotropic property, it is effective that the fluid is added with a viscosity-increasing linear polymer, or fine solid microparticles to be contained have anisotropic shapes and an increased aspect ratio. Use of an alkaline viscosity-increasing agent or a surfactant is also effective for that purpose.

The photothermographic material of the present invention is constituted by one or more layers on the support. When it is constituted with a monolayer, the layer must contain at least one kind of photosensitive silver halide, silver salt of an organic acid, reducing agent for silver ions, binder and desired additional materials such as toning agent, coating aid and other auxiliary agents. When the layer is bilayer, the first emulsion layer (in general, the layer adjacent to the support) may contain a silver salt of an organic acid and photosensitive silver halide, and the second emulsion layer or the both layers may contain the other ingredients such as toning agent, coating aid and other auxiliary agents. Another type of bilayer structure is also employable in which one layer is a single emulsion layer containing all necessary ingredients and the other layer is a protective top coat layer. Multicolor photothermographic material may contain these two layers for each color, or may contain all necessary ingredients in a single layer as described in U.S. Pat. No. 4,708,928. As for multicolor photothermographic materials containing multiple dyes, each emulsion layers are kept individually by using a functional or non-functional barrier layer between the adjacent photosensitive layers as described in U.S. Pat. No. 4,460,681.

For the photosensitive layer, various types of dyes and pigments may be used to improve color tone, to prevent interference fringes generated during laser exposure, and to prevent irradiation. These techniques are detailed in International Patent Publication WO98/36322. Preferred dyes and pigments for the photosensitive layer include, for example, anthraquinone dyes, azomethine dyes, indoaniline dyes, azo dyes, indanthrone pigments of anthraquinone type (e.g., C.I. Pigment Blue 60 and so forth), phthalocyanine pigments (e.g., copper phthalocyanines such as C.I. Pigment Blue 15; metal-free phthalocyanines such as C.I. Pigment Blue 16), triarylcarbonyl pigments of printing lake pigment type, indigo, inorganic pigments (e.g., ultramarine, cobalt blue and so forth). Any methods are employed to add these dyes and pigments such as addition as a solution, an emulsion, or a dispersion of solid microparticles, or addition of a polymer mordant mordanted with these. The amount of these compounds to be used may vary depending on intended absorbance. In general, the compounds may preferably be used in an amount of 1 $\mu$g to 1 g per $m^2$ of the photothermographic material.

In the photothermographic material of the invention, an antihalation layer may be provided in a distant position from a light source relative to the photosensitive layer. The antihalation layer is described in JP-A-11-65021, paragraphs 0123 to 0124.

In the photothermographic material of the present invention, a decoloring dye and a base precursor are preferably added to a non-photosensitive layer of the photothermographic material so that the non-photosensitive layer can function as a filter layer or an antihalation layer. Photothermographic materials generally have non-photosensitive layers in addition to the photosensitive layers. Depending on their positions, the non-photosensitive layers are classified into (1) a protective layer to be provided on a photosensitive layer (the opposite side of the support); (2) an intermediate layer to be provided between two or more of photosensitive layers or between a photosensitive layer and a protective layer; (3) an undercoat layer to be provided between a photosensitive layer and a support; (4) a back layer to be provided on a side opposite to the photosensitive layer. The filter layer is provided in the photosensitive material as the layer (1) or (2). The antihalation layer is provided in the photosensitive material as the layer (3) or (4).

The decoloring dye and the base precursor are preferably added to the same non-photosensitive layer. However, they may be also added separately to adjacent two non-photosensitive layers. If desired, a barrier layer may be provided between the two non-photosensitive layers.

As methods to add a decoloring dye to a non-photosensitive layer, a method may be employed which comprises step of adding a solution, an emulsion, a solid microparticles dispersion of the dye, or adding the dye impregnated in a polymer to a coating solution for the non-photosensitive layer. The dye may also be added to the non-photosensitive layer by using a polymer mordant. These methods for addition are the same as those generally employed for the addition of dyes to ordinary photothermographic materials. Polymer latexes used for preparation of the dye impregnated in a polymer are described in U.S. Pat. No. 4,199,363, German Patent Laid-open Nos. 25,141,274, 2,541,230, EP029104 and JP-B-53-41091. A method for emulsification by adding a dye to a solution in which a polymer is dissolved is described in International Patent Publication WO88/00723.

The amount of the decoloring dye may be determined depending on purpose of the use of the dye. In general, the dye is used in an amount to give an optical density (absorbance) of larger than 0.1 measured at an intended wavelength. The optical density is preferably 0.2 to 2. The amount of the dye to give such optical density may be generally from about 0.001 to about 1 $g/m^2$, preferably from about 0.005 to about 0.8 $g/m^2$, particularly preferably from about 0.01 to about 0.2 $g/m^2$.

Decoloring of dyes in that manner can lower optical density of the material to 0.1 or less. Two or more different decoloring dyes may be used in the thermo decoloring type recording materials or photothermographic materials. Similarly, two or more different base precursors may be used in combination.

The photothermographic material of the present invention is preferably a so-called single-sided photosensitive material comprising at least one photosensitive layer containing a silver halide emulsion on one side of support, and a back layer on the other side.

The back layers that are applicable to the photothermographic material of the present invention are described in, for example, JP-A-11-65021, paragraphs 0128 to 0130.

The photothermographic material of the present invention may preferably contain a matting agent for improving the transferability of the material. Matting agents are described in JP-A-11-65021, paragraphs 0126 to 0127. The matting agent is added in an amount of preferably 1 to 400 mg/m$^2$, more preferably 5 to 300 mg/m$^2$, as the amount per 1 m$^2$ of the photosensitive material.

While the matting degree of the surface of the emulsion layer is not particularly limited so long as the material is free from stardust defects, Beck's smoothness of the surface is preferably 30 seconds to 2000 seconds, more preferably 40 seconds to 1500 seconds. The matting degree of the back layer is preferably falls 10 seconds to 1200 seconds, more preferably 20 seconds to 800 seconds, further preferably 40 seconds to 500 seconds as shown by the Beck's smoothness.

In the present invention, the matting agent may preferably be contained in the outermost surface layer, or in a layer functioning as an outermost surface layer, or in a layer near to the outer surface of the photothermographic material. The agent may also be preferably contained in a layer functioning as a protective layer.

In the present invention, a hardening agent may be added to the photosensitive layer, the protective layer, the back layer, and other layers. As for the hardening agent, various methods are described in T. H. James, "THE THEORY OF THE PHOTOGRAPHIC PROCESS, FOURTH EDITION", Macmillan Publishing Co., Inc., 1977, pp. 77–87. Polyvalent metal ions described on page 78 of the above article, polyisocyanates described in U.S. Pat. No. 4,281,060 and JP-A-6-208193; epoxy compounds described in U.S. Pat. No. 4,791,042; vinylsulfone compounds described in JP-A-62-89048 and so forth may preferably be used.

The hardening agent is added to coating solutions for protective layers as a solution. Preferred addition time of the solution resides in a period of from 180 minutes before the coating to just before the coating, preferably 60 minutes to 10 seconds before the coating. The method and conditions for mixing are not particularly limited so long as the effect of the present invention can be obtained satisfactorily. Specific examples of the mixing method include a method in which a mixing is performed in a tank designed so as to obtain a desired average residence time which is calculated from addition flow rate and feeding amount to a coater, a method utilizing a static mixer described in N. Harnby, M. F. Edwards, A. W. Nienow, "Ekitai Kongo Gijutsu (Techniques for Mixing Liquids)", translated by Koji Takahashi, Chapter 8, Nikkan Kogyo Shinbunsha, 1989 and so forth.

Surfactants that can be used in the present invention are described in JP-A-11-65021, paragraph 0132; usable solvents are described in the above patent document in paragraph 0133; usable supports are described in the above patent document in paragraph 0134; usable antistatic and electroconductive layers are described in the above patent document in paragraph 0135; and usable methods for forming color images are described in the above patent document in paragraph 0136.

Preferably used as a transparent support is a polyester film, in particular, polyethylene terephthalate film, subjected to a heat treatment in a temperature range of 130–185° C. in order to relax the internal distortion formed in the film during the biaxial stretching so that thermal shrinkage distortion occurring during the heat development could be eliminated. When the photothermographic material is for medical use, the transparent support may be colored with blue dyes (e.g., with Dye-1 described in Examples of JP-A-8-240877), or may be colorless. For the support, techniques for undercoating described in JP-A-11-84574 (utilizing water-soluble polyester), JP-A-10-186565 (utilizing styrene/butadiene copolymer), Japanese Patent Application No. 11-106881, paragraphs 0063–0080 (utilizing vinylidene chloride copolymer) and so forth are preferably used. As for antistatic layers and undercoating, techniques disclosed in JP-A-56-143430, JP-A-56-143431, JP-A-58-62646, JP-A-56-120519, JP-A-11-84573, paragraphs 0040–0051, U.S. Pat. No. 5,575,957, JP-A-11-223898, paragraphs 0078–0084 and so forth can also be used.

The photothermographic material of the invention is preferably of a monosheet type. The monosheet type does not use any additional sheets such as image receiving materials, but can form images directly on the material itself.

The photothermographic material of the present invention may further contain an antioxidant, stabilizer, plasticizer, UV absorber or coating aid. Such various additives may be added to any of photosensitive layers or non-photosensitive layers. For these additives, International Patent Publication WO98/36322, EP803764A1, JP-A-10-186567, JP-A-10-18568 and so forth may be referred to.

The photothermographic material of the present invention preferably has a film surface pH of 6.0 or less, more preferably 5.5 or less before heat development. While the lower limit is not particularly limited, it is normally around 3. For controlling the film surface pH, an organic acid such as phthalic acid derivatives or a nonvolatile acid such as sulfuric acid, and a volatile base such as ammonia are preferably used to lower the film surface pH. In particular, ammonia is preferred to achieve a low film surface pH, because it is highly volatile and therefore it can be removed before coating or heat development. A method for measuring the film surface pH is described in Japanese Patent Application No. 11-87297, paragraph 0123.

The coating method used for the production of the photothermographic material of the present invention is not particularly limited, and any coating method can be used. Specific examples thereof include various types of coating techniques, for example, extrusion coating, slide coating, curtain coating, dip coating, knife coating, flow coating, extrusion coating utilizing a hopper of the type described in U.S. Pat. No. 2,681,294 and so forth. Preferably used are extrusion coating and slide coating described in Stephen F. Kistler, Petert M. Schweizer, "LIQUID FILM COATING", published by CHAPMAN & HALL Co., Ltd., 1997, pp. 399–536, and particularly preferably used is the slide coating. An example of the shape of slide coater used for the slide coating is shown in FIG. 11*b,* 1, on page 427 of the aforementioned reference. If desired, two or more layers may be coated simultaneously, for example, according to the methods described from page 399 to page 536 of the aforementioned reference, or the methods described in U.S. Pat. No. 2,761,791 and British Patent No. 837,095.

Other techniques that can be used for the production of the photothermographic material of the present invention are also described in EP803764A1, EP883022A1, WO98/36322, JP-A-56-62648, JP-A-58-62644, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-

10-186565, JP-A-10-186567, JP-A-10-186569, JP-A-10-186570, JP-A-10-186571, JP-A-10-186572, JP-A-10-197974, JP-A-10-197982, JP-A-10197983, JP-A-10-197985, JP-A-10-197986, JP-A-10-197987, JP-A-10-207001, JP-A-10-207004, JP-A-10-221807, JP-A-10-282601, JP-A-10-288823, JP-A-10-288824, JP-A-10-307365, JP-A-10-312083, JP-A-10-339934, JP-A-11-7100, JP-A-11-15105, JP-A-11-24200, JP-A-11-24201, JP-A-11-30832, JP-A-11-84574 and JP-A-11-65021, JP-A-11-125880, JP-A-11-129629, JP-A-11-133536, JP-A-11-133537, JP-A-11-133538, JP-A-11-133539, JP-A-11-133542and JP-A-11-133543.

The photothermographic material of the invention may be developed in any manner. Usually, an imagewise exposed photothermographic material is developed by heating. The development temperature is preferably 80° C. to 250° C., more preferably 100° C. to 140° C. The development time is preferably 1 to 180 seconds, more preferably 10 to 90 seconds, particularly preferably 10 to 40 seconds.

For thermal development for the material, preferred is a plate heater system. For heat development by the plate heater system, the method described in JP-A-11-133572 is preferred. The plate heater system described in this reference is a heat development apparatus wherein a photothermographic material on which a latent image is formed is brought into contact with heating means in a heat development section to obtain a visible image. In this apparatus, the heating means comprises a plate heater, and a plurality of presser rollers are disposed facing to one surface of the plate heater. Heat development of the photothermographic material is attained by passing the material between the presser rollers and the plate heater. The plate heater is preferably sectioned into 2 to 6 stages, and the temperature of the top stage is preferably kept lower by 1 to 10° C. or so than that of the others. Such a method is also described in JP-A-54-30032. Such a plate heater system can remove moisture and organic solvent contained in the photothermographic material out of the material, and prevent deformation of the support of the photothermographic material by rapidly heating the material.

The photothermographic material of the present invention can be exposed in any manner. As light source of exposure, laser rays are preferred. As the laser used in the present invention, gas lasers ($Ar^+$, He—Ne) , YAG lasers, dye lasers, semiconductor lasers and so forth are preferred. A combination of semiconductor laser and second harmonic generating device may also be used. Preferred are gas or semiconductor lasers for red to infrared emission.

Single mode lasers can be used for the laser rays, and the technique disclosed in JP-A-11-65021, paragraph 0140 can be used.

The laser output is preferably at least 1 mW, more preferably at least 10 mW. Even more preferred is high output of at least 40 mW. If desired, a plurality of lasers may be multiplexed. The diameter of laser ray may be in the range of 30 and 200 $\mu$m or so in terms of $1/e^2$ spot size of a Gaussian beam.

As an example of laser imager provided with a light exposure section and heat development section, Fuji Medical Dry Imager FM-DP L can be mentioned. FM-DP L is explained in Fuji Medical Review, No. 8, pages 39–55, and those techniques can of course be used in laser imagers for the photothermographic material of the present invention. Further, the photothermographic material of the present invention can be used as a photothermographic material for laser imagers in "AD network", which was proposed by Fuji Medical System as a network system that conforms to the DICOM standard.

The photothermographic material of the invention forms a monochromatic image based on silver image, and is preferably used as a photothermographic material for use in medical diagnosis, industrial photography, printing and COM. In such applications, the monochromatic images formed can of course be duplicated on duplicating films, MI-Dup, from Fuji Photo Film for medical diagnosis; and for printing, the images can be used as the mask for forming images on films for reverse images such as DO-175 and PDO-100 from Fuji Photo Film, or on offset printing plates.

EXAMPLES

The present invention will be specifically explained with reference to the following examples. The materials, regents, ratios, procedures and so forth shown in the following examples can be optionally changed so long as such change does not depart from the spirit of the present invention. Therefore, the scope of the present invention is not limited by the following examples.

Example 1

Preparation of PET Support

Using terephthalic acid and ethylene glycol, PET having an intrinsic viscosity IV of 0.66 (measured in phenol/tetrachloroethane=6/4 (weight ratio) at 25° C.) was obtained in a conventional manner. The PET was pelletized, and the pellets were dried at 130° C. for 4 hours, melted at 300° C., extruded from a T-die, and quenched to prepare an unstretched film having such a thickness that the film thickness after thermal fixation should become 175 $\mu$m.

The film was stretched along the longitudinal direction by 3.3 times using rollers having different peripheral speeds and then stretched along the transverse direction by 4.5 times using a tenter. In this case, the temperatures were 110° C. and 130° C., respectively. Thereafter, the film was subjected to thermal fixation at 240° C. for 20 seconds and relaxed by 4% along the transverse direction at the same temperature. Then, after chucks of the tenter were released, the both edges of the film were knurled, and the film was rolled up at 4 kg/cm$^2$ to provide a roll of the film having a thickness of 175 $\mu$m.

Surface Corona Discharging Treatment

Using a solid state corona discharging treatment machine Model 6KVA manufactured by Piller Inc., both surfaces of the support were treated at room temperature at 20 m/minute. In this case, from the read out values of the electric current and voltage, it was seen that the treatment of 0.375 kV.A.minute/m$^2$ was applied to the support. The treated frequency in this case was 9.6 kHz and the gap clearance between the electrode and the dielectric roll was 1.6 mm.

Preparation of Undercoated Support

| Formulation (1) (fro undercoat layer on photosensitive layer side) | |
|---|---|
| Pesresin A-515GB made by Takamatsu Yushi K.K. (30 weight % solution) | 234 g |
| Polyethylene glycol monononylphenyl ether (mean ethylene oxide number = 8.5,) 10 weight % solution) | 21.5 g |

-continued

| | |
|---|---|
| MP-1000 made by Soken Kagaku K.K. (polymer microparticles, mean particle size: 0.4 μm) | 0.91 g |
| Distilled water | 744 ml |
| Formulation (2) (for 1st layer on back surface | |
| Butadiene-styrene copolymer latex (solid content: 40 weight %, weight ratio of butadiene/styrene = 32/68) | 158 g |
| 2,4-Dichloro-6-hydroxy-S-triazine sodium salt (8 weight % aqueous solution) | 20 g |
| 1 weight % Aqueous solution of sodium laurylbenzenesulfonate | 10 ml |
| Distilled water | 854 ml |
| Formulatiom (3) (for 2nd layer on back surface side) | |
| $SnO_2$/SbO (weight ratio: 9/1, mean particle size: 0.038 μm, 17 weight % dispersion) | 84 g |
| Gelatin (10% aqueous solution) | 89.2 g |
| Metorose TC-5 made by Shin-Etsu Chemical Co., Ltd. (2% aqueous solution) | 8.6 g |
| MP-1000 (polymer microparticles) made by Soken Kagaku K.K. | 0.01 g |
| 1 weight % Aqueous solution of sodium dodecylbenzenesulfonate | 10 ml |
| NaOH (1%) | 6 ml |
| Proxel (made by ICI Co.) 1 | ml |
| Distilled water | 805 ml |

Preparation of Undercoated Support

After applying the aforementioned corona discharging treatment to both surfaces of the aforementioned biaxially stretched polyethylene terephthalate support having a thickness of 175 μm, one surface (photosensitive layer side) thereof was coated with the undercoating solution of Formulation (1) by a wire bar in a wet coating amount of 6.6 ml/m$^2$ (per one surface) and dried at 180° C. for 5 minutes. Then, the back surface thereof was coated with the undercoating solution of Formulation (2) by a wire bar in a wet coating amount of 5.7 ml/m$^2$ and dried at 180° C. for 5 minutes. The back surface thus coated was further coated with the undercoating solution of Formulation (3) by a wire bar in a wet coating amount of 7.7 ml/m$^2$ and dried at 180° C. for 6 minutes to prepare an undercoated support.

Preparation of Coating Solution for Back Surface

Preparation of Solid Microparticle Dispersion (a) of Base Precursor 64 g of Base precursor compound 11, 28 g of diphenylsulfone and 10 g of a surface active agent, Demor N (manufactured by Kao Corporation), were mixed with 220 ml of distilled water, and the mixture was beads-dispersed using a sand mill (¼ Gallon Sand Grinder Mill, manufactured by Imex Co.) to obtain Solid microparticle dispersion (a) of the base precursor compound having a mean particle size of 0.2 μm.

Preparation of Dye Solid Microparticle Dispersion 9.6 g of Cyanine dye compound 13 and 5.8 g of sodium p-dodecylbenzenesulfonate were mixed with 305 ml of distilled water, and the mixture was beads-dispersed using a sand mill (¼ Gallon Sand Grinder Mill, manufactured by Imex Co.) to obtain a dye solid microparticle dispersion having a mean particle size of 0.2 μm.

Preparation of Coating Solution for Antihalation Layer 17 g of gelatin, 9.6 g of polyacrylamide, 70 g of the aforementioned Solid microparticle dispersion (a) of the base precursor, 56 g of the aforementioned dye solid microparticle dispersion, 1.5 g of polymethyl methacrylate microparticles (mean particle size 6.5 μm), 0.03 g of benzoisothiazolinone, 2.2 g of sodium polyethylenesulfonate, 0.2 g of Blue dye compound 14 and 844 ml of water were mixed to prepare a coating solution for antihalation layer.

Preparation of Coating Solution for Back Surface Protective Layer

In a container kept at 40° C., 50 g of gelatin, 0.2 g of sodium polystyrenesulfonate, 2.4 g of N,N-ethylenebis (vinylsulfonacetamide), 1 g of sodium tert-octylphenoxyethoxyethanesulfonate, 30 mg of benzoisothiazolinone, 37 mg of N-perfluorooctylsulfonyl-N-propylalanine potassium salt, 0.15 g of polyethylene glycol mono(N-perfluorooctylsulfonyl-N-propyl-2-aminoethyl) ether [average polymerization degree of ethylene oxide: 15], 32 mg of $C_8F_{17}SO_3K$, 64 mg of $C_8F_{17}SO_2N(C_3H_7)(CH_2CH_2O)_4(CH_2)_4SO_3Na$, 8.8 g of an acrylic acid/ethyl acrylate copolymer (copolymerization ratio (by weight): 5/95), 0.6 g of Aerosol TO (manufactured by American Cyanamid Company), 1.8 g (as liquid paraffin) of a liquid paraffin emulsion and 950 ml of water were mixed to form a coating solution for back surface protective layer.

Preparation of Silver Halide Emulsion 1

1421 ml of distilled water was added with 3.1 ml of 1 weight % potassium bromide solution, and further added with 3.5 ml of 0.5 mol/L sulfuric acid and 31.7 g of phthalized gelatin. Separately, Solution A was prepared by adding distilled water to 22.22 g of silver nitrate to dilute it to 95.4 ml, and Solution B was prepared by diluting 26.3 g of potassium bromide with distilled water to a volume of 161 ml. To the aforementioned mixture maintained at 34° C. and stirred in a titanium-coated stainless steel reaction vessel, the whole volume of Solution A and Solution B was added over 45 seconds at a constant flow rate while. Then, the mixture was added with 10 ml of 3.5 weight % aqueous hydrogen peroxide solution, and further added with 10.8 ml of a 10 weight % aqueous solution of benzimidazole. Separately, Solution C was prepared by adding distilled water to 51.86 g of silver nitrate to dilute it to 317.5 ml, and Solution D was prepared by diluting 45.8 g of potassium bromide with distilled water to a volume of 400 ml. The whole volume of Solution C was added to the mixture over 20 minutes at a constant flow rate. Solution D was added by the control double jet method while pAg was maintained at 8.1. Hexachloroiridic acid (III) potassium salt in an amount of $1\times10^{-4}$ mole per mole of silver was added at one time 10 minutes after the addition of Solutions C and D was started. Further, an aqueous solution of potassium iron (II) hexacyanide in an amount of $3\times10^{-4}$ mole per mole of silver was added at one time 5 seconds after the addition of Solution C was completed. Then, the mixture was adjusted to pH 3.8 using 0.5 mol/L sulfuric acid, and the stirring was stopped. Then, the mixture was subjected to precipitation, desalting and washing with water, adjusted to pH 5.9 with 1 mol/L sodium hydroxide to form a silver halide dispersion having pAg of 8.0.

The aforementioned silver halide dispersion was added with 5 ml of a 0.34 weight % methanol solution of 1,2-benzisothiazolin-3-one with stirring at 38° C., and after 40 minutes since then, added with a methanol solution of Spectral sensitizing dye A in an amount of $1\times10^{-3}$ mole per mole of silver. After 1 minutes, the mixture was warmed to 47° C., and 20 minutes after the warming, added with $7.6\times10^{-5}$ mole of sodium benzenethiosulfonate per mole of silver as a methanol solution. Further after 5 minutes, the mixture was added with Tellurium sensitizer B as a methanol solution in an amount of $1.9\times10^{-4}$ mole per mole of silver followed by ripening for 91 minutes. The mixture was added with 1.3 ml of a 0.8 weight % methanol solution of N,N'-dihydroxy-N"-di-ethylmelamine, and 4 minutes later, added with 5-methyl-2-mercaptobenzimidazole in an amount of $3.7\times10^{-3}$ mole per mole of silver and 1-phenyl-2-heptyl-5-mercapto-1,3,4-triazole as a methanol solution in an amount of $4.9\times10^{-3}$ mole per mole of silver to prepare Silver halide emulsion 1.

The grains in the prepared silver halide emulsion were pure silver bromide grains having a mean diameter as spheres of 0.046 μm and a variation coefficient of 20% for mean diameter as spheres. The grain size and others were obtained from averages for 1000 grains by using an electron microscope. The [100] face ratio of these grains was determined to be 80% by the Kubelka-Munk method.

Preparation of Silver Halide Emulsion 2

In the same manner as the preparation of Silver halide emulsion 1 except that the liquid temperature during the formation of the grains was changed from 34° C. to 49° C., addition time of Solution C was changed to 30 minutes and potassium iron (II) hexacyanide was not used, Silver halide emulsion 2 was prepared. Further, as in the case of Silver halide emulsion 1, the steps of precipitation, desalting, washing with water and dispersion were performed. Furthermore, in the same manner as in the case of Silver halide emulsion 1 except that the addition amount of Spectral sensitizing dye A was changed to $7.5\times10^{-4}$ mole per mole of silver, the addition amount of Tellurium sensitizer B was changed to $1.1\times10^{-4}$ mole per mole of silver and the addition amount of 1-phenyl-2-heptyl-5-mercapto-1,3,4-triazole was changed to $3.3\times10^{-3}$ mole of per mole of silver, spectral sensitization, chemical sensitization, and addition of 5-methyl-2-mercaptobenzimidazole and 1-phenyl-2-heptyl-5-mercapto-1,3,4-traizole were performed to obtain Silver halide emulsion 2. Emulsion grains of Silver halide emulsion 2 were pure silver bromide cubic grains having a mean grain size of 0.080 μm as spheres and a variation coefficient of 20% for diameter as spheres.

Preparation of Silver Halide Emulsion 3

In the same manner as the preparation of Silver halide emulsion 1 except that the liquid temperature during the formation of the grains was changed from 34° C. to 27° C., Silver halide emulsion 3 was prepared. Further, as in the case of Silver halide emulsion 1, the steps of precipitation, desalting, washing with water and dispersion were performed. Furthermore, in the same manner as in the case of Silver halide emulsion 1 except that the addition amount of the solid dispersion of Spectral sensitizing dye A (gelatin aqueous solution) was changed to $6\times10^{-3}$ mole per mole of silver and the addition amount of Tellurium sensitizer B was changed to $5.2\times10^{-4}$ mole per mole of silver, Silver halide emulsion 3 was obtained. Emulsion grains of Silver halide emulsion 3 were pure silver bromide cubic grains having a mean grain size of 0.038 μm as spheres and a variation coefficient of 20% for diameter as spheres.

Preparation of Mixed Emulsion A for Coating Solution

70% by weight of Silver halide emulsion 1, 15% by weight of Silver halide emulsion 2 and 15% by weight of Silver halide emulsion 3 were mixed and added with benzothiazolium iodide in an amount of $7\times10^{-3}$ mole per mole of silver as a 1 weight % aqueous solution to form Mixed emulsion A for coating solution.

Preparation of Scaly Fatty Acid Silver Salt 87.6 kg of behenic acid (Edenor C22-85R, trade name, manufactured by Henkel Co.), 423 L of distilled water, 49.2 L of a 5 mol/L aqueous solution of NaOH, and 120 L of tert-butanol were mixed and allowed to react with stirring at 75° C. for one hour to obtain a solution of sodium behenate. Separately, 206.2 L of an aqueous solution containing 40.4 kg of silver nitrate (pH 4.0) was prepared and kept at 10° C. A mixture of 635 L of distilled water and 30 L of tert-butanol contained in a reaction vessel kept at 30° C. was added with the whole amount of the aforementioned sodium behenate solution and the whole amount of the aqueous silver nitrate solution at constant flow rates over the periods of 62 minutes and 10 seconds, and 60 minutes, respectively. In this case, they were added in such a manner that only the aqueous silver nitrate solution was added for 7 minutes and 20 seconds after starting the addition of the aqueous silver nitrate solution. Then, the addition of the sodium behenate solution was started so that only the sodium behenate solution could be added for 9 minutes and 30 seconds after finishing the addition of the aqueous silver nitrate solution. In this operation, the outside temperature was controlled so that the temperature in the reaction vessel could be 30° C. and the liquid temperature should be constant. The piping of the addition system for the sodium behenate solution was warmed by steam trace and the steam opening was controlled such that the liquid temperature at the outlet orifice of the addition nozzle should be 75° C. The piping of the addition system for the aqueous silver nitrate solution was maintained by circulating cold water outside a double pipe. The addition position of the sodium behenate solution and the addition position of the aqueous silver nitrate solution were arranged symmetrically with respect to the stirring axis as the center, and the positions are controlled to be at heights for not contacting with the reaction mixture.

After finishing the addition of the sodium behenate solution, the mixture was left with stirring for 20 minutes at the same temperature and then the temperature was decreased to 25° C. Thereafter, the solid content was recovered by suction filtration and washed with water until electric conductivity of the filtrate became 30 μS/cm. Thus, a silver salt of an aliphatic acid was obtained. The solid content was stored as a wet cake without being dried.

When the shape of the obtained silver behenate grains was evaluated by an electron microscopic photography, the grains were scaly crystals having a=0.14 μm, b=0.4 μm, and c=0.6 μm in mean values, a mean aspect ratio of 5.2, a mean diameter as spheres of 0.52 μm, and a variation coefficient of 15% for mean diameter as spheres (a, b and c have the meanings defined in the present specification).

To the wet cake corresponding to 100 g of the dry solid content was added with 7.4 g of polyvinyl alcohol (PVA-217, trade name) and water to make the total amount 385 g, and the mixture was pre-dispersed by a homomixer.

Then, the pre-dispersed stock dispersion was treated three times by using a dispersing machine (Microfluidizer-M-110S-EH; trade name, manufactured by Microfluidex International Corporation, using G10Z interaction chamber) with a pressure controlled to be 1750 kg/cm$^2$ to obtain a silver behenate dispersion. During the cooling operation, a dispersion temperature of 18° C. was achieved by providing coiled heat exchangers fixed before and after the interaction chamber and controlling the temperature of the refrigerant.

Preparation of 25 Weight % Dispersion of Reducing Agent 10 kg of 1,1-bis(2-hydroxy-3,5-dimethylphenyl)-3,5,5-trimethylhexane (Reducing agent C-1) and 10 kg of a 20 weight % aqueous solution of denatured polyvinyl alcohol (Poval MP203, manufactured by Kuraray Co. Ltd.) were added with 16 kg of water, and mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 3 hours and 30 minutes. Then, the slurry was added with 0.2 g of benzothiazolinone sodium salt and water so that the concentration of the reducing agent could become 25% by weight to obtain a reducing agent dispersion. The reducing agent particles contained in the reducing agent dispersion obtained as described above had a median diameter of 0.38 μm and the maximum particle size of 1.8 μm or shorter. The obtained reducing agent dispersion was filtered through a polypropylene filter having a pore size of 10.0 μm to remove dusts and so forth, and stored.

Preparation of 10 Weight % Dispersion of Mercapto Compound 5 kg of 1-phenyl-2-heptyl-5-mercapto-1,3,4-triazole and 5 kg of a 20 weight % aqueous solution of denatured polyvinyl alcohol (Poval MP203, manufactured by Kuraray Co., Ltd.) were added with 8.3 kg of water, and mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 6 hours. Then, the slurry was added with water so that the concentration of the mercapto compound could become 10 weight % to obtain a mercapto compound dispersion. The mercapto compound particles contained in the mercapto compound dispersion obtained as described above had a median diameter of 0.40 μm and the maximum particle size of 2.0 μm or less. The obtained mercapto compound dispersion was filtered through a polypropylene filter having a pore size of 10.0 μm to remove dusts and so forth, and stored. The dispersion was filtered through a polypropylene filter having a pore size of 10.0 μm immediately before use.

Preparation of 20 Weight % Dispersion of Organic Polyhalogenated Compound 1

5 kg of tribromomethylnaphthylsulfone, 2.5 kg of a 20 weight % aqueous solution of denatured polyvinyl alcohol (Poval MP203, manufactured by Kuraray Co., Ltd.) and 213 g of 20 weight % aqueous solution of sodium triisopropylnaphthalenesulfonate were added with 10 kg of water, and mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 5 hours. Then, the slurry was added with 0.2 g of benzisothiazolinone sodium salt and water so that the concentration of the organic polyhalogenated compound could become 20 weight % to obtain an organic polyhalogenated compound dispersion. The organic polyhalogenated compound particles contained in the polyhalogenated compound dispersion obtained as described above had a median diameter of 0.39 μm and the maximum particle size of 2.0 μm or less. The obtained organic polyhalogenated compound dispersion was filtered through a polypropylene filter having a pore size of 3.0 μm to remove dusts and so forth, and stored.

Preparation of 20 Weight % Dispersion of Organic Polyhalogenated Compound 2

A dispersion was prepared in the same manner as the preparation of the 20 weight % dispersion of organic polyhalogenated compound 1 except that 5 kg of tribromomethyl (3-N-butylcarbamoylphenyl)sulfone was used instead of 5 kg of tribromomethylnaphthylsulfone, diluted so that the concentration of the organic polyhalogenated compound could become 20 weight %, and filtered. The organic polyhalogenated compound particles contained in the organic polyhalogenated compound dispersion obtained as described above had a median diameter of 0.38 μm and the maximum particle size of 2.0 μm or less. The obtained organic polyhalogenated compound dispersion was filtered through a polypropylene filter having a pore size of 3.0 μm to remove dusts and so forth, and stored.

Preparation of 25 Weight % Dispersion of Organic Polyhalogenated Compound 3

A dispersion was prepared in the same manner as the preparation of the 20 weight % dispersion of organic polyhalogenated compound 1 except that 5 kg of tribromomethylphenylsulfone was used instead of 5 kg of tribromomethylnaphthylsulfone and the amount of the 20 weight % aqueous solution of MP203 was changed to 5 kg, diluted so that the concentration of the organic polyhalogenated compound could become 25 weight %, and filtered. The organic polyhalogenated compound particles contained in the organic polyhalogenated compound dispersion obtained as described above had a median diameter of 0.40 μm and the maximum particle size of 2.0 μm or less. The obtained organic polyhalogenated compound dispersion was filtered through a polypropylene filter having a pore size of 3.0 μm to remove dusts and so forth, and stored. The dispersion was stored at 10° C. or less until use.

Preparation of 5 Weight % Solution of Phthalazine Compound 8 kg of denatured polyvinyl alcohol (MP-203, manufactured by Kuraray Co., Ltd.) was dissolved in 174.57 kg of water and then added with 3.15 kg of 20 weight % aqueous solution of sodium triisopropylnaphthalenesulfonate and 14.28 kg of 70 weight % aqueous solution of 6-isopropylphthalazine to obtain a 5 weight % solution of 6-isopropylphthalazine.

Preparation of 20 Weight % Dispersion of Pigment 64 g of C.I. Pigment Blue 60 and 6.4 g of Demor N manufactured by Kao Corporation were added with 250 g of water and mixed sufficiently to provide slurry. Then, 800 g of zirconia beads having a mean diameter of 0.5 mm were placed in a vessel together with the slurry and the slurry was dispersed by a dispersing machine (¼G Sand Grinder Mill; manufactured by Imex Co.) for 25 hours to obtain a pigment dispersion. The pigment particles contained in the pigment dispersion obtained as described above had a mean particle size of 0.21 μm.

Preparation of 40 Weight % SBR Latex

SBR latex purified by ultrafiltration (UF) was obtained as follows.

The SBR latex mentioned below diluted by 10 times with distilled water was diluted and purified by using an UF-purification module FS03-FC-FUYO3A1 (manufactured by Daisen Membrane System K. K.) until the ion conductivity became 1.5 mS/cm, and added with Sandet-BL (manufactured by SANYO CHEMICAL INDUSTRIES, LTD.) to a concentration of 0.22 weight %. Further, the latex was added with NaOH and $NH_4OH$ so that the ratio of $Na^+$ ion:$NH_4^+$ ion could become 1:2.3 (molar ratio) to adjust pH to 8.4. At this point, the concentration of the latex was 40% by weight.

(SBR latex: a latex of -St(68)-Bu(29)-AA(3)-, wherein the numerals in the parentheses indicate the contents in terms of % by weight, St represents styrene, Bu represents butadiene and AA represents acrylic acid)

The latex had the following characteristics: mean particle size of 0.1 μm, concentration of 45%, equilibrated moisture content of 0.6 weight % at 25° C. and relative humidity 60%, and ion conductivity of 4.2 mS/cm (measured for the latex stock solution (40%) at 25° C. by using a conductometer, CM-30S, manufactured by Toa Electronics, Ltd.), pH 8.2.

Preparation of Coating Solution for Emulsion Layer (photosensitive layer)

1.1 g of the 20 weight % aqueous dispersion of the pigment obtained above, 103 g of the organic acid silver salt dispersion, 5 g of the 20 weight % aqueous solution of polyvinyl alcohol, PVA-205 (manufactured by Kuraray Co., Ltd.), 25 g of the 25 weight % dispersion of the reducing agent, 12.6 g in total of the dispersions of organic polyhalogenated compounds 1 to 3 (weight ratio=1:6:3), 6.2 g of the 10 weight % dispersion of mercapto compound, 106 g of the 40 weight % SBR latex purified by ultrafiltration (UF) and undergone pH adjustment, and 18 ml of the 5 weight % solution of the phthalazine compound were combined, added with 10 g of Silver halide mixed emulsion A, and mixed sufficiently to prepare a coating solution for emulsion layer. The coating solution was fed as it was to a coating die in such a feeding amount giving a coating amount of 70 ml/$m^2$ and coated.

The viscosity of the coating solution for emulsion layer described above was measured by a B-type viscometer manufactured by Tokyo Keiki K. K. and found to be 85 [mPa.s] at 40° C. (Rotor No. 1, 60 rpm).

The viscosity of the coating solution was measured at 25° C. by an RFS fluid spectrometer produced by Rheometric Far East Co., Ltd., and found to be 1500, 220, 70, 40 and 20 [mPa.s] at shear rates of 0.1, 1, 10, 100 and 1000 [1/second], respectively.

Preparation of Coating Solution for Intermediate Layer on the Emulsion Layer Surface 772 g of an aqueous solution of 10% by weight polyvinyl alcohol, PVA-205 (manufactured by Kuraray Co., Ltd.), 5.3 g of the 20 weight % dispersion of the pigment, and 226 g of 27.5 weight % latex of methyl methacrylate/styrene/butyl acrylate/hydroxyethyl methacrylate/acrylic acid copolymer (copolymerization ratio (by weight) : 64/9/20/5/2) were added with 2 ml of a 5 weight % aqueous solution of Aerosol TO (manufactured by American Cyanamid Company), 10.5 ml of a 20 weight % aqueous solution of phthalic acid diammonium salt and water in such an amount giving a total amount of 880 g to form a coating solution for intermediate layer. This coating solution was fed to a coating die in such an amount that gave a coating amount of 10 ml/$m^2$.

The viscosity of the coating solution measured by a B-type viscometer at 40° C. (Rotor No. 1, 60 rpm) was 21 [mPa.s].

Preparation of Coating Solution for 1st Protective Layer on Emulsion Layer Surface 64 g of inert gelatin was dissolved in water, added with 80 g of a 27.5 weight % latex solution of methyl methacrylate/styrene/butyl acrylate/hydroxyethyl methacrylate/acrylic acid copolymer (copolymerization ratio (by weight): 64/9/20/5/2), 23 ml of a 10 weight % methanol solution of phthalic acid, 23 ml of a 10 weight % aqueous solution of 4-methylphthalic acid, 28 ml of 1 N sulfuric acid, 5 ml of a 5 weight % aqueous solution of Aerosol TO (manufactured by American Cyanamid Company), 0.5 g of phenoxyethanol, 0.1 g of benzoisothiazolinone, and water in such an amount that gave a total amount of 750 g to form a coating solution. The coating solution was mixed with 26 ml of 4 weight % chromium alum by a static mixer immediately before coating, and fed to a coating die in such an amount that gave a coating amount of 18.6 ml/$m^2$.

The viscosity of the coating solution measured by a B-type viscometer (Rotor No. 1, 60 rpm) at 40° C. was 17 [mPa.s].

Preparation of Coating Solution for 2nd Protective Layer on Emulsion Layer Surface 80 g of inert gelatin was dissolved in water, added with 102 g of a 27.5 weight % latex solution of methyl methacrylate/styrene/butyl acrylate/hydroxyethyl methacrylate/acrylic acid copolymer (copolymerization ratio (by weight): 64/9/20/5/2), 3.2 ml of a 5 weight % solution of N-perfluoro-octylsulfonyl-N-propylalanine potassium salt, 32 ml of a 2 weight % aqueous solution of polyethylene glycol mono(N-perfluorooctylsulfonyl-N-propyl-2-aminoethyl) ether [average polymerization degree of ethylene oxide=15], 23 ml of a 5 weight % aqueous solution of Aerosol TO (manufactured by American Cyanamid Company), 4 g of polymethyl methacrylate microparticles (mean particle size: 0.7 μm), 21 g of polymethyl methacrylate microparticles (mean particle size: 6.4 μm), 1.6 g of 4-methylphthalic acid, 4.8 g of phthalic acid, 44 ml of 1 N sulfuric acid, 10 mg of benzoisothiazolinone and water in such an amount that gave a total amount of 650 g. The mixture was further mixed with 445 ml of an aqueous solution containing 4 weight % chromium alum and 0.67 weight % of phthalic acid by a static mixer immediately before coating to form a coating solution for surface protective layer, which was fed to a coating die in such an amount that gave a coating amount of 8.3 ml/$m^2$.

The viscosity of the coating solution measured by a B-type viscometer (Rotor No. 1, 60 rpm) at 40° C. was 9 [mPa.s].

Preparation of Photothermographic Material

On the back side of the aforementioned support having an undercoat layer, the coating solution for antihalation layer and the coating solution for back surface protective layer were simultaneously applied as stacked layers so that the applied solid content amount of the solid microparticle dye in the antihalation layer could be 0.04 g/$m^2$, and the applied amount of gelatin in the protective layer should be 1.7 g/$m^2$, and dried to form an antihalation back layer.

Then, on the side opposite to the back side, an emulsion layer (coated silver amount of the silver halide was 0.14 g/$m^2$), intermediate layer, first protective layer, and second protective layer were simultaneously applied in this order from the undercoat layer by the slide bead application method as stacked layers to form a sample of photothermographic material.

The coating was performed at a speed of 160 m/min. The gap between the tip of coating die and the support was set to be 0.14 to 0.28 mm, and the coated width was controlled so that it could spread by 0.5 mm each at both sides compared with the projecting slit width of the coating solution. The pressure in the reduced pressure chamber was adjusted to be lower than the atmospheric pressure by 392 Pa. In this case, handling, temperature and humidity were controlled so that the support was not be electrostatically charged, and electrostatic charge was further eliminated by ionized wind immediately before the coating. In the subsequent chilling zone, the material was blown with air showing a dry-bulb temperature of 18° C. and a wet-bulb temperature of 12° C. for 30 seconds to cool the coating solutions. Then, in the floating type drying zone in a coiled shape, the material was blown with drying air showing a dry-bulb temperature of 30° C. and a wet-bulb temperature of 18° C. for 200 seconds. Subsequently, the material was passed through a drying zone of 70° C. for 20 seconds, and then another drying zone of 90° C. for 10 seconds, and cooled to 25° C. to evaporate the solvent in the coating solutions. The average wind velocity of the wind applied to the coated layer surface in the chilling zone and the drying zones was 7 m/sec.

The prepared photothermographic material showed matting degrees of 550 seconds for the photosensitive layer side, and 130 seconds for the back surface, in terms of Beck's smoothness.

Spectral sensitizing dye A

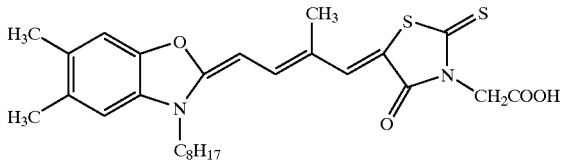

Tellurium sensitizer B

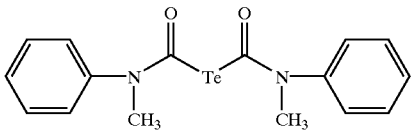

Base precursor compound 11

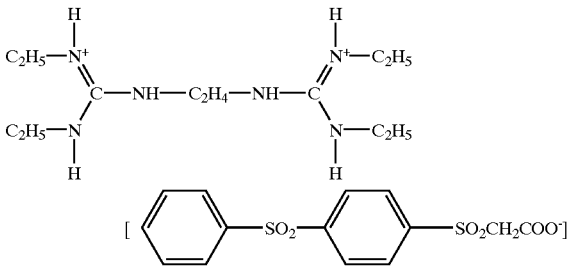

-continued

Cyanine dye compound 13

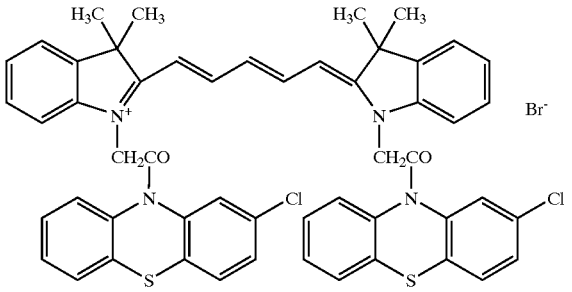

Blue dye compound 14

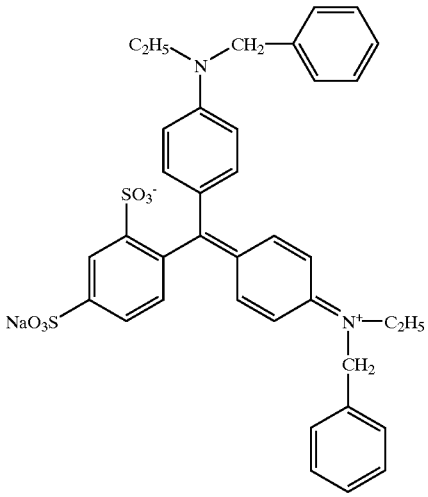

Comparative Sample 1 was prepared as described above, and Samples 2–45 were prepared in the exactly same manner as that for Sample 1 except that the type and coated amount of the reducing agent were changed to those mentioned in Table 1. In Samples 31–45, two kinds of reducing agents shown in Table 1 were used in combination in a molar ratio of 1/1, and the total coated amounts of the reducing agents are shown in Table 1.

Structures of the comparative compounds (Reducing agents C1 and C2) are as follows.

C1

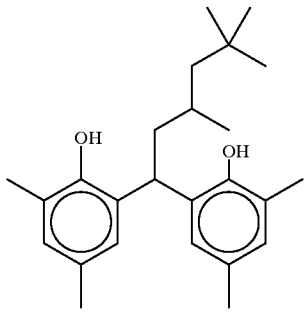

-continued

C2

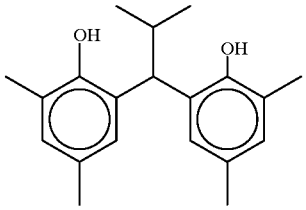

Evaluation of Photographic Performance

Each of the produced photothermographic materials was light-exposed and heat-developed (at about 120° C.) by using Fuji Medical Dry Laser Imager FM-DP L (equipped with a semiconductor laser of 660 nm and a maximum output of 60 mW (IIIB)), and the obtained image was evaluated by a densitometer.

Further, as for evaluation of silver color tone after the development, a thorax X-ray image and head CT image were printed, and the color tone was evaluated by visual inspection using an X-ray illuminator. For this evaluation, an image was formed as a standard by using LI-FM produced by Fuji Photo Film Co., Ltd., and relative color tone with respect to this image was evaluated. The aforementioned material is a photosensitive material for laser imager utilizing a non-dry type development, and it is accepted in the market as a material providing desirable color tone. In Table 1, ◎ means the most preferred color tone substantially the same as that of the standard sample, ○ means preferred color tone very near to the standard sample, Δ means acceptable color tone that is slightly different from that of the standard sample, and × means unfavorable color tone clearly different from that of the standard sample. In the cases where the color tone was different from that of the standard sample, the tendency of color shift is shown in the parentheses. For example, the evaluation of Comparative Sample 1 is shown as "× (blue) ", which means that the color tone clearly and unfavorably became bluish.

As for the evaluation of color tone change, the thorax X-ray images obtained as described above were illuminated with white light of luminescent lamp of 2000 Luxes for two days under conditions of 30° C. and 80% of relative humidity. Then, the images were each compared with the same samples stored with cooling, and degree of change was evaluated by visual inspection. In Table1, ◎ means superior result with particularly small change, ○ means good result with small change, Δ means acceptable result in spite of change, and × means unfavorable result with significant change. The results as for the above evaluation are shown in Table 1.

TABLE 1

| | Type of reducing agent | Coated amount (mmol/m$^2$) | Dmin | Dmax | Color tone | Color tone change | Note |
|---|---|---|---|---|---|---|---|
| 1 | C1 | 3.8 | 0.175 | 3.62 | X (Blue) | X | Comparative |
| 2 | C1 | 3.4 | 0.171 | 3.27 | X (Blue) | X | Comparative |
| 3 | C1 | 2.9 | 0.166 | 2.89 | X (Blue) | X | Comparative |
| 4 | C1 | 2.7 | 0.163 | 2.63 | Δ (Blue) | X | Comparative |
| 5 | C1 | 2.4 | 0.162 | 2.28 | Δ (Blue) | Δ | Comparative |
| 6 | C2 | 3.8 | 0.188 | 3.64 | X (Blue) | X | Comparative |
| 7 | C2 | 3.4 | 0.180 | 3.45 | X (Blue) | X | Comparative |
| 8 | C2 | 2.9 | 0.174 | 3.12 | X (Blue) | X | Comparative |
| 9 | C2 | 2.7 | 0.169 | 2.87 | X (Blue) | X | Comparative |
| 10 | C2 | 2.4 | 0.165 | 2.44 | X (Blue) | X | Comparative |
| 11 | 1 | 3.8 | 0.196 | 3.46 | X (Yellow) | X | Comparative |
| 12 | 1 | 3.4 | 0.181 | 3.55 | Δ (Yellow) | Δ | Invention |
| 13 | 1 | 2.9 | 0.175 | 3.68 | Δ (Yellow) | Δ | Invention |
| 14 | 1 | 2.7 | 0.170 | 3.72 | Δ (Yellow) | Δ | Invention |
| 15 | 1 | 2.4 | 0.168 | 3.58 | Δ (Yellow) | Δ | Invention |
| 21 | 16 | 3.8 | 0.193 | 3.46 | X (Yellow) | Δ | Comparative |
| 22 | 16 | 3.4 | 0.176 | 3.68 | Δ (Yellow) | ○ | Invention |
| 23 | 16 | 2.9 | 0.170 | 3.75 | ○ | ○ | Invention (preferred embodiment) |
| 24 | 16 | 2.7 | 0.166 | 3.69 | ○ | ◎ | Invention (preferred embodiment) |
| 25 | 16 | 2.4 | 0.164 | 3.63 | ◎ | ◎ | Invention (preferred embodiment) |
| 16 | 4 | 3.8 | 0.185 | 3.57 | X (Yellow) | Δ | Comparative |
| 17 | 4 | 3.4 | 0.176 | 3.65 | Δ (Yellow) | ○ | Invention |
| 18 | 4 | 2.9 | 0.168 | 3.71 | ○ | ◎ | Invention (preferred embodiment) |
| 19 | 4 | 2.7 | 0.166 | 3.62 | ○ | ◎ | Invention (preferred embodiment) |
| 20 | 4 | 2.4 | 0.163 | 3.55 | ◎ | ◎ | Invention (preferred embodiment) |
| 26 | 2 | 3.8 | 0.188 | 3.51 | X (Yellow) | Δ | Comparative |
| 27 | 2 | 3.4 | 0.177 | 3.60 | Δ (Yellow) | ○ | Invention |
| 28 | 2 | 2.9 | 0.170 | 3.68 | ○ | ◎ | Invention (preferred embodiment) |
| 29 | 2 | 2.7 | 0.167 | 3.66 | ◎ | ◎ | Invention (preferred embodiment) |
| 30 | 2 | 2.4 | 0.165 | 3.56 | ◎ | ◎ | Invention (preferred embodiment) |
| 31 | C1/1 | 3.8 | 0.191 | 3.51 | Δ (Yellow) | X | Comparative |
| 32 | C1/1 | 3.4 | 0.178 | 3.57 | ○ | Δ | Invention |
| 33 | C1/1 | 2.9 | 0.172 | 3.64 | ○ | ○ | Invention (preferred embodiment) |
| 34 | C1/1 | 2.7 | 0.168 | 3.61 | ○ | ○ | Invention (preferred embodiment) |
| 35 | C1/1 | 2.4 | 0.166 | 3.55 | ○ | ○ | Invention (preferred embodiment) |
| 36 | C1/4 | 3.8 | 0.182 | 3.54 | Δ (Blue) | X | Comparative |
| 37 | C1/4 | 3.4 | 0.173 | 3.67 | ○ | Δ | Invention |
| 38 | C1/4 | 2.9 | 0.167 | 3.72 | ◎ | ○ | Invention (preferred embodiment) |
| 39 | C1/4 | 2.7 | 0.165 | 3.58 | ◎ | ○ | Invention (preferred embodiment) |
| 40 | C1/4 | 2.4 | 0.164 | 3.51 | ◎ | ○ | Invention (preferred embodiment) |
| 41 | 4/16 | 3.8 | 0.189 | 3.43 | X (Yellow) | ○ | Comparative |

TABLE 1-continued

| | Type of reducing agent | Coated amount (mmol/m$^2$) | Dmin | Dmax | Color tone | Color tone change | Note |
|---|---|---|---|---|---|---|---|
| 42 | 4/16 | 3.4 | 0.176 | 3.58 | Δ (Yellow) | ◎ | Invention |
| 43 | 4/16 | 2.9 | 0.169 | 3.69 | ○ | ◎ | Invention (preferred embodiment) |
| 44 | 4/16 | 2.7 | 0.166 | 3.75 | ◎ | ◎ | Invention (preferred embodiment) |
| 45 | 4/16 | 2.4 | 0.164 | 3.68 | ◎ | ◎ | Invention (preferred embodiment) |

As clearly seen from the results shown in Table 1, in Samples 1–5 utilizing the comparative Reducing agent C-1, the color tone significantly became bluish, and thus unfavorable. Although the color tone change could be slightly improved by decreasing the amount of the reducing agent, the image density markedly reduced and thus the materials could no longer be used for practical use. Further, it was also found that Samples 6–10 utilizing the comparative Reducing agent C-2 were also unfavorable.

On the other hand, it can be seen that, in the samples utilizing the reducing agents represented by the general formula (I), while the color tone became bluish (yellowish for some samples) if the amount of the reducing agents exceeded 3.5 mmol/m$^2$, the color tone could be improved by decreasing the reducing agents. Further, the color tone change favorably became small. Moreover, the reduction of image density was small even if the reducing agents were decreased, and thus it is clear that the color tone and the color tone change can be improved while securing practical image density.

Furthermore, it can also be seen that more superior performance can be obtained by decreasing the amount of the reducing agent to 3.0 mmol/m$^2$ or less.

Example 2

Samples were prepared in the same manner as that in Example 1 except that the binder of Example 1 was changed to each of the binders having the following Tg's, and evaluated.

1) Tg=−10° C.

2) Tg=5° C.

3) Tg=40° C.

4) 1/1 Blend of binders having Tg=20° C. and Tg=80° C.

5) Tg=70° C.

As a result, when the binder of 1) was used, substantially the same results as in Example 1 were obtained except that the color tone change slightly became significant. It was also revealed that, when the binder of 2), 3) or 4) was used, superior silver color tone and color tone change similar to those obtained in Example 1 could be obtained by the combinations of the present invention. It was further revealed that, when the binder of 5) was used, substantially the same results as in Example 1 were obtained except that the image density was slightly reduced.

It was observed that the binders of 3), 4) and 5), in particular, provided further improved color tone change compared with the corresponding samples in Example 1.

Example 3

Preparation of Silver Halide Emulsion 4

1421 ml of distilled water was added with 8.0 ml of a 1 weight % potassium bromide solution, and further added with 8.2 ml of 1 N nitric acid and 20 g of phthalized gelatin. Separately, Solution A was prepared by adding distilled water to 37.04 g of silver nitrate to dilute it to 159 ml, and Solution B was prepared by diluting 32.6 g of potassium bromide with distilled water to a volume of 200 ml. To the aforementioned mixture maintained at 37° C. and stirred in a titanium-coated stainless steel reaction vessel, the whole volume of Solution A was added by the control double jet method over 1 minute at a constant flow rate while pAg was maintained at 8.1. Solution B was also added by the control double jet method. Then, the mixture was added with 30 ml of 3.5 weight % aqueous hydrogen peroxide solution, and further added with 36 ml of a 3 weight % aqueous solution of benzimidazole. Separately, Solution A2 was prepared by diluting Solution A with distilled water to a volume of 317.5 ml, and Solution B2 was prepared by dissolving tripotassium hexachloroiridate in Solution B in such an amount that its final concentration should become $1\times10^{-4}$ mole per mole of silver, and diluting the obtained solution with distilled water to a volume twice as much as the volume of Solution B, 400 ml. The whole volume of Solution A2 was added to the mixture again by the control double jet method over 10 minutes at a constant flow rate while pAg was maintained at 8.1. Solution B2 was also added by the control double jet method. Then, the mixture was added with 50 ml of a 0.5 weight % solution of 5-methyl-2-mercapto-benzimidazole in methanol. After pAg was raised to 7.5 with silver nitrate, the mixture was adjusted to pH 3.8 using 1 N sulfuric acid, and the stirring was stopped. Then, the mixture was subjected to precipitation, desalting and washing with water, added with 3.5 g of deionized gelatin and 1 N sodium hydroxide to be adjusted to pH 6.0 and pAg of 8.2 to form a silver halide dispersion.

The grains in the completed silver halide emulsion were pure silver bromide grains having a mean spherical diameter of 0.053 $\mu$m and a variation coefficient of 18% in terms of spherical diameter. The grain size and others were obtained from averages for 1000 grains by using an electron microscope. The [100] face ratio of these grains was determined to be 85% by the Kubelka-Munk method.

The aforementioned emulsion was added with 0.035 g of benzoisothiazolinone (added as a 3.5 weight % methanol solution of the compound) with stirring at 38° C., after 40 minutes since then, added with the solid dispersion (an aqueous gelatin solution) of Spectral sensitizing dye A in an amount of $5\times10^{-3}$ mole per mole of silver. After 1 minute, the mixture was warmed to 47° C., and after 20 minutes, added with $3\times10^{-5}$ mole of sodium benzenethiosulfonate per mole of silver. Further after 2 minutes, the mixture was added with Tellurium sensitizer B in an amount of $5\times10^{-5}$ mole per mole of silver followed by ripening for 90 minutes. Immediately before finishing the ripening, the mixture was added with 5 ml of a 0.5 weight % methanol solution of N,N'-dihydroxy-N"-diethylmelamine, and after lowering the temperature to 31° C., added with 5 ml of a 3.5 weight % methanol solution of phenoxyethanol, 5-methyl-2-mercaptobenzimidazole in an amount of $7\times10^{-3}$ mole per mole of silver and 1-phenyl-2-heptyl-5-mercapto-1,3,4-triazole in an amount of $6.4\times10^{-3}$ mole of per mole of silver to prepare Silver halide emulsion 4.

Preparation of Silver Halide Emulsion 5

In the same manner as the preparation of Silver halide emulsion 4 except that the liquid temperature upon forming the grains was changed from 37° C. to 50° C., a pure silver bromide cubic grain dispersion having a mean grain size of 0.08 μm as spheres and a variation coefficient of 15% for size as spheres was prepared. Further, as in the case of Silver halide emulsion 4, the steps of precipitation, desalting, washing with water and dispersion were performed. Furthermore, in the same manner as in the case of Silver halide emulsion 4 except that the addition amount of Spectral sensitizing dye A was changed to $4.5\times10^{-3}$ mole per mole of silver, the spectral sensitization, chemical sensitization and addition of 5-methyl-2-mercapto benzimidazole and 1-phenyl-2-heptyl-5-mercapto-1,3,4-traizole were performed to obtain Silver halide emulsion 5.

Preparation of Silver Halide Emulsion 6

In the same manner as the preparation of Silver halide emulsion 4 except that the liquid temperature upon forming the grains was changed from 37° C. to 27° C., a pure silver bromide cubic grain dispersion having a mean grain size of 0.038 μm as spheres and a variation coefficient of 20% for size as spheres was prepared. Further, as in the case of Silver halide emulsion 4, the steps of precipitation, desalting, washing with water and dispersion were performed. Furthermore, in the same manner as in the case of Silver halide emulsion 4 except that the addition amount of Spectral sensitizing dye A was changed to $6\times10^{-3}$ mole per mole of silver, the spectral sensitization, chemical sensitization and addition of 5-methyl-2-mercaptobenzimidazole and 1-phenyl-2-heptyl-5-mercapto-1,3,4-traizole were performed to obtain Silver halide emulsion 6.

Preparation of 25 Weight % Dispersion of Reducing Agent 100 g of a reducing agent (a compound of the general formula (I) according to the present invention or a comparative compound) and 100 g of a 20 weight % aqueous solution of denatured polyvinyl alcohol (Poval MP203, manufactured by Kuraray Co., Ltd. ) were added with 200 g of water, and mixed sufficiently to form slurry. The slurry was introduced into a ¼G vessel together with 960 g of zirconia beads having a mean diameter of 0.5 mm, and dispersed for 5 hours in a sand grinder mill (Imex Co.). Then, the beads were separated by filtration and the slurry was added with benzisothiazolinone sodium salt at a concentration of 100 ppm to obtain a 25 weight % dispersion of the reducing agent. The particles of the reducing agent contained in the dispersion of the reducing agent obtained as described above had a median diameter of 0.36–0.50 μm and the maximum particle size of 2.0 μm or less. The obtained dispersion of the reducing agent was filtered through a polypropylene filter having a pore size of 3.0 μm to remove dusts and so forth, and stored. Structures of the comparative compounds are mentioned after Table 2.

Preparation of 20 Weight % Dispersion of Compound Represented by the General Formula (A)

All of dispersions of the compounds represented by the general formula (A) (and comparative compounds) used for this example were prepared in the same manner as mentioned below.

80 g of a compound represented by the general formula (A), 80 g of a 20 weight % aqueous solution of denatured polyvinyl alcohol (Poval MP203, manufactured by Kuraray Co., Ltd.) and 8 g of 20 weight % aqueous solution of sodium triisopropyl-naphthalenesulfonate were added with 232 g of water, and mixed sufficiently to form slurry. The slurry was introduced into a ¼G vessel together with 960 g of zirconia silicate beads having a mean diameter of 0.5 mm, and dispersed for 5 hours in a sand grinder mill (Imex Co.). Then, the beads were separated by filtration and the slurry was added with benzisothiazolinone sodium salt at a concentration of 100 ppm to obtain a 20 weight % dispersion of the reducing agent. The particles of the compound represented by the formula (A) contained in the dispersion of the compound represented by the formula (A) obtained as described above had a median diameter of 0.36–0.50 μm and the maximum particle size of 2.0 μm or less. The obtained dispersion of the organic polyhalogenated compound was filtered through a polypropylene filter having a pore size of 3.0 μm to remove dusts and so forth, and stored. Structures of the comparative compounds are mentioned after Table 2.

Preparation of Dispersion of Phthalazine Compound

Preparation composition (amount in 100 g of completed dispersion) and preparation method

| | | |
|---|---|---|
| (1) | water | 87.9 g |
| (2) | Denatured polyvinyl alcohol (Poval MP-203, manufactured by Kuraray Co., Ltd.) | 2.0 g |
| (3) | 20 weight % aqueous solution of sodium triisopropylnaphthalene-sulfonate | 3.0 g |
| (4) | 6-Isopropylphthalazine (70% aqueous solution) | 7.14 g |

Dispersion was prepared by following the process steps mentioned below.

1. (1) was added with (2) at room temperature with stirring so that (2) was not coagulate, and mixed by stirring for 10 minutes.

2. Then, the mixture was heated until the internal temperature reached 50° C., and stirred for 1 hour to uniformly dissolve the materials.

3. The internal temperature was lowered to 40° C. or lower, and the mixture was added with (3) and (4) and stirred for 30 minutes to obtain a transparent dispersion.

4. The obtained dispersion was filtered through a polypropylene filter having a pore size of 3.0 μm to remove dusts and so forth, and stored.

Preparation of Coating Solution for Emulsion Layer (photosensitive layer)

1.1 g of the 20 weight % aqueous dispersion of the pigment, 103 g of the organic acid silver salt dispersion, 5 g of the 20 weight % aqueous solution of polyvinyl alcohol, PVA-205 (manufactured by Kuraray Co., Ltd.), the aforementioned 25 weight % dispersion of reducing agent (a compound of the general formula (I) or a comparative compound, type and amount are mentioned in Table 2), a dispersion of organic polyhalogenated compound (a compound of the general formula (A) or a comparative compound, type and amount are mentioned in Table 2), 106 g of the 40 weight % SBR latex purified by ultrafiltration (UF) and undergone pH adjustment, and 16 ml of the 10 weight % solution of the phthalazine compound were combined, added with 10 g of Silver halide mixed emulsion A, and mixed sufficiently to prepare a coating solution for emulsion layer. The coating solution was fed as it was to a coating die in such a feeding amount giving a coating amount of 70 ml/$m^2$ and coated. As for materials for which production methods are not explained in this example, the same materials as those used in Example 1 were used.

The viscosity of the coating solution for emulsion layer described above was measured by a B-type viscometer manufactured by Tokyo Keiki K. K. and found to be 85 [mPa.s] at 40° C. (Rotor No. 1, 60 rpm).

The viscosity of the coating solution was measured at 25° C. by an RFS fluid spectrometer produced by Rheometric Far East Co., Ltd., and found to be 1500, 220, 70, 40 and 20 [mPa.s] at shear rates of 0.1, 1, 10, 100 and 1000 [1/second], respectively.

Preparation of Coating Solution for Intermediate Layer on the Emulsion Layer Surface The same one as in Example 1 was used.

Preparation of Coating Solution for 1st Protective Layer on Emulsion Layer Surface A coating solution was prepared in the same manner as in Example 1 except that 64 ml of 10 weight % methanol solution of phthalic acid and 74 ml of 10 weight % aqueous solution of 4-methylphthalic acid were used.

Preparation of Coating Solution for 2nd Protective Layer on Emulsion Layer Surface A coating solution was prepared in the same manner as in Example 1 except that 8.1 g of phthalic acid was used.

Preparation of Photothermographic Material

On the side opposite to the back side of the support having an antihalation back layer prepared in Example 1, an emulsion layer (coated silver amount of the silver halide was 0.14 g/$m^2$), intermediate layer, first protective layer, and second protective layer were simultaneously applied in this order from the undercoat layer by the slide bead application method as stacked layers to form a sample of photothermographic material.

The coating was performed at a speed of 160 m/min. The gap between the tip of coating die and the support was set to be 0.14 to 0.28 mm, and the coated width was controlled so that it could spread by 0.5 mm each at both sides compared with the projecting slit width of the coating solution. The pressure in the reduced pressure chamber was adjusted to be lower than the atmospheric pressure by 392 Pa. In this case, handling, temperature and humidity were controlled so that the support could not be electrostatically charged, and electrostatic charge was further eliminated by ionized wind immediately before the coating. In the subsequent chilling zone, the material was blown with air showing a dry-bulb temperature of 18° C. and a wet-bulb temperature of 12° C. for 30 seconds to cool the coating solutions. Then, in the floating type drying zone in a coiled shape, the material was blown with drying air showing a dry-bulb temperature of 30° C. and a wet-bulb temperature of 18° C. for 200 seconds. Subsequently, the material was passed through a drying zone of 70° C. for 20 seconds, and then another drying zone of 90° C. for 10 seconds, and cooled to 25° C. to evaporate the solvent in the coating solution. The average wind velocities of the wind applied to the coated layer surface in the chilling zone and the drying zones were 7 m/sec. The sample prepared by coating was used for performance evaluation after it was subjected to a heat treatment at 90° C. for 5 seconds. The prepared photothermographic material showed matting degrees of 550 seconds for the photosensitive layer side, and 130 seconds for the back surface, in terms of Beck's smoothness.

Evaluation of Photographic Performance

Each photographic material was light-exposed with a laser sensitometer (details are mentioned below) and treated at 118° C. (preheating zone) for 5 seconds and then at 122° C. for 16 seconds (head development: heat development temperature=122.0° C.). Thereafter, the obtained image was evaluated by using a densitometer.

Laser Sensitometer

Two of 660 nm diode lasers with output of 35 mW, of which beams were multiplexed, Single mode, Gaussian beam spot $1/e^2$ was 100 $\mu$m, the material was transported along the feeding direction with a pitch of 25 $\mu$m, and each picture element was written four times.

Sensitivity was evaluated as a reciprocal of exposure that gave a density higher than the fog (Dmin) by 1.0, and represented with a relative value based on the value of the sample of Experiment No 2 as a standard, which was taken as 100. The sensitivity must be 95 to 105 in view of practical use.

Evaluation of Stability for Dispersions of Compounds Represented By the General Formula (A) and Comparative Compounds As evaluation of stability of the prepared solid microparticle dispersions, change in particle size before and after experimental aging (defined by the following equation) was measured for each dispersion.

Change in particle size after aging ($\mu$m)=Average particle size after aging—Average particle size before aging The particle size was measured by using a laser diffraction type particle size measurement apparatus SALD-200J (Shimadzu). Samples showing a large particle size change are not preferred, since they suffer from precipitation of dispersed particles with time and cause difficulty of filtration of coating solution.

Evaluation for Image Storability of Photosensitive Material

1. Image Storability Under Heating in Dark Place

Each sample used for the evaluation of photographic performance was illuminated under a fluorescent lamp (1000 Luxes) for 10 minutes and stored under conditions of 60° C. and 50% of relative humidity with light shielding. After storage for 24 hours, increase degree of Dmin was measured for evaluation.

2. Image Storability Under Illumination and Heating

Each sample used for the evaluation of photographic performance was stored for 8 hours under illumination by a fluorescent lamp (8500 Luxes, true light) and conditions of 40° C. and 50% of relative humidity. Then, increase degree of Dmin was measured for evaluation.

Evaluation of Environmental Temperature and Humidity Dependency

Difference of photographic performance was evaluated under the following three kinds of conditions. In order to condition a sample to the environmental conditions, the sample was left under a corresponding condition for 3 hours and then used for the experiment.

1. 25° C., Relative humidity of 50%
2. 20° C., Relative humidity of 20%
3. 30° C., Relative humidity of 70%

The environmental temperature and humidity dependency was evaluated as difference of densities obtained under the environmental conditions 2 and 3 with exposure providing density of 1.2, which corresponded to the density of the sample processed under the environmental condition 1. A smaller value of this difference means better resistance to environmental temperature and humidity change.

-continued

C-4 (melting point: 92° C.)

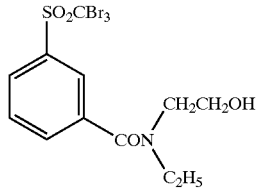

By using the combination of the present invention, there could be provided photothermographic materials that could provide appropriate sensitivity, superior image storability and superior environmental temperature and humidity dependency.

TABLE 2

| | Compound of general formula (I) | | Compound of general formula (A) | | | | | | | | | | |
|---|---|---|---|---|---|---|---|---|---|---|---|---|---|
| Exp No. | Type | Amount (mol/m$^2$) | Type | Amount (mol/m$^2$) | Change in particle size after experimental aging ($\mu$m) | Melting point (° C.) | Difference from heat development temperature (° C.) | Fresh performance: Fog | Fresh performance: Sensitivity | Image storability under heating in dark place ΔDmin | Image storability under illumination and heating ΔDmin | Environmental temperature and humidity dependency ΔD1.2 | Note |
| 1 | C-1 | $3.5 \times 10^{-3}$ | C-2 | $1.8 \times 10^{-3}$ | 0.02 | 196 | 74 | 0.15 | 80 | 0.28 | 0.15 | 0.12 | Comparative |
| 2 | I-16 | $2.3 \times 10^{-3}$ | A-21 | $1.8 \times 10^{-3}$ | 0.02 | 168 | 46 | 0.15 | 100 | 0.05 | 0.03 | 0.03 | Invention |
| 3 | I-16 | $2.3 \times 10^{-3}$ | C-2 | $1.8 \times 10^{-3}$ | 0.02 | 196 | 74 | 0.18 | 115 | 0.85 | 0.25 | 0.12 | Comparative |
| 4 | C-1 | $3.5 \times 10^{-3}$ | A-21 | $1.8 \times 10^{-3}$ | 0.02 | 168 | 46 | 0.15 | 75 | 0.06 | 0.08 | 0.12 | Comparative |
| 5 | I-4 | $2.3 \times 10^{-3}$ | A-21 | $1.8 \times 10^{-3}$ | 0.02 | 168 | 46 | 0.15 | 100 | 0.05 | 0.04 | 0.05 | Invention |
| 6 | I-16 | $2.3 \times 10^{-3}$ | C-3 | $1.8 \times 10^{-3}$ | 0.00 | 188 | 66 | 0.16 | 111 | 0.75 | 0.22 | 0.15 | Comparative |
| 7 | I-16 | $2.3 \times 10^{-3}$ | C-4 | $1.8 \times 10^{-3}$ | 0.16 | 92 | −30 | 0.15 | 85 | 0.06 | 0.03 | 0.04 | Comparative |
| 8 | I-16 | $2.3 \times 10^{-3}$ | A-4 | $1.8 \times 10^{-3}$ | 0.10 | 161 | 39 | 0.15 | 99 | 0.07 | 0.04 | 0.04 | Invention |
| 9 | I-4 | $2.3 \times 10^{-3}$ | A-4 | $1.8 \times 10^{-3}$ | 0.10 | 161 | 39 | 0.15 | 97 | 0.06 | 0.03 | 0.03 | Invention |
| 10 | I-16 | $2.3 \times 10^{-3}$ | A-1 | $1.8 \times 10^{-3}$ | 0.09 | 145 | 20 | 0.15 | 98 | 0.06 | 0.04 | 0.03 | Invention |
| 11 | I-4 | $2.3 \times 10^{-3}$ | A-1 | $1.8 \times 10^{-3}$ | 0.09 | 145 | 20 | 0.15 | 96 | 0.05 | 0.03 | 0.03 | Invention |
| 12 | I-4 | $2.3 \times 10^{-3}$ | A-2 | $1.8 \times 10^{-3}$ | 0.09 | 143 | 18 | 0.15 | 96 | 0.08 | 0.06 | 0.04 | Invention |

C-1

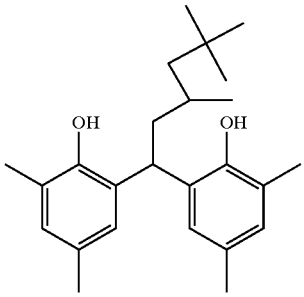

C-2 (melting point: 196° C.)

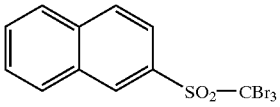

C-3 (melting point: 188° C.)

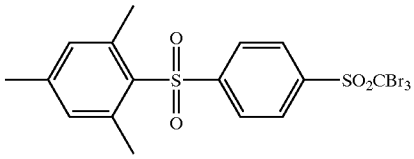

Example 4

Preparation of Silver Halide Emulsion A 11 g of alkali-treated gelatin (calcium content of 2700 ppm or less), 30 mg of potassium bromide and 1.3 g of sodium 4-methylbenzenesulfonate were dissolved in 700 ml of water, and the pH of the mixture was adjusted to 6.5 at a temperature of 40° C., and added with 159 ml of an aqueous solution containing 18.6 g of silver nitrate and an aqueous solution containing 1 mole/liter of potassium bromide, $5\times10^{-6}$ mole/liter of $(NH_4)_2RhCl_5(H_2O)$, and $2\times10^{-5}$ mole/liter of $K_3IrCl_6$ by the control double jet method over a period of 6 minutes and 30 seconds, while the pAg was kept at 7.7. Then, the solution was added with 476 ml of an aqueous solution containing 55.5 g of silver nitrate and an aqueous halide salt solution containing 1 mole/liter of potassium bromide and $2\times10^{-5}$ mole/liter of $K_3IrCl_6$ by the control double jet method over a period of 28 minutes and 30 seconds, while the pAg was kept at 7.7. Thereafter, by lowering the pH to cause aggregation and precipitation to attain a desalting treatment. The mixture was added with 51.1 g of low molecular weight gelatin having an average molecular weight of 15,000 (calcium content: 20 ppm or less), and the pH and pAg of the mixture were adjusted to 5.9 and 8.0, respectively. The obtained grains were cubic grains having a mean grain size of 0.08 μm, a variation coefficient of 9% for projected area and a [100] face ratio of 90%.

The silver halide grains obtained as described above were warmed to a temperature of 60° C., added with 76 μmoles of sodium benzenesulfonate per mole of silver, and after 3 minutes, added with 71 μmoles of triethylthiourea. Then, the mixture was ripened for 100 minutes, and added with $5\times10^{-4}$ mole of 4-hydroxy-6-methyl-1,3,3a, 7-tetrazaindene and 0.17 g of Compound A, and the temperature of the mixture was lowered to 40° C.

Thereafter, while the mixture was kept at a temperature of 40° C., the mixture was added with $4.7\times10^{-2}$ mole of potassium bromide (added as aqueous solution), $12.8\times10^{-4}$ mole of Sensitizing dye A (added as ethanol solution) and $6.4\times10^{-3}$ mole of Compound B (added as methanol solution) per mole of silver halide with stirring. After 20 minutes, the mixture was quenched to 30° C. to finish the preparation of Silver halide emulsion A.

Sensitizing dye A

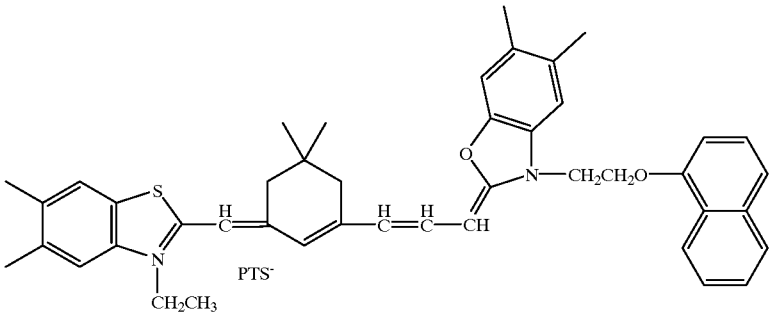

Compound A

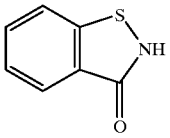

Compound B

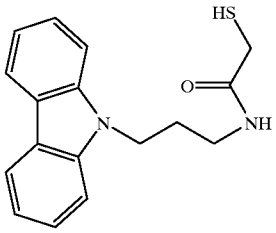

Preparation of Silver Behenate Dispersion A 87.6 g of behenic acid (Edenor C22-85R, trade name, manufactured by Henkel Co.), 423 ml of distilled water, 49.2 ml of a 5 N aqueous solution of NaOH, and 120 ml of tert-butanol were mixed and allowed to react with stirring at 75° C. for one hour to obtain a solution of sodium behenate. Separately, 206.2 ml of an aqueous solution containing 40.4 g of silver nitrate was prepared and kept at 10° C. A mixture of 635 ml of distilled water and 30 ml of tert-butanol contained in a reaction vessel kept at 30° C. was added with the whole amount of the aforementioned sodium behenate solution and the whole amount of the aqueous silver nitrate solution with stirring at constant flow rates over the periods of 62 minutes and 10 seconds, and 60 minutes, respectively. In this case, the aqueous silver nitrate solution was added in such a manner that only the aqueous silver nitrate solution should be added for 7 minutes and 20 seconds after starting the addition of the aqueous silver nitrate solution, and then the addition of the aqueous solution of sodium behenate was started and added in such a manner that only the aqueous solution of sodium behenate should be added for 9 minutes and 30 seconds after finishing the addition of the aqueous silver nitrate solution. In this operation, the outside temperature was controlled so that the temperature in the reaction vessel could be 30° C. and the liquid temperature should be constant. The piping of the addition system for the sodium behenate solution was warmed by steam trace and the steam opening was controlled such that the liquid temperature at the outlet orifice of the addition nozzle should be 75° C. The piping of the addition system for the aqueous silver nitrate solution was maintained by circulating cold water outside a double pipe. The addition position of the sodium behenate solution and the addition position of the aqueous silver nitrate solution were arranged symmetrically with respect to the stirring axis as the center, and the positions are controlled to be at heights for not contacting with the reaction mixture.

After finishing the addition of the sodium behenate solution, the mixture was left with stirring for 20 minutes at the same temperature and then the temperature was decreased to 25° C. Thereafter, the solid content was recovered by suction filtration and the solid content was washed with water until electric conductivity of the filtrate became 30 μS/cm. The solid content obtained as described above was stored as a wet cake without being dried.

When the shape of the obtained silver behenate grains was evaluated by an electron microscopic photography, the grains were scaly crystals having a mean diameter of projected areas of 0.52 μm, a mean thickness of 0.14 μm and a variation coefficient of 15% for mean diameter as spheres.

Then, dispersion of silver behenate was prepared as follows. To the wet cake corresponding to 100 g of the dry solid content was added with 7.4 g of polyvinyl alcohol (PVA-217, trade name, average polymerization degree: about 1700) and water to make the total amount 385 g, and the mixture was pre-dispersed by a homomixer. Then, the pre-dispersed stock dispersion was treated three times by using a dispersing machine (Microfluidizer-M-110S-EH; trade name, manufactured by Microfluidex International Corporation, using G10Z interaction chamber) with a pressure controlled to be 1750 kg/cm$^2$ to obtain Silver behenate dispersion A. During the cooling operation, a desired dispersion temperature was achieved by providing coiled heat exchangers fixed before and after the interaction chamber and controlling the temperature of the refrigerant.

The silver behenate grains contained in Silver behenate dispersion A obtained as described above were grains having a volume weight mean diameter of 0.52 μm and a coefficient of variation of 15%. The measurement of the grain size was carried out by using Master Sizer X manufactured by Malvern Instruments Ltd. When the grains were evaluated by an electron microscopic photography, the ratio of the long side to the short side was 1.5, the grain thickness was 0.14 μm and a mean aspect ratio (ratio of diameter as sphere of projected area of grain and grain thickness) was 5.1.

Preparation of 25 Weight % Dispersion of Reducing Agent

Dispersion was prepared in the same manner as in Example 3 as for both of the compounds represented by the general formula (I) and comparative compounds. As for types of materials, the same materials as used in Example 3 were used.

Preparation of 20 Weight % Dispersion of Compound Represented By the General Formula (A)

Dispersion was prepared in the same manner as in Example 3 as for both of the compounds represented by the general formula (A) and comparative compounds. As for types of materials, the same materials as used in Example 3 were used.

Preparation of Aqueous Solution of Polyhalogenated Compound C

Preparation composition (amount in 100 g of completed dispersion) and preparation method

| | | |
|---|---|---|
| (1) | Water | 75.0 g |
| (2) | 20 weight % Aqueous solution of sodium triisopropylnaphthalene-sulfonate | 8.6 ml |
| (3) | 5% Aqueous solution of sodium dihydrogenorthophosphate dihydrate | 6.8 ml |
| (4) | 1 mol/L Aqueous solution of potassium hydroxide | 9.5 ml |
| (5) | 3-Tribromomethanesulfonyl-benzoaminoacetic acid | 4.0 g |

A solution was prepared by following the process steps mentioned below.

1. (1) to (4) was added successively with stirring at room temperature, and the mixture was stirred for 5 minutes after the addition of (4).

2. Further, (5) was added with stirring, and the materials were uniformly dissolved until the solution became transparent.

3. The obtained dispersion was filtered through a polyester screen of 200 mesh to remove dusts and so forth, and stored.

Preparation of Emulsion-dispersion of Compound Z 10 kg of R-054 produced by Sanko Co., ltd., which contained 85 weight % of Compound Z, and 11.66 kg of MIBK were mixed, then added with 25.52 kg of water, 12.76 kg of 20 weight % aqueous solution of MP polymer (MP-203, manufactured by Kuraray Co., Ltd.) and 0.44 kg of 20 weight % aqueous solution of sodium triisopropylnaphthalenesulfonate, and emulsion-dispersed at 20–40° C. and 3600 rpm for 60 minutes. The liquid was further addedwith 0.08 kg of Safinol 104E manufactured by Nisshin Kagaku K. K. and 47.94 kg of water and distilled under reduced pressure to remove MIBK. Then, the concentration of Compound Z was adjusted to 10 weight %. The particles of Compound Z contained in the dispersion obtained as described above had a median diameter of 0.19 μm, the maximum particle diameter of 1.5 μm or less and a variation coefficient of 17% for the mean particle diameter. The obtained dispersion was filtered through a polypropylene filter having a pore size of 3.0 μm to remove dusts and so forth, and stored.

Preparation of Dispersion of 6-isopropylphthalazine

Preparation composition (amount in 100 g of completed dispersion) and preparation method

| | | |
|---|---|---|
| (1) | Water | 15.0 g |
| (2) | Denatured polyvinyl alcohol (Poval MP-203, manufactured by Kuraray Co., Ltd.) | 2.0 g |
| (3) | 10% Aqueous solution of polyvinyl alcohol (PVA-217, manufactured by Kuraray Co., Ltd.) | 17.0 g |
| (4) | 20% Aqueous solution of sodium triisopropylnaphthalene-sulfonate | 3.0 g |
| (4) | 6-Isopropylphthalazine (70% aqueous solution) | 7.15 g |

Dispersion was prepared by the following process steps.

1. (1) was added with (2) at room temperature with stirring so that (2) was not coagulate, and mixed by stirring for 10 minutes.

2. Then, the mixture was heated until the internal temperature reached 50° C., and uniformly dissolved by stirring for 90 minutes.

3. The internal temperature was lowered to 40° C. or lower, and the mixture was added with (3) , (4) and (5) and stirred for 30 minutes to obtain a transparent dispersion.

4. The obtained dispersion was filtered through a polypropylene filter having a pore size of 3.0 μm to remove dusts and so forth, and stored.

Preparation of Solid Microparticle Dispersion of Nucleating Agent 4 kg of Nucleating agent A was added with 1 kg of Poval (PVA-217, manufactured by Kuraray Co., Ltd.) and 36 kg of water, and mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 12 hours. Then, the slurry was added with 4 g of benzisothiazolinone sodium salt and water so that the concentration of the nucleating agent could become 10 weight % to obtain a microparticle dispersion of nucleating agent. The particles of the nucleating agent contained in the dispersion obtained as described above had a median diameter of 0.34 μm, the maximum particle diameter of 3.0 μm or less, and variation coefficient of 19% for the particle diameter. The obtained dispersion was filtered through a polypropylene filter having a pore size of 3.0 μm to remove dusts and so forth, and stored.

Preparation of Solid Microparticle Dispersion of Development Accelerator A 10 kg of Development accelerator A (N-[4-(3,5-dichlorohydroxyphenylsulfamoyl)phenyl]acetamide) and 10 kg of 20 weight % aqueous solution of denatured polyvinyl alcohol (Poval MP203, manufactured by Kuraray Co., Ltd.) were added with 20 kg of water, and mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 5 hours. Then, the slurry was added with water so that the concentration of Nucleating agent A could become 20 weight % to obtain a microparticle dispersion of Nucleating agent A. The particles of the nucleating agent contained in the dispersion obtained as described above had a median diameter of 0.5 μm, the maximum particle size of 2.0 μm or less, and variation coefficient of 18% for the mean particle diameter. The obtained dispersion was filtered through a polypropylene filter having a pore size of 3.0 μm to remove dusts and so forth, and stored.

Preparation of Coating Solution for Image-forming Layer

The binder, raw materials shown below and Silver halide emulsion A were added to Silver behenate dispersion A prepared above in the indicated amounts per one mole of silver in the dispersion, and water was added to the mixture to form a coating solution for image-forming layer. After the completion, the coating solution was degassed under reduced pressure of 0.54 atm for 45 minutes. The coating solution showed pH of 7.3–7.7, and had a viscosity of 45–50 mPa.s at 25° C.

| | |
|---|---|
| Binder: LACSTAR 3307B (SBR latex, produced by Dai-Nippon Ink & Chemicals, Inc., glass transition temperature: 17° C.) | 397 g as solid |
| Reducing agent (compound of the general formula (I) or comparative compound) | Type and amount are shown in Table 3 |
| Compound of the general formula (A) or comparative compound | Type and amount are shown in Table 3 |
| Organic polyhalogenated compound C (melting point: 180° C.) | 2.25 g as solid |
| Sodium ethylthiosulfonate | 0.30 g |
| 4-Methylbenzotriazole | 1.02 g |
| Polyvinyl alcohol (PVA-235, produced by Kuraray Co., Ltd.) | 10.8 g |
| 6-Isopropylphthalazine | 15.0 g |
| Compound Z | 9.7 g as solid |
| Nucleating agent A | 14.7 g as solid |

-continued

| | |
|---|---|
| Dye A (added as a mixture with low molecular weight gelatin having average molecular weight of 15000) | Amount giving optical density of 0.15 at 783 nm (about 0.19 g) |
| Silver halide emulsion A | 0.06 mole as Ag |
| Compound A as preservative | 40 ppm in the coating solution (2.5 mg/m$^2$ as coated amount) |
| Methanol | 2 weight % as to total solvent amount in the coating solution |
| Ethanol | 1 weight % as to total solvent amount in the coating solution |

(The coated film showed a glass transition temperature of 17° C.)

Compound C

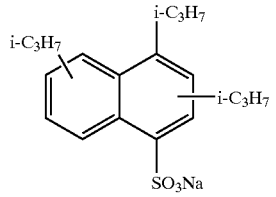

Compound Z

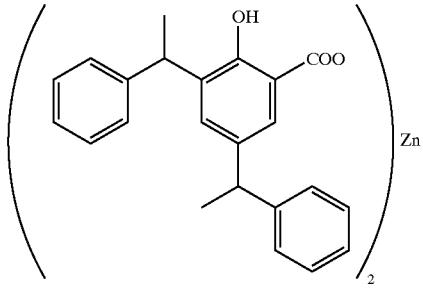

Dye A

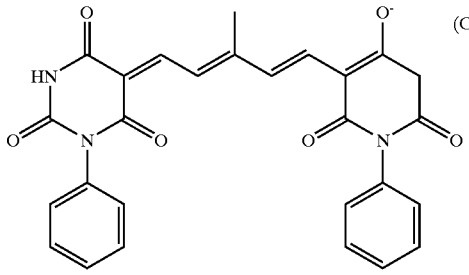

Polyhalogenated compound C

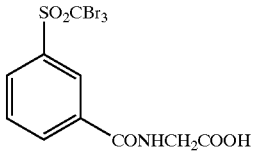

-continued

Nucleating agent A

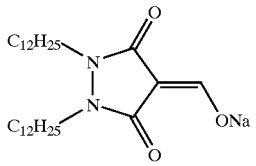

Preparation of Coating Solution for Lower Protective Layer 943 g of a polymer latex solution containing copolymer of methyl methacrylate/styrene/2-ethylhexyl acrylate/2-hydroxyethylmethacrylate/acrylic acid=58.9/8.6/25.4/5.1/2 (weight %) (glass transition temperature as copolymer: 46° C. (calculated value), solid content: 21.5 weight %, containing 100 ppm of Compound A and Compound D as a film-forming aid in an amount of 15 weight % relative to solid content of the latex so that the glass transition temperature of the coating solution could become 24° C., average particle diameter: 116 nm) was added with water, 1.62 g of Compound E, 112.7 g of aqueous solution of Organic polyhalogenated compound C, 11.54 g as solid content of Development accelerator A, 1.58 g of matting agent (polystyrene particles, average diameter: 7 μm, variation coefficient of 8% for average particle size) and 29.4 g of polyvinyl alcohol (PVA-235, Kuraray Co., Ltd.) and further added with water to form a coating solution (containing 2 weight % of methanol solvent). After the completion, the solution was degassed under reduced pressure of 0.47 atm for 60 minutes. The coating solution showed pH of 5.4, and had a viscosity of 39 mPa.s at 25° C.

Preparation of Coating Solution for Upper Protective Layer 649 g of polymer latex solution containing copolymer of methyl methacrylate/styrene/2-ethylhexyl acrylate/2-hydroxyethyl methacrylate/acrylic acid=58.9/8.6/25.4/5.1/2 (weight %) (glass transition temperature as copolymer: 46° C. (calculated value), solid content: 21.5 weight %, containing 100 ppm of Compound A and Compound D as a film-forming aid in an amount of 15 weight % relative to solid content of the latex so that the glass transition temperature of the coating solution could become 24° C., average particle diameter: 72 nm) was added with water, 6.30 g of 30 weight % solution of carnauba wax (Cellosol 524, silicone content: less than 5 ppm, Chukyo Yushi Co., Ltd.), 0.23 g of Compound C, 0.93 g of Compound E, 7.95 g of Compound F, 1.8 g of Compound H, 1.18 g of matting agent (polystyrene particles, mean particle diameter: 7 μm, variation coefficient of 8% for mean particle diameter) and 12.1 g of polyvinyl alcohol (PVA-235, Kuraray Co., Ltd.), and further added with water to form a coating solution (containing 1.5 weight % of methanol solvent). After the completion, the solution was degassed under reduced pressure of 0.47 atm for 60 minutes. The coating solution showed pH of 2.8, and had a viscosity of 30 mPa.s at 25° C.

Compound D

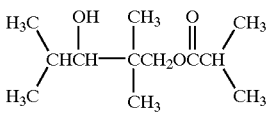

-continued

Compound E

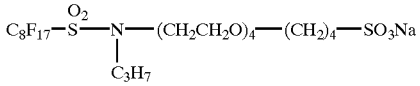

Compound F

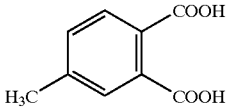

Compound G

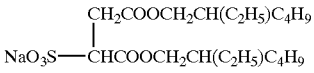

Compound H

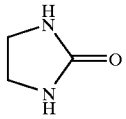

Development accelerator A

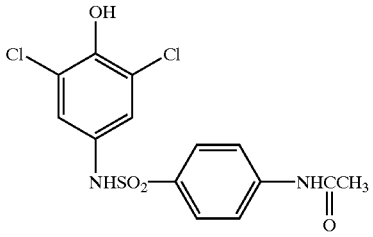

Preparation of PET Support With Back Layer and Undercoat Layer (1) Preparation of PET Support Polyethylene terephthalate having IV (intrinsic viscosity) of 0.66 (measured in phenol/tetrachloroethane=6/4 (weight ratio) at 25° C.) was obtained by using terephthalic acid and ethylene glycol in a conventional manner. The product was pelletized, dried at 130° C. for 4 hours, melted at 300° C., then extruded from a T-die and rapidly cooled to form an unstretched film having a thickness of 120 μm after thermal fixation.

The film was stretched along the longitudinal direction by 3.3 times using rollers of different peripheral speeds, and then stretched along the transverse direction by 4.5 times using a tenter. The temperatures used for these operations were 110° C. and 130° C., respectively. Then, the film was subjected to thermal fixation at 240° C. for 20 seconds, and relaxed by 4% along the transverse direction at the same temperature. Then, the chuck of the tenter was released, the both edges of the film were knurled, and the film was rolled up at 4.8 kg/cm$^2$. Thus, a roll of a PET support having a width of 2.4m, length of 3500m, and thickness of 120 μm was obtained.

(2) Preparation of Undercoat Layer and Back Layer (i) First Undercoat Layer

The aforementioned PET support was subjected to a corona discharge treatment of 0.375 kV.A.minute/m$^2$, then coated with a coating solution having the following composition in an amount of 6.2 ml/m$^2$, and dried at 125° C. for 30 seconds, 150° C. for 30 seconds, and 185° C. for 30 seconds.

| | |
|---|---|
| Latex A | 280 g |
| KOH | 0.5 g |
| Polystyrene microparticles (average particle diameter; 2 μm, variation coefficient of 7% for average particle diameter) | 0.03 g |
| 2,4-Dichloro-6-hydroxy-s-triazine | 1.8 g |
| Compound Bc-C | 0.097 g |
| Distilled water | Amount giving total weight of 1000 g |

(ii) Second Undercoat Layer

A coating solution having the following composition was coated on the first undercoat layer in an amount of 5.5 ml/m$^2$ and dried at 125° C. for 30 seconds, 150° C. for 30 seconds, and 170° C. for 30 seconds.

| | |
|---|---|
| Deionized gelatin ($Ca^{2+}$ content; 0.6 ppm, jelly strength; 230 g) | 10.0 g |
| Acetic acid (20% aqueous solution) | 10.0 g |
| Compound Bc-A | 0.04 g |
| Methylcellulose (2% aqueous solution) | 25.0 g |
| Polyethylene oxide compound | 0.3 g |
| Distilled water | Amount giving total weight of 1000 g |

(iii) First Back Layer

The surface of the support opposite to the surface coated with the undercoat layers was subjected to a corona discharge treatment of 0.375kV.A.minute/m$^2$, coated with a coating solution having the following composition in an amount of 13.8 ml/m$^2$, and dried at 125° C. for 30 seconds, 150° C. for 30 seconds, and 185° C. for 30 seconds.

| | |
|---|---|
| Julimer ET-410 (30% aqueous dispersion Nihon Junyaku Co., Ltd.) | 23.0 g |
| Alkali-treated gelatin (molecular weight; about 10000, $Ca^{2+}$ content; 30 ppm) | 4.44 g |
| Deionized gelatin ($Ca^{2+}$ content; 0.6 ppm) | 0.84 g |
| Compound Bc-A | 0.02 g |
| Dye Bc-A | Amount giving optical density of 1.3–1.4 at 783 nm, about 0.88 g |
| Polyoxyethylene phenyl ether | 1.7 g |
| Sumitex Resin M-3 (8% aqueous solution, water-soluble melamine compound, Sumitomo Chemical Co., Ltd.) | 15.0 g |
| FS-10D (aqueous dispersion of Sb-doped $SbO_2$ acicular grains, Ishihara Sangyo Kaisha, Ltd.) | 24.0 g |
| Polystyrene microparticles (average diameter; 2.0 μm, variation coefficient of 7% for average particle diameter) | 0.03 g |
| Distilled water | Amount giving total weight of 1000 g |

(iv) Second Back Layer

A coating solution having the following composition was coated on the first back layer in an amount of 5.5 ml/m$^2$ and dried at 125° C. for 30 seconds, 150° C. for 30 seconds, and 170° C. for 30 seconds.

| | |
|---|---|
| Julimer ET-410 (30% aqueous dispersion Nihon Junyaku Co., Ltd.) | 57.5 g |
| Polyoxyethylene phenyl ether | 1.7 g |
| Sumitex Resin M-3 (8% aqueous solution, water-soluble melamine resin, Sumitomo Chemical Co., Ltd.) | 15.0 g |
| Cellosol 524 (30% aqueous solution, Chukyo Yushi Co., Ltd.) | 6.6 g |
| Distilled water | Amount giving total weight of 1000 g |

(v) Third Back Layer

The same coating solution as the first undercoat layer was coated on the second back layer in an amount of 6.2 ml/m$^2$ and dried at 125° C. for 30 seconds, 150° C. for 30 seconds, and 185° C. for 30 seconds.

(vi) Fourth Back Layer

A coating solution having the following composition was coated on the third back layer in an amount of 13.8 ml/m$^2$ and dried at 125° C. for 30 seconds, 150° C. for 30 seconds, and 170° C. for 30 seconds.

| | |
|---|---|
| Latex B | 286 g |
| Compound Bc-B | 2.7 g |
| Compound Bc-C | 0.6 g |
| Compound Bc-D | 0.5 g |
| 2,4-Dichloro-6-hydroxy-s-triazine | 2.5 g |
| Polymethyl methacrylate (10% aqueous dispersion, average diameter: 5.0 μm, variation coefficient of 7% for average particle diameter) | 7.7 g |
| Distilled water | Amount giving total weight of 1000 g |

Dye Bc-A

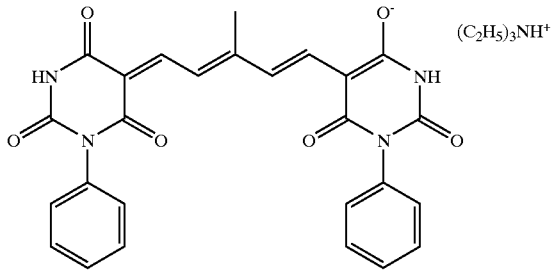

Compound Bc-A

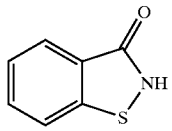

Compound Bc-B $C_{18}H_{37}OSO_3Na$

Compound Bc-C $C_8F_{17}SO_3Li$

-continued

Compound Bc-D

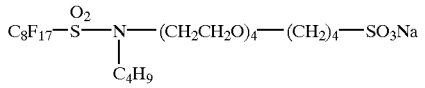

Latex A

Core/shell type latex comprising 90 weight % of core and 10 weight % of shell, core: vinylidene chloride/methyl acrylate/methyl methacrylate/acrylonitrile/acrylic acid=93/3/3/0.9/0.1 (weight %), shell: vinylidene chloride/methyl acrylate/methyl methacrylate/acrylonitrile/acrylic acid=88/3/3/3/3 (weight %), weight average molecular weight; 38000

Latex B

Latex of copolymer of methyl methacrylate/styrene/2-ethylhexyl acrylate/2-hydroxyethyl methacrylate/acrylic acid=59/9/26/5/1 (weight %)

(3) Heat Treatment During Transportation (3-1) Heat Treatment

The PET support with back layers and undercoat layers prepared as described above was introduced into a heat treatment zone having a total length of 200 m set at 160° C., and transported at a tension of 2 kg/cm$^2$ and a transportation speed of 20 m/minute.

(3-2) Post-heat Treatment

Following the aforementioned heat treatment, the support was passed through a zone at 40° C. for 15 seconds, and rolled up. The rolling up tension for this operation was 10 kg/cm$^2$.

Preparation of Photothermographic Material

On the undercoat layers of the aforementioned PET support on the side coated with the first and second undercoat layers, the aforementioned coating solution for image-forming layer was coated so that the coated silver amount could be 1.5 g/m$^2$ by the slide bead method disclosed in Japanese Patent Application No. 10-292849, FIG. 1. Further, the coating solution for lower protective layer was coated on the image-forming layer simultaneously with the coating solution for image-forming layer as stacked layers, so that the coated solid content of the polymer latex could be 1.31 g/m$^2$. Then, the coating solution for upper protective layer was coated on the coated layers, so that the coated solid content of the polymer latex could be 3.11 g/m$^2$ to obtain a photothermographic material.

After the coating, the layers were dried in a horizontal drying zone (the support is at an angle of 1.5–3° to the horizontal direction of the coating machine) under the following conditions: dry-bulb temperature of 70–75° C., dew point of 8–25° C. and liquid film surface temperature of 35–40° C. for both of the constant rate drying process and the decreasing rate drying process. After the drying, the material was rolled up under the conditions of a temperature of 25±5° C. and relative humidity of 45±10%, and the material was rolled up so that the image-forming layer could be exposed to the outside so as to conform to the subsequent processing (image-forming layer outside roll). The humidity in the package of the photosensitive material was 20–40% relative humidity (measured at 25° C.). The obtained photothermographic material showed a film surface pH of 5.0 and Beck's smoothness of 850 seconds for the image-forming layer side. The opposite surface showed a film surface pH of 5.9 and Beck's smoothness of 560 seconds.

Evaluation of Photographic Performance (Light exposure)

The obtained photothermographic material was light exposed for $1\times10^{-8}$ second by using a laser light-exposure apparatus of single channel cylindrical inner surface type provided with a semiconductor laser with a beam diameter (½ of FWHM of beam intensity) of 12.56 $\mu$m, laser output of 50 mW and output wavelength of 783 nm. The exposure time was adjusted by controlling the mirror revolution number, and exposure was adjusted by changing output. The overlap coefficient of the light exposure was 0.449.

Heat Development

Each light-exposed photothermographic material was heat-developed by using a heat-developing apparatus as shown in FIG. 1. The roller surface material of the heat development section was composed of silicone rubber, and the flat surface consisted of Teflon non-woven fabric. The heat development was performed (heat development temperature was 120° C.) at a transportation linear speed of 25 mm/second in the preheating section for 12.2 seconds (Driving units of the preheating section and the heat development section were independent from each other, and speed difference as to the heat development section was adjusted to −0.5% to −1%. Temperatures of the metallic rollers and processing times for each preheating part are as follows: first roller, 67° C. for 2.0 seconds; second roller, 82° C. for 2.0 seconds; third roller, 98° C. for 2.0 seconds; fourth roller, 107° C. for 2.0 seconds; fifth roller, 115° C. for 2.0 seconds; and sixth roller, 120° C. for 2.0 seconds), in the heat development section at 120° C. (surface temperature of photothermographic material) for 17.2 seconds, and in the gradual cooling section for 13.6 seconds. The temperature precision as for the transverse direction was ±0.5° C. As for each roller temperature setting, the temperature precision was secured by using a length of rollers longer than the width of the photothermographic material (for example, width of 61 cm) by 5 cm for the both sides and also heating the protruding portions. Since the rollers showed marked temperature decrease at the both end portions, the temperature of the portions protruding by 5 cm from the end of the photothermographic material was controlled to be higher than that of the roller center by 1–3° C., so that uniform image density of a finished developed image could be obtained for the whole photothermographic material surface (for example, within a width of 61 cm).

Evaluation of Photographic Performance

The obtained image was evaluated by Macbeth TD904 densitometer (visible density). The measurement results were evaluated as Dmin (fog) and sensitivity (evaluated as a reciprocal of the ratio of the exposure giving a density 1.5 higher than Dmin, and expressed as a relative value based on the value of Photothermographic material 2 shown in Table 3, which was taken as 100)

Evaluation of Environmental Temperature and Humidity Dependency

Difference of photographic performance was evaluated under the following three kinds of conditions. In order to condition a sample to the environmental conditions, the sample was left under a corresponding condition for 3 hours and then used for the experiment.

1. 25° C., Relative humidity of 50%
2. 20° C., Relative humidity of 20%

3. 30° C., Relative humidity of 70%

The environmental temperature and humidity dependency was evaluated as difference of line widths obtained under the environmental conditions 2 and 3 with exposure providing line width of 100 μm, which corresponded to the line width of the sample processed under the environmental condition 1. A smaller difference of line widths means better resistance to environmental temperature and humidity change. The other evaluations were performed in the same manner as in Example 3. The results of the aforementioned evaluations for the photothermographic materials are shown in Table 3. Effects similar to those observed in Example 3 were obtained, and thus the advantages of the present invention were clearly demonstrated.

TABLE 3

| | Compound of general formula (I) | | Compound of general formula (A) | | | | | Fresh performance | | Image storability under heating in dark | Image storability under illumination and heating | Environmental temperature and humidity dependency Δ(line width) | |
|---|---|---|---|---|---|---|---|---|---|---|---|---|---|
| Exp No. | Type | Amount (mol/m²) | Type | Amount (mol/m²) | Change in particle size after experimental aging (μm) | Melting point (° C.) | Difference from heat development temperature (° C.) | Fog | Sensitivity | place ΔDmin | ΔDmin | (μm) | Note |
| 1 | C-1 | $3.5 \times 10^{-3}$ | C-2 | $1.8 \times 10^{-3}$ | 0.02 | 196 | 76 | 0.06 | 79 | 0.51 | 0.25 | 17.5 | Comparative |
| 2 | I-16 | $2.3 \times 10^{-3}$ | A-21 | $1.8 \times 10^{-3}$ | 0.02 | 168 | 48 | 0.06 | 100 | 0.06 | 0.04 | 5.4 | Invention |
| 3 | I-16 | $2.3 \times 10^{-3}$ | C-2 | $1.8 \times 10^{-3}$ | 0.02 | 196 | 76 | 0.12 | 115 | 0.95 | 0.32 | 13.5 | Comparative |
| 4 | C-1 | $3.5 \times 10^{-3}$ | A-21 | $1.8 \times 10^{-3}$ | 0.02 | 168 | 48 | 0.06 | 76 | 0.07 | 0.08 | 14.5 | Comparative |
| 5 | I-4 | $2.3 \times 10^{-3}$ | A-21 | $1.8 \times 10^{-3}$ | 0.02 | 168 | 48 | 0.06 | 99 | 0.06 | 0.03 | 5.8 | Invention |
| 6 | I-16 | $2.3 \times 10^{-3}$ | C-3 | $1.8 \times 10^{-3}$ | 0.00 | 188 | 68 | 0.06 | 112 | 1.35 | 0.26 | 15.7 | Comparative |
| 7 | I-16 | $2.3 \times 10^{-3}$ | C-4 | $1.8 \times 10^{-3}$ | 0.16 | 92 | −28 | 0.06 | 86 | 0.06 | 0.03 | 6.5 | Comparative |
| 8 | I-16 | $2.3 \times 10^{-3}$ | A-4 | $1.8 \times 10^{-3}$ | 0.10 | 161 | 41 | 0.06 | 100 | 0.08 | 0.05 | 6.5 | Invention |
| 9 | I-4 | $2.3 \times 10^{-3}$ | A-4 | $1.8 \times 10^{-3}$ | 0.10 | 161 | 41 | 0.06 | 96 | 0.08 | 0.04 | 6.3 | Invention |
| 10 | I-16 | $2.3 \times 10^{-3}$ | A-1 | $1.8 \times 10^{-3}$ | 0.09 | 145 | 25 | 0.06 | 99 | 0.08 | 0.05 | 6.4 | Invention |
| 11 | I-4 | $2.3 \times 10^{-3}$ | A-1 | $1.8 \times 10^{-3}$ | 0.09 | 145 | 25 | 0.06 | 95 | 0.08 | 0.04 | 6.3 | Invention |

All of the samples contained Organic polyhalogenated compound C (melting point 180° C. (difference from the heat development temperature: 60° C.))

What is claimed is:

1. A photothermographic material comprising a non-photosensitive silver salt of an organic acid, a photosensitive silver halide, a reducing agent for silver ions and a binder on one surface of a support, wherein content of the reducing agent is 0.4–3.5 mmol/m², and the reducing agent contains at least one compound represented by the following formula (I):

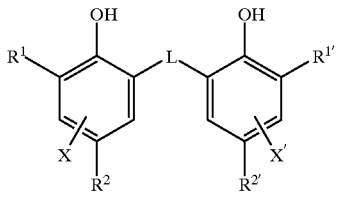

wherein $R^1$ and $R^{1'}$ each independently represent an alkyl group, at least one of which is a secondary or tertiary alkyl group; $R^2$ and $R^{2'}$ each independently represent hydrogen atom or a group that can be a substituent on benzene ring; L represents —S— group or a —CH($R^3$)— group where $R^3$ represents hydrogen atom or an alkyl group; and X and X' each independently represent hydrogen atom or a group that can be a substituent on benzene ring.

2. The photothermographic material according to claim 1, wherein, in the formula (I), $R^1$ and $R^{1'}$ each independently represent a secondary or tertiary alkyl group, $R^2$ and $R^{2'}$ each independently represents an alkyl group, L represents a —CH($R^3$)— group, and X and X' both represent hydrogen atom.

3. The photothermographic material according to claim 2, wherein, in the formula (I), $R^1$ and $R^{1'}$ each independently represent a tertiary alkyl group, and $R^3$ represent an alkyl group.

4. The photothermographic material according to claim 2, wherein, in the formula (I) , $R^1$ and $R^{1'}$ each independently represent a tertiary alkyl group, $R^2$ and $R^{2'}$ each independently represents an alkyl group having 2 or more carbon atoms, and $R^3$ represent hydrogen atom.

5. The photothermographic material according to claim 1, wherein the content of the reducing agent is 0.4–3.0 mmol/m².

6. The photothermographic material according to claim 1, wherein the binder has an average glass transition point of 10–60° C.

7. The photothermographic material according to claim 1, wherein the non-photosensitive silver salt of an organic acid, the photosensitive silver halide and the reducing agent for silver ions are coated as an aqueous solvent coating solution comprising aqueous polymer latex as the binder.

8. The photothermographic material according to claim 7, wherein the coating solution contains the reducing agent as solid dispersion.

9. The photothermographic material according to claim 7, wherein the coating solution contains an isothiazolinone compound.

10. A photothermographic material comprising a non-photosensitive silver salt of an organic acid, a photosensitive silver halide, a reducing agent for silver ions and a binder on one surface of a support, wherein the photothermographic material contains, as the reducing agent, at least one compound represented by the following formula (I):

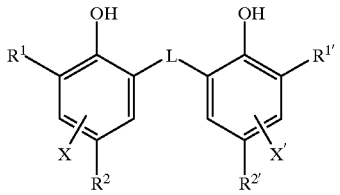

wherein $R^1$ and $R^{1'}$ each independently represent an alkyl group, at least one of which is a secondary or tertiary alkyl group; $R^2$ and $R^{2'}$ each independently represent hydrogen atom or a group that can be a substituent on benzene ring; L represents —S— group or a —CH($R^3$)— group where $R^3$ represents hydrogen atom or an alkyl group; and X and X' each independently represent hydrogen atom or a group that can be a substituent on benzene ring, and at least one compound represented by the following formula (A):

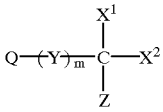

wherein Q represents an alkyl group, an aryl group or a heterocyclic group; $X^1$ and $X^2$ each independently represent a halogen atom; Z represents hydrogen atom or an electron withdrawing group; Y represents —C(=O)—, —SO— or —$SO_2$; and m represents 0 or 1, which has a melting point not lower than a heat development temperature for the photothermographic material by more than 10° C. but not higher than the heat development temperature by more than 55° C.

11. The photothermographic material according to claim 10, wherein, in the formula (I), $R^1$ and $R^{1'}$ each independently represent a secondary or tertiary alkyl group, $R^2$ and $R^{2'}$ each independently represents an alkyl group, L represents a —CH($R^3$)— group, and X and X' both represent hydrogen atom.

12. The photothermographic material according to claim 11, wherein, in the formula (I), $R^1$ and $R^{1'}$ each independently represent a tertiary alkyl group, and $R^3$ represent an alkyl group.

13. The photothermographic material according to claim 11, wherein, in the formula (I), $R^1$ and $R^{1'}$ each independently represent a tertiary alkyl group, $R^2$ and $R^{2'}$ each independently represents an alkyl group having 2 or more carbon atoms, and $R^3$ represent hydrogen atom.

14. The photothermographic material according to claim 10, wherein, in the formula (A), Q represents a phenyl group having a carbamoyl substituent.

15. The photothermographic material according to claim 10, wherein, in the formula (A), Z represents a halogen atom.

16. The photothermographic material according to claim 10, wherein, in the formula (A), m represents 0.

17. The photothermographic material according to claim 10, wherein, in the formula (A), Y represents —$SO_2$—.

18. The photothermographic material according to claim 10, wherein content of the compound represented by the formula (A) is $1\times10^{-6}$ to 0.5 mole per mole of silver.

19. The photothermographic material according to claim 10, wherein the binder has an average glass transition point of 10–60° C.

20. The photothermographic material according to claim 10, wherein the non-photosensitive silver salt of an organic acid, the photosensitive silver halide and the reducing agent for silver ions are coated as an aqueous solvent coating solution comprising aqueous polymer latex as the binder.

21. The photothermographic material according to claim 10, wherein, in the formula (A), Q represents an alkyl group, an aryl group or a heterocyclic group except for 6-membered heterocyclic group having more than one to four nitrogen atoms.

22. The photothermographic material according to claim 10, wherein, in the formula (A), Q represents a substituted or unsubstituted pyrrolidine, piperidine, piperazine, morpholine, thiophene, furan, pyrrole, imidazole, pyrazole, pyridine, triazole, indole, indazole, thiadiazole, oxadiazole, quinoline, naphthyridine, acridine, pheanathroline, tetrazole, thiazole, oxazole, benzimidazole, benzoxazole, benzthiazole, benzoselenazole, indolenine, imidazole, pyrazole, triazole, triazine, indole, indazole, thiadiazole, oxadiazole, quinoline, naphthyridine, acridine, phenanthroline, phenazine, tetrazole, thiazole, oxazole, benzimidazole, benzoxazole, benzthiazole or indolenine.

* * * * *